US009862214B2

(12) United States Patent
Suzuki et al.

(10) Patent No.: US 9,862,214 B2
(45) Date of Patent: Jan. 9, 2018

(54) RECORDING APPARATUS FOR REDUCING DISCHARGE POSITION DEVIATION OF DISCHARGED INK, AND RECORDING METHOD FOR THE SAME

(71) Applicant: CANON KABUSHIKI KAISHA, Tokyo (JP)

(72) Inventors: Fumiko Suzuki, Kawasaki (JP); Hirokazu Tanaka, Inagi (JP); Gou Sasaki, Kawasaki (JP); Tsukasa Doi, Tokyo (JP); Satoshi Seki, Kawasaki (JP); Mayuko Yamagata, Inagi (JP); Kiichiro Takahashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/226,678

(22) Filed: Aug. 2, 2016

(65) Prior Publication Data

US 2017/0036465 A1 Feb. 9, 2017

(30) Foreign Application Priority Data

Aug. 7, 2015 (JP) ..... 2015-157606
Sep. 10, 2015 (JP) ..... 2015-178700
Sep. 10, 2015 (JP) ..... 2015-178701

(51) Int. Cl.

*B41J 25/00* (2006.01)
*B41J 2/045* (2006.01)
*B41J 19/14* (2006.01)
*B41J 2/21* (2006.01)

(52) U.S. Cl.

CPC ..... *B41J 25/001* (2013.01); *B41J 2/04543* (2013.01); *B41J 2/2132* (2013.01); *B41J 19/142* (2013.01)

(58) Field of Classification Search

CPC ..... B41J 25/001; B41J 19/142; B41J 2/2132; B41J 2/04543

See application file for complete search history.

(56) References Cited

U.S. PATENT DOCUMENTS 5,633,663 A 5/1997 Matsubara
5,914,731 A * 6/1999 Yano ..... H04N 1/4057 347/15
2006/0221105 A1 10/2006 Imanaka et al.
2009/0002417 A1* 1/2009 Uji ..... B41J 2/2132 347/12
2009/0015612 A1* 1/2009 Teshigawara ..... G03G 15/104 347/12
2010/0060683 A1* 3/2010 Edamura ..... B41J 2/04541 347/9
2013/0201238 A1* 8/2013 Tanaka ..... B41J 2/04573 347/14

FOREIGN PATENT DOCUMENTS

CN 1693085 A 11/2005
CN 101130299 A 2/2008
CN 101332701 A 12/2008
(Continued)

*Primary Examiner* — Bradley Thies
(74) *Attorney, Agent, or Firm* — Canon U.S.A., Inc. IP Division

(57) ABSTRACT

Recording is performs that suppresses ink discharge position deviation between scans while suppressing graininess in a case of using multiple types of ink.

15 Claims, 38 Drawing Sheets

(56) References Cited

FOREIGN PATENT DOCUMENTS

| | | | |
|---|---|---|---|
| CN | 104275935 | A | 1/2015 |
| EP | 0938976 | A1 | 9/1999 |
| JP | H09187969 | A | 7/1997 |
| JP | 2006159798 | A | 6/2006 |
| JP | 2013-159017 | A | 8/2013 |

* cited by examiner

FIG. 6A
| | | DISCHARGE ORIFICE ROW | | |
|---|---|---|---|---|
| | | 1 pl | 2 pl | 5 pl |
| DATA | 0 | 0 | × | × |
| | 1 | 1 | × | × |
| | 2 | 2 | × | × |
| | 3 | 3 | × | × |
| | 4 | 4 | × | × |
FIG. 6B
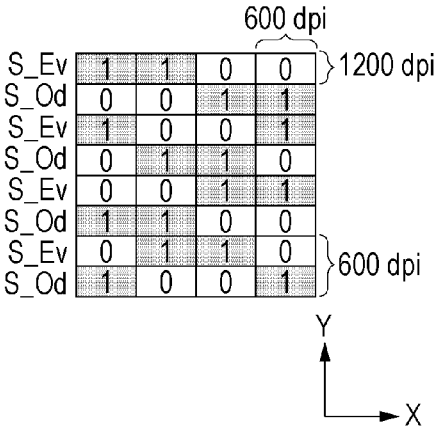
FIG. 6C
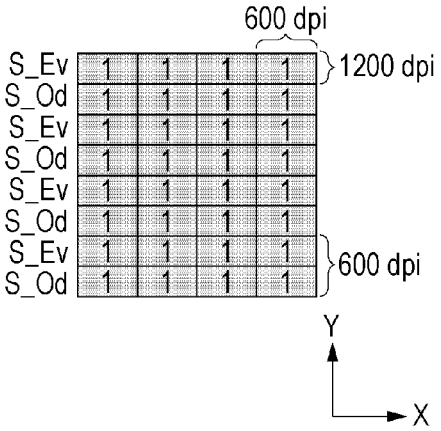
FIG. 6D
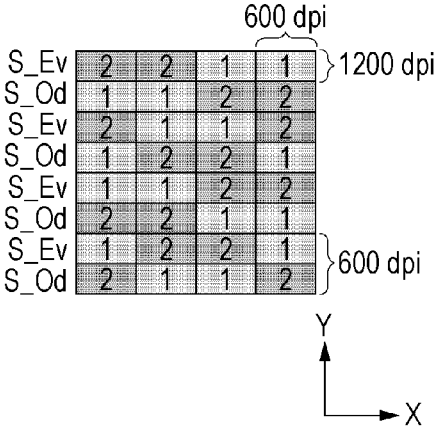
FIG. 6E
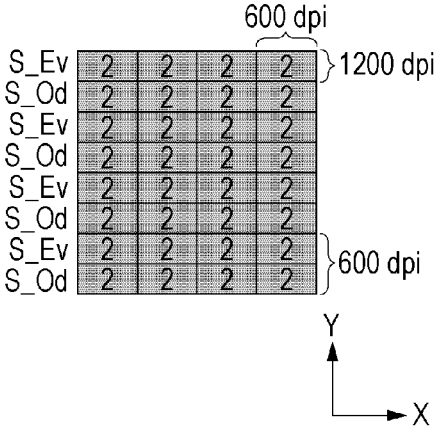

FIG. 9A

| | | | |
|---|---|---|---|
| 700 | 701 | 702 | 703 |
| 704 | 705 | 706 | 707 |
| 708 | 709 | 710 | 711 |
| 712 | 713 | 714 | 715 |

FIG. 9B

IMAGE DATA

| | | | |
|---|---|---|---|
| 2 | 1 | 0 | 0 |
| 2 | 1 | 0 | 0 |
| 2 | 1 | 0 | 0 |
| 2 | 1 | 0 | 0 |

FIG. 9C1

MASK PATTERN

| | | | | |
|---|---|---|---|---|
| 2 | 1 | 0 | 0 | MP1 |
| 0 | 2 | 1 | 0 | |
| 0 | 0 | 2 | 1 | |
| 1 | 0 | 0 | 2 | |

FIG. 9C2

| | | | | |
|---|---|---|---|---|
| 1 | 0 | 0 | 2 | MP2 |
| 2 | 1 | 0 | 0 | |
| 0 | 2 | 1 | 0 | |
| 0 | 0 | 2 | 1 | |

FIG. 9C3

| | | | | |
|---|---|---|---|---|
| 0 | 0 | 2 | 1 | MP3 |
| 1 | 0 | 0 | 2 | |
| 2 | 1 | 0 | 0 | |
| 0 | 2 | 1 | 0 | |

FIG. 9C4

| | | | | |
|---|---|---|---|---|
| 0 | 2 | 1 | 0 | MP4 |
| 0 | 0 | 2 | 1 | |
| 1 | 0 | 0 | 2 | |
| 2 | 1 | 0 | 0 | |

FIG. 9D1

RECORDING DATA

| | | | |
|---|---|---|---|
| 1 | 1 | 0 | 0 |
| 0 | 0 | 0 | 0 |
| 0 | 0 | 0 | 0 |
| 1 | 0 | 0 | 0 |

FIG. 9D2

| | | | |
|---|---|---|---|
| 1 | 0 | 0 | 0 |
| 1 | 1 | 0 | 0 |
| 0 | 0 | 0 | 0 |
| 0 | 0 | 0 | 0 |

FIG. 9D3

| | | | |
|---|---|---|---|
| 0 | 0 | 0 | 0 |
| 1 | 0 | 0 | 0 |
| 1 | 1 | 0 | 0 |
| 0 | 0 | 0 | 0 |

FIG. 9D4

| | | | |
|---|---|---|---|
| 0 | 0 | 0 | 0 |
| 0 | 0 | 0 | 0 |
| 1 | 0 | 0 | 0 |
| 1 | 1 | 0 | 0 |

FIG. 9E

LOGICAL SUM OF RECORDING DATA
(NUMBER OF TIMES OF INK DISCHARGE)

| | | | |
|---|---|---|---|
| 2 | 1 | 0 | 0 |
| 2 | 1 | 0 | 0 |
| 2 | 1 | 0 | 0 |
| 2 | 1 | 0 | 0 |

FIG. 10

| ○: RECORDED<br>×: NOT RECORDED | | CODE VALUE OF MASK PATTERN | | |
|---|---|---|---|---|
| | | 0 | 1 | 2 |
| PIXEL VALUE OF IMAGE DATA | 0 | × | × | × |
| | 1 | × | ○ | × |
| | 2 | × | ○ | ○ |

FIG. 11A
| | DRIVING ORDER | DRIVING BLOCK NO. |
|---|---|---|
| DRIVING ORDER | 1 | 1 |
| | 2 | 2 |
| | 3 | 3 |
| | 4 | 4 |
| | 5 | 5 |
| | 6 | 6 |
| | 7 | 7 |
| | 8 | 8 |
| | 9 | 9 |
| | 10 | 10 |
| | 11 | 11 |
| | 12 | 12 |
| | 13 | 13 |
| | 14 | 14 |
| | 15 | 15 |
| | 16 | 16 |
FIG. 11B
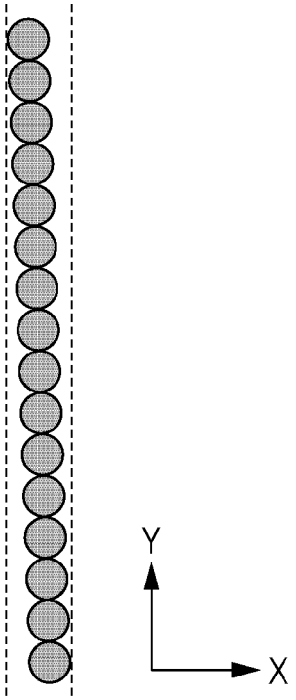
FIG. 11C
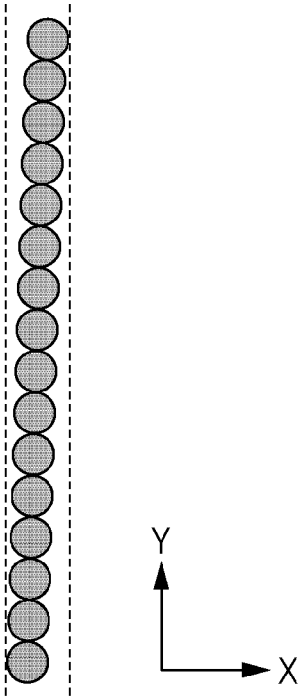

FIG. 12A1
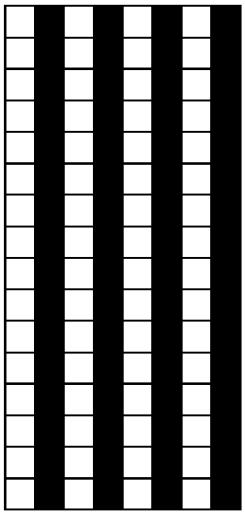
FIG. 12A2
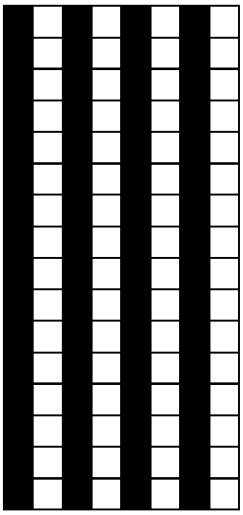
FIG. 12C
| | DRIVING ORDER | DRIVING BLOCK NO. |
|---|---|---|
| DRIVING ORDER A | 1 | 1 |
| | 2 | 2 |
| | 3 | 3 |
| | 4 | 4 |
| | 5 | 5 |
| | 6 | 6 |
| | 7 | 7 |
| | 8 | 8 |
| | 9 | 9 |
| | 10 | 10 |
| | 11 | 11 |
| | 12 | 12 |
| | 13 | 13 |
| | 14 | 14 |
| | 15 | 15 |
| | 16 | 16 |
FIG. 12B1
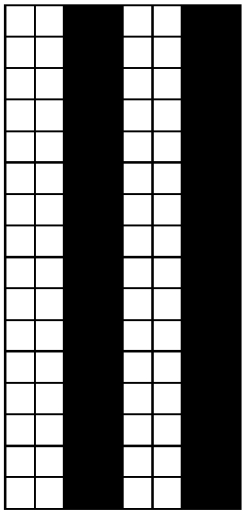
FIG. 12B2
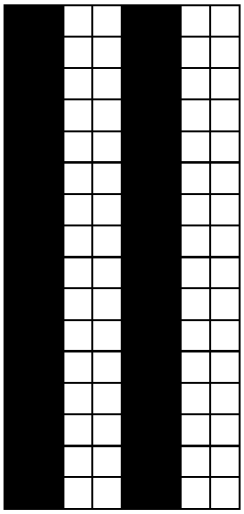
FIG. 12D
| | DRIVING ORDER | DRIVING BLOCK NO. |
|---|---|---|
| DRIVING ORDER B | 1 | 16 |
| | 2 | 15 |
| | 3 | 14 |
| | 4 | 13 |
| | 5 | 12 |
| | 6 | 11 |
| | 7 | 10 |
| | 8 | 9 |
| | 9 | 8 |
| | 10 | 7 |
| | 11 | 6 |
| | 12 | 5 |
| | 13 | 4 |
| | 14 | 3 |
| | 15 | 2 |
| | 16 | 1 |
FIG. 12E
| | RECORDING DATA | | DRIVING ORDER | |
|---|---|---|---|---|
| | FORWARD SCAN | BACKWARD SCAN | FORWARD SCAN | BACKWARD SCAN |
| FIRST SET | (b1) | (b2) | (c) | (d) |
| SECOND SET | (a1) | (a2) | (c) | (d) |
| THIRD SET | (b1) | (b2) | (c) | (c) |
| FOURTH SET | (a1) | (a2) | (c) | (c) |

FIG. 18A
| | DRIVING ORDER | DRIVING BLOCK NO. |
|---|---|---|
| DRIVING ORDER | 1 | 1 |
| | 2 | 9 |
| | 3 | 6 |
| | 4 | 14 |
| | 5 | 3 |
| | 6 | 11 |
| | 7 | 8 |
| | 8 | 16 |
| | 9 | 5 |
| | 10 | 13 |
| | 11 | 2 |
| | 12 | 10 |
| | 13 | 7 |
| | 14 | 15 |
| | 15 | 4 |
| | 16 | 12 |
FIG. 18B
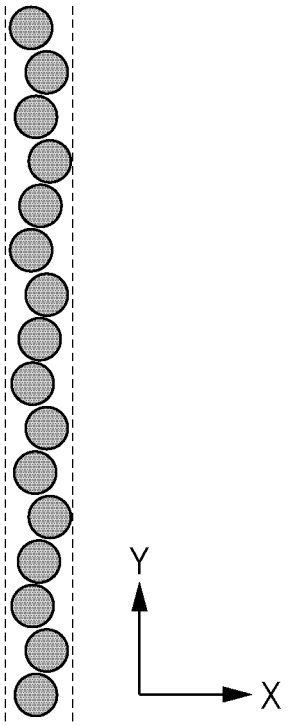
FIG. 18C
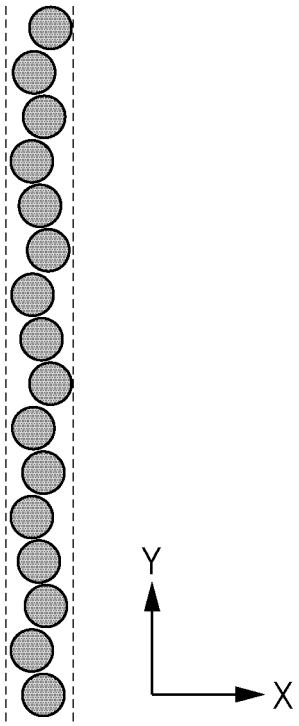

FIG. 19A
| | DRIVING ORDER | DRIVING BLOCK NO. |
|---|---|---|
| DRIVING ORDER | 1 | 5 |
| | 2 | 13 |
| | 3 | 2 |
| | 4 | 10 |
| | 5 | 7 |
| | 6 | 15 |
| | 7 | 4 |
| | 8 | 12 |
| | 9 | 1 |
| | 10 | 9 |
| | 11 | 6 |
| | 12 | 14 |
| | 13 | 3 |
| | 14 | 11 |
| | 15 | 8 |
| | 16 | 16 |
FIG. 19B
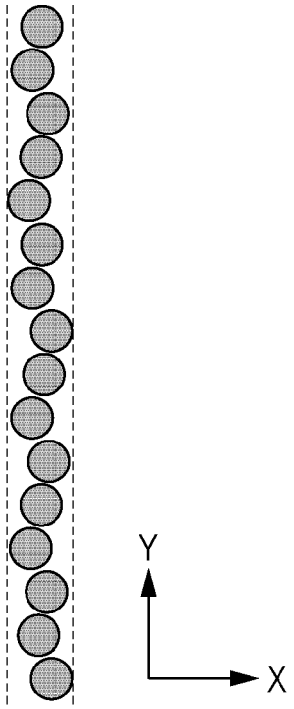
FIG. 19C
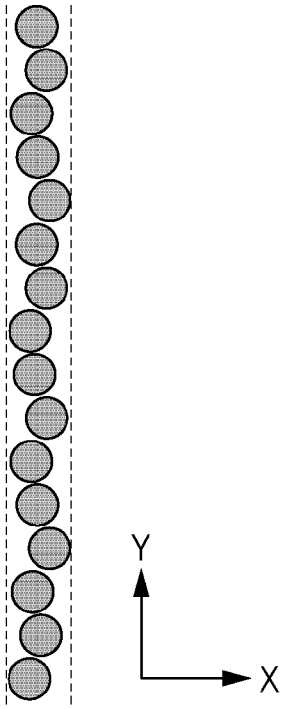

FIG. 24A
| | DRIVING ORDER | DRIVING BLOCK NO. |
|---|---|---|
| DRIVING ORDER | 1 | 1 |
| | 2 | 2 |
| | 3 | 3 |
| | 4 | 4 |
| | 5 | 5 |
| | 6 | 6 |
| | 7 | 7 |
| | 8 | 8 |
| | 9 | 9 |
| | 10 | 10 |
| | 11 | 11 |
| | 12 | 12 |
| | 13 | 13 |
| | 14 | 14 |
| | 15 | 15 |
| | 16 | 16 |
FIG. 24B
| | DRIVING ORDER | DRIVING BLOCK NO. |
|---|---|---|
| DRIVING ORDER | 1 | 8 |
| | 2 | 7 |
| | 3 | 6 |
| | 4 | 5 |
| | 5 | 4 |
| | 6 | 3 |
| | 7 | 2 |
| | 8 | 1 |
| | 9 | 16 |
| | 10 | 15 |
| | 11 | 14 |
| | 12 | 13 |
| | 13 | 12 |
| | 14 | 11 |
| | 15 | 10 |
| | 16 | 9 |
FIG. 24C
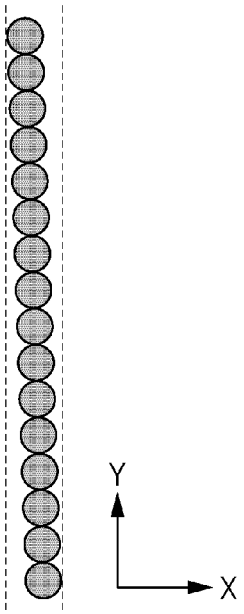
FIG. 24D
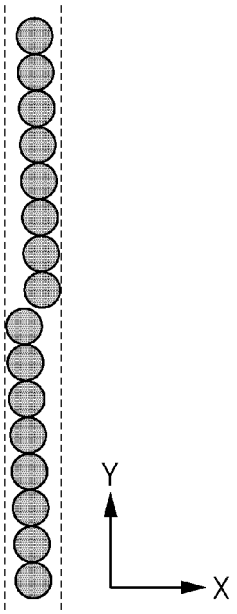

FIG. 26A
| | DRIVING ORDER | DRIVING BLOCK NO. |
|---|---|---|
| DRIVING ORDER | 1 | 9 |
| | 2 | 4 |
| | 3 | 15 |
| | 4 | 10 |
| | 5 | 5 |
| | 6 | 16 |
| | 7 | 11 |
| | 8 | 6 |
| | 9 | 1 |
| | 10 | 12 |
| | 11 | 7 |
| | 12 | 2 |
| | 13 | 13 |
| | 14 | 8 |
| | 15 | 3 |
| | 16 | 14 |
FIG. 26B
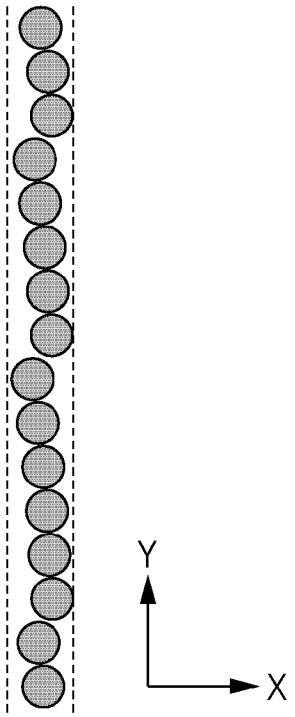
FIG. 26C
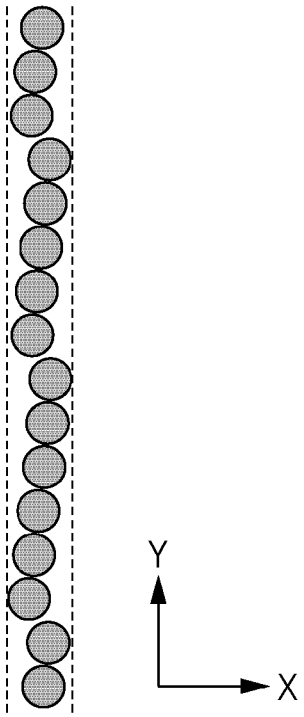

FIG. 36A
| | DRIVING ORDER | DRIVING BLOCK NO. |
|---|---|---|
| DRIVING ORDER | 1 | 3 |
| | 2 | 11 |
| | 3 | 8 |
| | 4 | 16 |
| | 5 | 5 |
| | 6 | 13 |
| | 7 | 2 |
| | 8 | 10 |
| | 9 | 7 |
| | 10 | 15 |
| | 11 | 4 |
| | 12 | 12 |
| | 13 | 1 |
| | 14 | 9 |
| | 15 | 6 |
| | 16 | 14 |
FIG. 36B
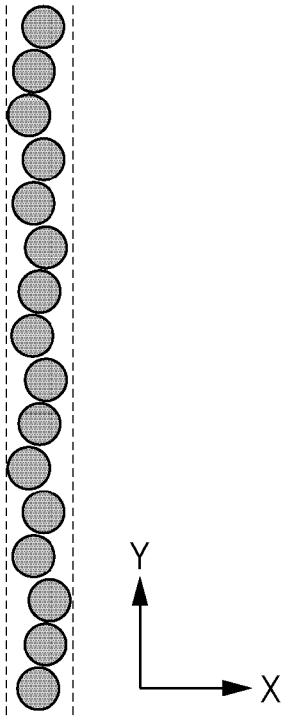
FIG. 36C
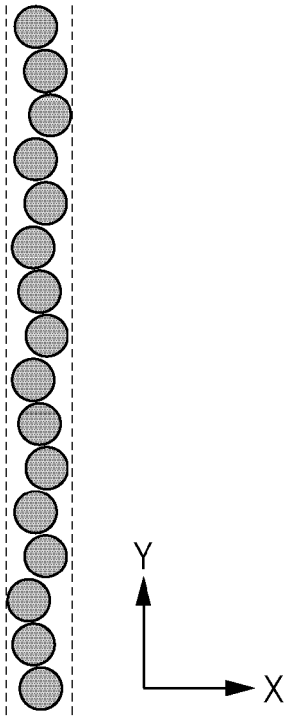

RECORDING APPARATUS FOR REDUCING DISCHARGE POSITION DEVIATION OF DISCHARGED INK, AND RECORDING METHOD FOR THE SAME

BACKGROUND OF THE INVENTION

Field of the Invention

The present invention relates to a recording apparatus and a recording method.

Description of the Related Art

There is conventionally known a recording apparatus that records images by discharging ink onto a recording medium by driving recording elements, using a recording head having a recording element row where multiple recording elements that generate energy for discharging ink are arrayed. There also is known so-called multi-pass recording in such recording apparatuses, where multiple recording scans are performed as to a unit region to form images.

On the other hand, there is commonly known the so-called time-division driving method for a driving methods of multiple recording elements within a recording element row, where the multiple recording elements are divided into multiple driving blocks, and the recording elements belonging to different driving blocks are driven at different timings from each other. This time-division driving method enables the number of recording elements being driven at the same time to be reduced, thereby enabling a recording apparatus to be provided with the size of the driving power source suppressed.

In a case of recording using the above multi-pass recording, there are cases where discharging position deviation of ink occurs among one type of scan and another type of scan in the multiple scans over a unit region, due to various factors. For example, in a case where floating (cockling) of the recording medium occurs in an arrangement where the recording head is reciprocally scanned in the forward direction and backward direction, the ink discharge direction slightly shifts between the forward direction and backward direction, so there is ink discharge position deviation between a region where recording has been performed by a forward direction scan and a region where recording has been performed by a backward direction scan.

In comparison with this, Japanese Patent Laid-Open No. 2013-159017 describes an arrangement to suppress ink discharge position deviation among two types of scans such as forward scan and backward scan described above. In this arrangement recording data is generated where ink is discharged in the same pixel region by these two types of scans, and further the above-described time-division driving is performed so that the landing positions of dots formed by each of the driving blocks in each of the two types of scans differ from each other. Now, in order for the landing positions of dots formed by each of the driving blocks to differ in a case of the recording head being reciprocally scanned in the forward direction and backward direction, the driving order of multiple driving blocks when scanning in the backward direction is described as being different from the reverse order of the driving order of multiple driving blocks when scanning in the forward direction. Also, in order for the landing positions of dots formed by each of the driving blocks to differ in a case of the recording head being scanned only in one direction, the driving order of multiple driving blocks in a certain type of scan is described as being different from the driving order of multiple driving blocks in another certain type of scan. According to Japanese Patent Laid-Open No. 2013-159017, recording can be realized where ink discharge position deviation between two types of scans is suppressed when performing recording using multi-pass recording and time-division driving.

However, Japanese Patent Laid-Open No. 2013-159017 only describes controlling the driving order of the driving blocks of the recording element row to discharge one certain type of ink. In other words, Japanese Patent Laid-Open No. 2013-159017 makes no mention of how to set the driving order of driving blocks among recording element rows that each discharge ink, in a case of discharging multiple types of ink. Accordingly, while Japanese Patent Laid-Open No. 2013-159017 can suppress ink discharge position deviation among two types of scans when discharging one type of ink, image defects may occur in a case of discharging multiple types of ink.

More specifically, Japanese Patent Laid-Open No. 2013-159017 does not describe the relationship between the driving order of a recording element row discharging cyan ink and the driving order of a recording element row discharging magenta ink, so discharge position deviation between cyan ink and magenta ink may not be suppressed. Further, Japanese Patent Laid-Open No. 2013-159017 does not describe the relationship between the driving order of a recording element row discharging ink with a large dot size and the driving order of the recording element row discharging ink with a small dot size, so discharge position deviation between ink with a large dot size and ink with a small dot size may not be suppressed.

SUMMARY OF THE INVENTION

It has been found desirable to provide recording with suppressed ink discharge position deviation among two types of scans without image defects, even in a case of discharging ink of multiple types, such as ink of multiple types of color or multiple dot sizes.

In view of the above, according to an aspect of the present invention, there is provided a recording apparatus including a recording head, a scanning unit, a generating unit, drive unit, and a control unit. The recording head includes a first recording element row where a plurality of recording elements configured to generate energy to discharge ink of a first type are arrayed in a predetermined direction, and a second recording element row where a plurality of recording elements configured to generate energy to discharge ink of a second type, that is different from the first type, are arrayed in the predetermined direction. The scanning unit is configured to execute a first scan of the recording head over a unit region on a recording medium, K ($K \geq 1$) times in a first direction following an intersecting direction intersecting the predetermined direction, and a second scan of the recording head over the unit region, L ($L \geq 1$) times in a second direction opposite to the first direction. The generating unit is configured to generate a plurality of sets of first recording data stipulating discharge or non-discharge of the ink of the first type, as to each of a plurality of pixel regions within the unit region, in each of the K+L scans by the scanning unit, based on first image data that corresponds to an image to be recorded in the unit region by discharging ink of the first type, and generate a plurality of sets of second recording data stipulating discharge or non-discharge of the ink of the second type, as to each of the plurality of pixel regions within the unit region, in each of the K+L scans by the scanning unit, based on second image data that corresponds to an image to be recorded in the unit region by discharging ink of the second type. The drive unit is configured to, with regard to a plurality of first recording elements corresponding to the unit region in the K'th first scan of the plurality of recording elements arrayed in the first recording element row, that have been divided into a plurality of first driving blocks, perform driving of the plurality of first recording elements where the first recording elements belonging to different first driving blocks are driven at different timings from each other, and with regard to a plurality of second recording elements corresponding to the unit region in the K'th first scan of the plurality of recording elements arrayed in the second recording element row, that have been divided into a plurality of second driving blocks, perform driving of the plurality of second recording elements where the second recording elements belonging to different second driving blocks are driven at different timings from each other. The control unit is configured to, in the K'th first scan and the L'th second scan by the scanning unit, discharge ink of the first type and ink of the second type to the unit region by driving the plurality of recording elements in the first recording element row and the second recording element row by the driving unit, based on the first recording data and the second recording data generated by the generating unit, wherein the driving order of the plurality of second driving blocks is different from the driving order of the plurality of first driving blocks.

Further features of the present invention will become apparent from the following description of exemplary embodiments with reference to the attached drawings.

BRIEF DESCRIPTION OF THE DRAWINGS

FIGS. 6A through 6E are diagrams illustrating a rasterization table in an embodiment.

FIGS. 9A through 9E are diagrams for describing recording data generating steps in a multi-pass recording method.

FIG. 10 is a diagram illustrating a decoding table.

FIGS. 11A through 11C are diagrams for describing correlation between driving order and ink landing position.

FIGS. 12A1 through 12E are diagrams for describing correlation of recording data, driving order, and ink discharge position.

FIGS. 18A through 18C are diagrams for describing driving order in an embodiment.

FIGS. 19A through 19C are diagrams for describing driving order in an embodiment.

FIGS. 24A through 24D are diagrams for describing driving order in an embodiment.

FIGS. 26A through 26C are diagrams for describing driving order in an embodiment.

FIGS. 36A through 36C are diagrams for describing driving order in an embodiment.

DESCRIPTION OF THE EMBODIMENTS

First Embodiment

Figure 1:
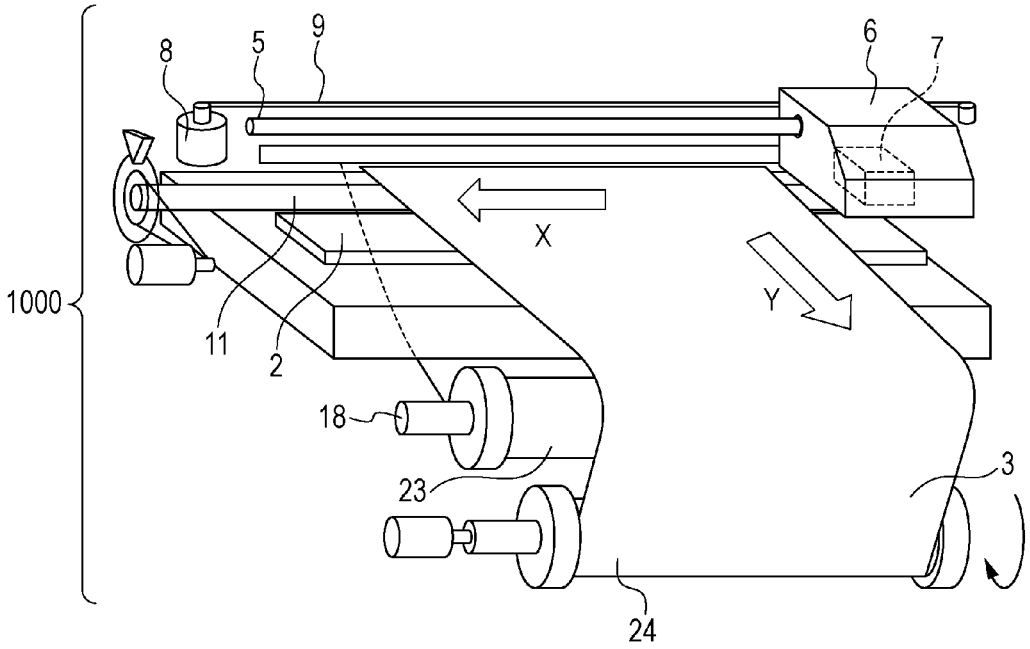
FIG. 1 is a perspective view of a recording apparatus according to an embodiment.
Figure 2:
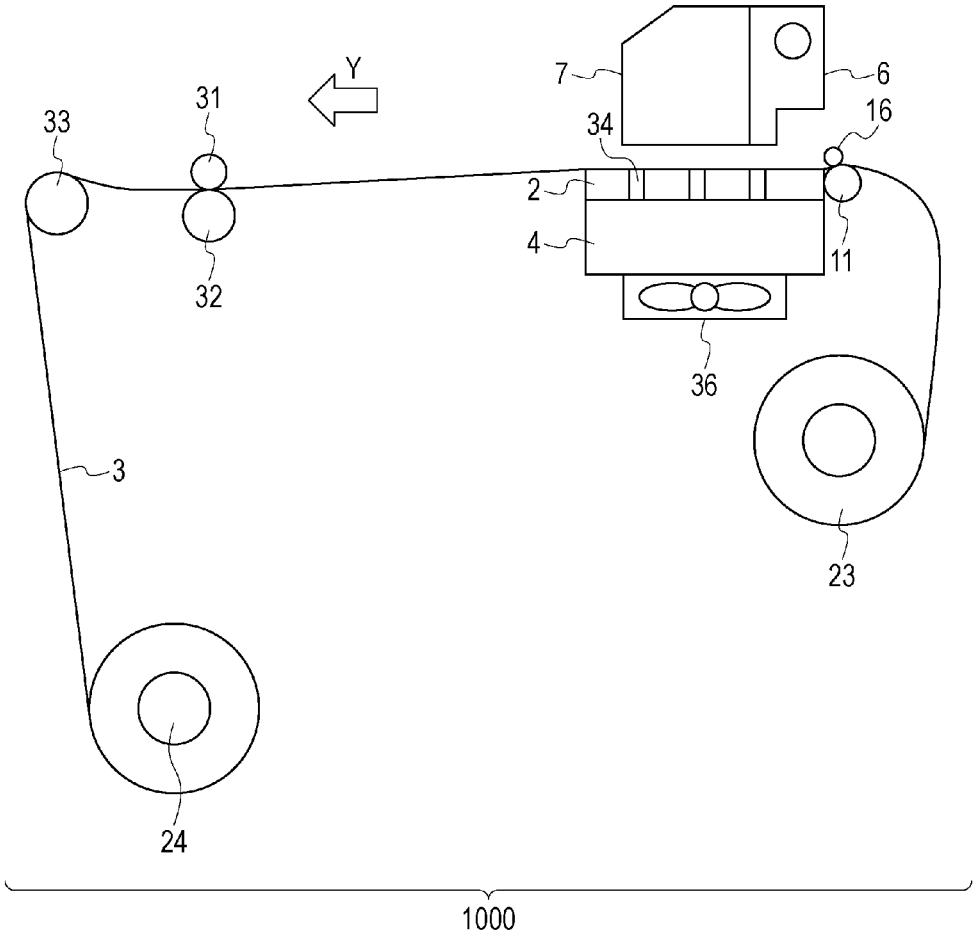
FIG. 2 is a schematic diagram illustrating the internal configuration of the recording apparatus according to an embodiment.

A first embodiment of the present invention will be described in detail below with reference to the drawings. FIG. 1 is a perspective view partially illustrating the internal structure of a recording apparatus 1000 according to the first embodiment of the present invention. FIG. 2 is a cross-sectional diagram partially illustrating the internal configuration of the recording apparatus 1000 according to the first embodiment of the present invention.

A platen 2 is disposed within a recording apparatus 1000. A great number of suction holes 34 are formed in the platen 2 so that a recording medium 3 can be suctioned and thus prevented from floating up. The suction holes 34 are connected to a duct, below which a suction fan 36 is disposed. The recording medium 3 is suctioned to the platen 2 by this suction fan 36 operating.

A carriage 6 is supported by a main rail 5 disposed extending in the width direction of sheets, and is configured so as to be capable of reciprocal scanning (reciprocal movement) in the forward direction and backward direction along an X direction (intersecting direction). Mounted on the carriage 6 is an ink jet recording head 7 which will be described later. Various recording methods can be used in the recording head 7, including the thermal jet method using heating elements, the piezoelectric method using piezoelectric elements, and so forth. A carriage motor 8 is a drive source for moving the carriage 6 in the X direction. The rotational driving force thereof is transmitted to the carriage 6 by a belt 9.

The recording medium 3 is supplied by being unwound off of a rolled medium 23. The recording medium 3 is conveyed in a Y direction (conveyance direction) intersecting the X direction on the platen 2. The recording medium 3 is nipped by a pinch roller 16 and conveyance roller 11, and is conveyed by the conveyance roller 11 being driven. Downstream in the Y direction from the platen 2, the recording medium 3 is nipped by a roller 31 and discharge roller 32, and further is wound onto a take-up roller 24 by way of a turn roller 33.

Figure 3A:
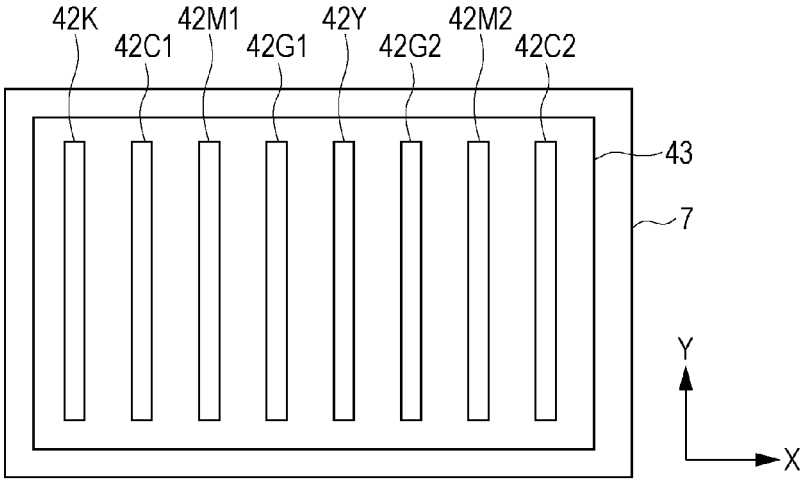
FIGS. 3A through 3C are schematic diagrams of a recording head according to an embodiment.
Figure 3B:
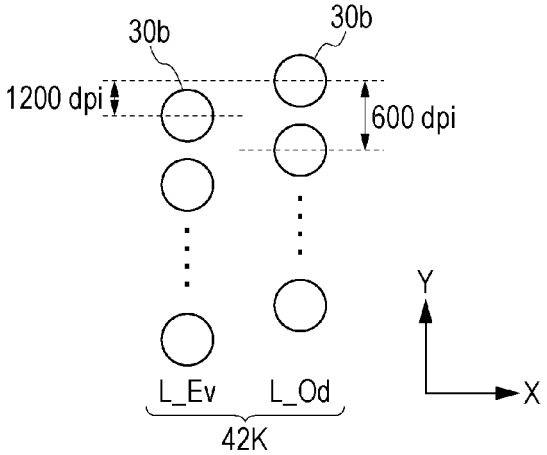
Figure 3C:
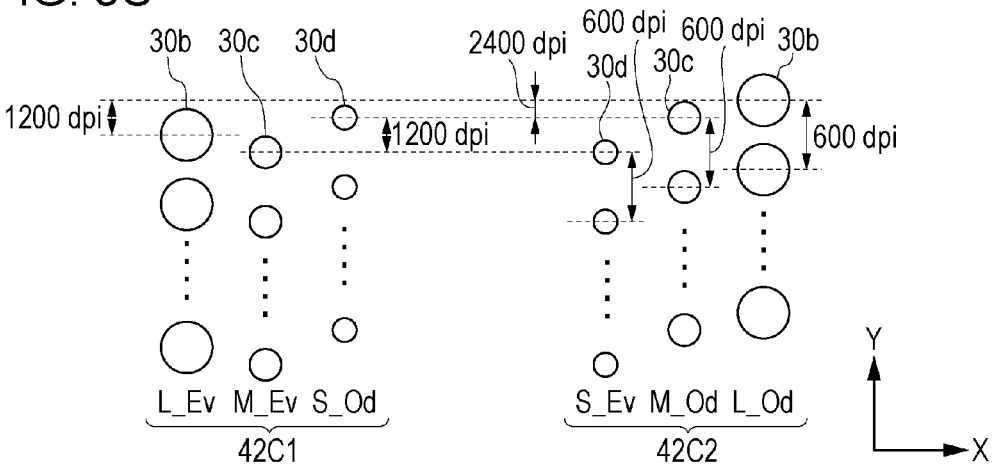

FIG. 3A is a perspective view illustrating the recording head 7 according to the present embodiment. FIG. 3B is an enlarged view of discharge orifice row 42K for black ink inside the recording head 7. FIG. 3C is an enlarged view of discharge orifice rows 42C1 and 42C2 for cyan ink inside the recording head 7.

It can be seen from FIG. 3A that one recording chip 43 is provided within the recording head 7 in the present embodiment. The recording chip 43 has formed thereupon a total of eight discharge orifice rows 42, which are the discharge orifice row 42K for discharging black ink, the discharge orifice rows 42C1 and 42C2 for discharging cyan ink, discharge orifice rows 42M1 and 42M2 for discharging magenta ink, a discharge orifice row 42Y for discharging yellow ink, and discharge orifice rows 42G1 and 42G2 for discharging gray ink.

The discharge orifice row 42K for black ink is formed with rows where discharge orifices 30*b* arrayed in the Y direction at a recording resolution of 600 per inch (600 dpi), are arrayed shifted in the Y direction by a recording resolution of 1200 per inch (1200 dpi), which is illustrated in FIG. 3B. The discharge orifices 30*b* are capable of discharging approximately 5 picoliters (hereinafter "pl") of ink. The diameter of a dot formed by a discharge orifice 30*b* discharging ink onto the recording medium is approximately 50 μm. Although only six discharge orifices 30*b* are illustrated in FIG. 3B for the same of brevity, in reality 256 discharge orifices 30*b* are arrayed to make up the discharge orifice row 42K. The discharge orifice row 42Y for yellow ink is also in a configuration such as illustrated in FIG. 3B.

As illustrated in FIG. 3C, the discharge orifice row 42C1 for cyan ink is formed having three rows, which are a row L_Ev where discharge orifices 30*b* are arrayed at a recording resolution of 600 dpi, a row M_Ev where discharge orifices 30*c* are arrayed at a recording resolution of 600 dpi, and a row S_Od where discharge orifices 30*d* are arrayed at a recording resolution of 600 dpi. The discharge orifices 30*c* are capable of discharging approximately 2 pl of ink. The diameter of a dot formed by a discharge orifice 30*c* discharging ink onto the recording medium is approximately 35 μm. Further, the discharge orifices 30*d* are capable of discharging approximately 1 pl of ink. The diameter of a dot formed by a discharge orifice 30*d* discharging ink onto the recording medium is approximately 28 μm.

The discharge orifice row 42C2 for cyan ink is formed having three rows, which are a row L_Od where discharge orifices 30*b* are arrayed at a recording resolution of 600 dpi, a row M_Od where discharge orifices 30*c* are arrayed at a recording resolution of 600 dpi, and a row S_Ev where discharge orifices 30*d* are arrayed at a recording resolution of 600 dpi.

Now, the rows L_Ev, L_Od, M_Ev, M_Od, S_Ev, and S_Od, within the discharge orifice rows 42C1 and 42C2 are arranged based on the following arrangement conditions. The row L_Od within the discharge orifice row 42C2 is disposed shifted toward the downstream side in the Y direction (upwards in FIG. 3C) from the row L_Ev within the discharge orifice row 42C1 by 1200 dpi. The row M_Od within the discharge orifice row 42C2 is disposed shifted toward the downstream side in the Y direction (upwards in FIG. 3C) from the row M_Ev within the discharge orifice row 42C1 by 1200 dpi. Note that the row M_Od within the discharge orifice row 42C2 is disposed shifted toward the upstream side in the Y direction (downwards in FIG. 3C) from the row L_Od within the discharge orifice row 42C2 by 2400 dpi.

Also, the row S_Od within the discharge orifice row 42C1 and the row M_Od within the discharge orifice row 42C2, and the row S_Ev within the discharge orifice row 42C2 and the row M_Ev within the discharge orifice row 42C1, are arranged so that the middle positions of each in the Y direction are at approximately the same position. Accordingly, the row S_Od within the discharge orifice row 42C1 is disposed shifted toward the downstream side in the Y direction (upwards in FIG. 3C) from the row S_Ev within the discharge orifice row 42C2 by 1200 dpi.

Although only three discharge orifices are illustrated in FIG. 3C as discharge orifices making up the rows L_Ev, L_Od, M_Ev, M_Od, S_Ev, and S_Od, for the sake of brevity, in reality each row is formed having 128 discharge orifices. Accordingly, with two rows that discharge the same amount of ink (e.g., S_Od and S_Ev) as one row, this row is formed including 256 discharge orifices.

Also note that discharge orifice rows 42M1 and 42M2 for magenta ink have the same configuration as illustrated in FIG. 3C. Further, the discharge orifice rows 42G1 and 42G2 for gray ink have the same configuration as illustrated in FIG. 3C.

Now, recording elements are disposed directly below the discharge orifices 30*b*, 30*c*, and 30*d* (although omitted from illustration). Thermal energy generated by the recording elements being driven causes the ink immediately above to bubble, which discharges ink from the discharge orifices. In order to simplify description hereinafter, a row of multiple recording elements formed directly below multiple discharge orifices making up a row that discharges ink of the same color and same amount will be referred to as "recording element row".

Figure 4:
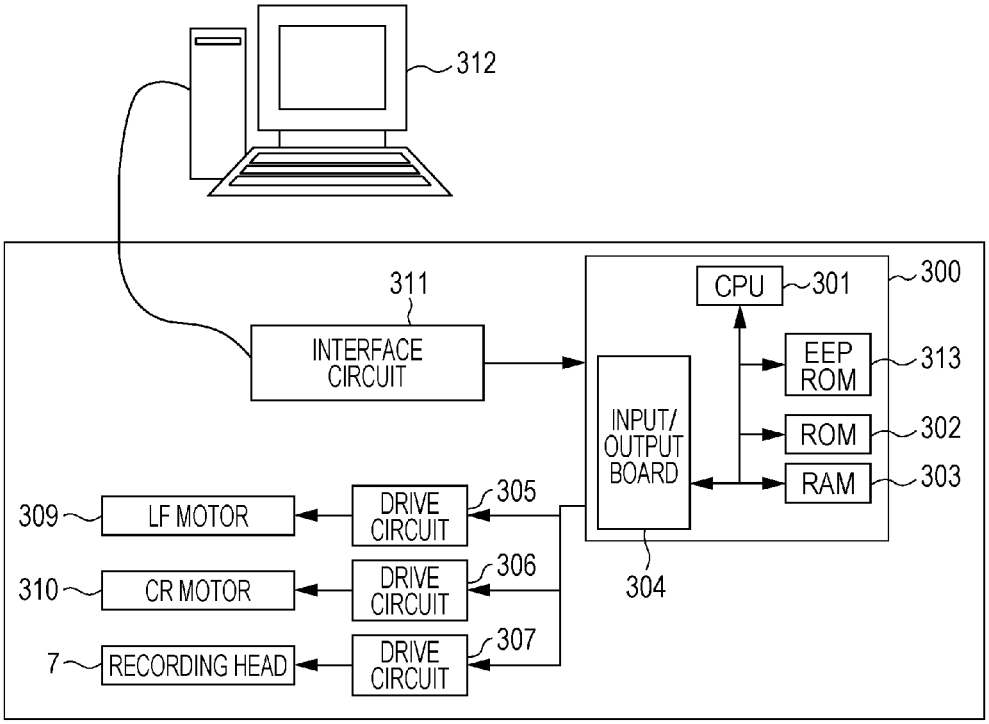
FIG. 4 is a diagram illustrating a recording control system in an embodiment.

FIG. 4 is a block diagram illustrating a schematic configuration of a control system in the present embodiment. A main control unit 300 includes a central processing unit (CPU) 301 that executes processing operations such as computation, selection, determination, control, and so forth, read-only memory (ROM) 302 that stores control programs and the like to be executed by the CPU 301, random access memory (RAM) 303 used to buffer recording data and so forth, an input/output port 304, and so forth. Electrically Erasable Programmable ROM (EEPROM) 313 stores image data, mask patterns, faulty nozzle data, and so forth, which will be described later. Drive circuits 305, 306, 307 corresponding to a conveyance motor (LF motor) 309, a carriage motor (CR motor) 310, and the recording head 7, are connected to the input/output port 304. The main control unit 300 is further connected to a personal computer (PC) 312 that is a host computer, via an interface circuit 311.

Figure 5:
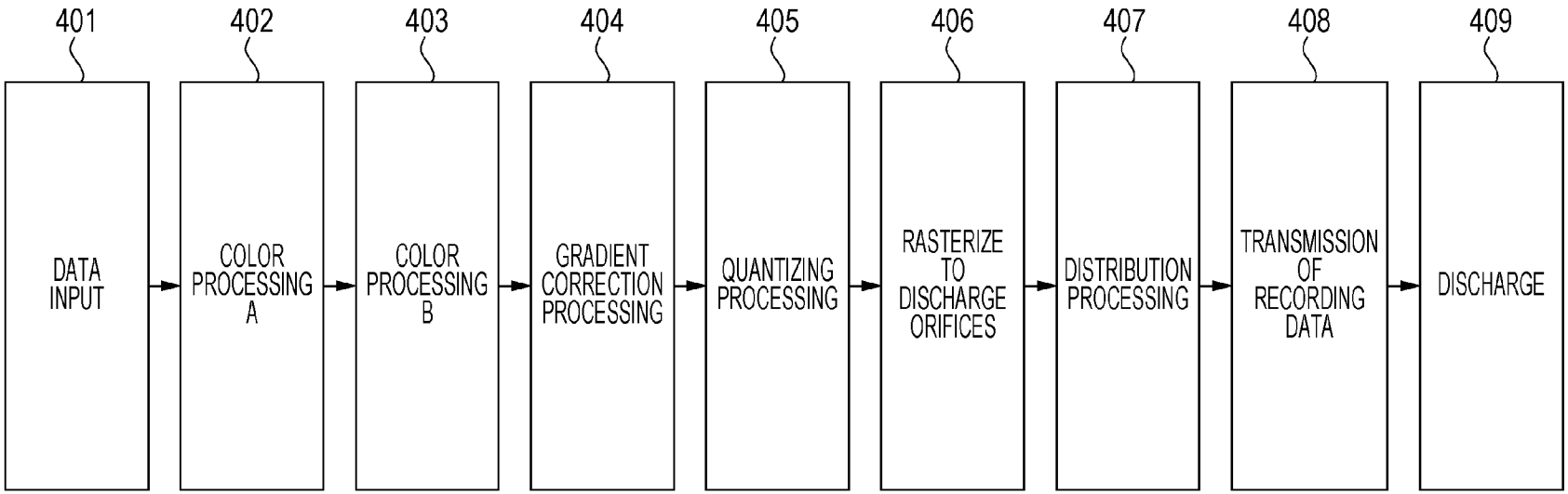
FIG. 5 is a diagram illustrating data processing steps in an embodiment.

FIG. 5 is a flowchart illustrating data processing steps that the CPU 301 executes in the present embodiment.

In step 401, original image signals that have 256 gradation levels (0 through 255) for each of red, green, and blue (RGB) acquired from an image input device such as a digital camera or scanner or the like, or by computer processing or the like, are input at resolution of 600 dpi.

In step 402, the RGB original image signals input in step 401 are converted to R'G'B' signals by color conversion processing A.

In color conversion processing B in the following step 403, the R'G'B' signals are converted into signal values corresponding to the respective color inks. Five colors are used in the present embodiment, which are cyan (C), magenta (M), yellow (Y), black (K), and gray (G). Accordingly, the signals after conversion are data C1, M1, Y1, K1, and G1, corresponding to the cyan, magenta, yellow, black, and gray ink colors. Each of C1, M1, Y1, K1, and G1 have 256 gradation levels (0 through 255) and resolution of 600 dpi. Specific color processing B involves using a three-dimensional look-up table (omitted from illustration) showing the relationship between the input values of R, G, and B, and the output values of C, M, Y. The output values for input values not within grid points of the table are calculated by interpolation from the output values of surrounding table grid points. Description will be made with data C1 representing the data C1, M1, Y1, K1, and G1.

In step 404, gradation correction using a gradation correction table is performed on the data C1, thereby obtaining post-gradation-correction data C2.

In step 405, the data C2 obtained in step 404 is subjected to quantization processing by error diffusion to obtain data C3 having five gradations (gradation levels 0, 1, 2, 3, 4) and resolution of 600 dpi×600 dpi. The data C3 will also be referred to as gradation data in the present embodiment. Although error diffusion has been described as being used here, dithering may be used instead.

In step 406, the gradation data C3 is converted into data C4 for the discharge orifice rows in accordance with the discharge orifice row rasterization table illustrated in FIG. 6A. In the present embodiment, image data for 5 pl discharge orifice rows and image data for 2 pl discharge orifice rows is not generated, and image data 1 pl discharge orifice rows is rasterized in the five gradations of "0", "1", "2", "3", and "4", based on the dot arrangement pattern where the numbers and positions of dot arrangements are determined. Specifically, the image data C4 is made up of three types of 2-bit information "00", "01", and "10", at resolution of 600 dpi×1200 dpi. The data C4 is also referred to as "image data" in the present embodiment.

Now, in a case where the 2-bit information making up the image data C4 is "00" at a certain pixel, the value which that information indicates (hereinafter also referred to as "pixel value") is "0". Also, in a case where the 2-bit information making up the image data is "01" at a certain pixel, the value which that information indicates (pixel value) is "1". In a case where the 2-bit information making up the image data C4 is "10" at a certain pixel, the value which that information indicates (pixel value) is "2". These pixel values "0", "1", and "2" indicate the number of discharge of ink as to a pixel region.

As described above, the resolution of data C3 is 600 dpi×600 dpi, so the resolution of the image data C4 is higher than the resolution of the gradation data C3. More specifically, the gradation data C3 stipulates five values of gradation levels for a pixel group made up of 1 pixel×2 pixels, which is to say that the total number of times of discharging ink to a pixel group region corresponding to the pixel group is stipulated. On the other hand, the image data C4 stipulates three pixel values for each of two pixels making up one pixel group, which is to say that the number of times of discharging ink to each pixel region corresponding to the two pixels is stipulated.

FIG. 6B is a diagram illustrating a dot arrangement pattern used in a case where the gradation level (gradation value) of the data C3 is level 1. FIG. 6C is a diagram illustrating a dot arrangement pattern used in a case where the gradation level (gradation value) of the data C3 is level 2. FIG. 6D is a diagram illustrating a dot arrangement pattern used in a case where the gradation level (gradation value) of the data C3 is level 3. FIG. 6E is a diagram illustrating a dot arrangement pattern used in a case where the gradation level (gradation value) of the data C3 is level 4. Note that the "0", "1", and "2" described in the pixels in FIGS. 6B through 6E represent the pixel value of that pixel.

In the present embodiment, the dot arrangement is stipulated as follows in a dot arrangement pattern where the gradation level is level 1 as illustrated in FIG. 6B, which is used in a case where the concentration of image data is low. Of the pixels for dot arrangement in the X direction, the number of pixels to which a pixel for placement of another dot is adjacent in the X direction is greater than the number of pixels to which no pixel for placement of another dot is adjacent in the X direction.

For example, placement of a dot is stipulated at the pixel at the far upper left in the dot arrangement pattern illustrated in FIG. 6B, and further, placement of a dot is stipulated at the pixel adjacent thereto, which is at the uppermost end and is the second pixel from the left. According to this arrangement, multiple dots can be situated at adjacent positions even if the image data has low concentration, so discharge position deviation among scans can be suitably suppressed.

The dot arrangement is stipulated in the same way in dot arrangement patterns where the gradation level is level 2, level 3, and level 4, as illustrated in each of FIGS. 6C through 6E, where, of the pixels for dot arrangement in the X direction, the number of pixels to which a pixel for placement of another dot is adjacent in the X direction is greater than the number of pixels to which no pixel for placement of another dot is adjacent in the X direction. Thus, in a case where the data C3 is other than the smallest gradation value (other than level 0) out of the reproducible gradation levels (levels 0 through 4) in the present embodiment, the data C4 can be generated so that the number of dots situated at adjacent positions is larger.

Note however, that the dot arrangement patterns applicable in the present embodiment are not restricted to those illustrated in FIGS. 6B through 6E. For example, a dot arrangement may be stipulated where, of the pixels for dot arrangement in the X direction, the number of pixels to which a pixel for placement of another dot is adjacent is smaller than the number of pixels to which no pixel for placement of another dot is adjacent in the X direction.

In step 407, later-described distribution processing is performed regarding the image data C4, and recording data C5 stipulating discharge or non-discharge of cyan ink for each pixel region in each scan is generated. Further, recording data M5 for magenta ink, recording data Y5 for yellow ink, recording data K5 for black ink, and recording data G5 for gray ink, are each generated in step 407 in the same way.

The recording data C5, M5, Y5, K5, and G5 are transmitted to the recording head in step 408, and in step 409 ink is discharged in accordance with the recording data.

The PC 312 may perform all of the processing of steps 401 through 407, or part of the processing of steps 401 through 407 may be performed by the PC 312 and the remainder by the recording apparatus 1000.

Note that in the following, description will be made regarding only the recording data C5 for cyan ink, recording data M5 for magenta ink, and recording data G5 for gray ink, for sake of brevity. Recording is performed using dime-division driving and multi-pass recording in the present embodiment. Control of each of these will be described in detail.

Time-Division Driving

In a case of using a recording head where a great number of recording elements are arranged as illustrated in FIGS. 3A through 3C, performing ink discharging by driving all of the recording elements at the same time and discharging ink at the same timing would require a large-capacity power source. As a way to reduce the size of the power source, it is commonly known to perform so-called time-division driving, where the recording elements are divided into multiple driving blocks, and the timing at which each driving block is driven to record is made to differ within the same row. This time-division driving method enables the number of recording elements being driven at the same time to be reduced, so the size of the power source necessary for the recording apparatus can be reduced.

Figure 7A:
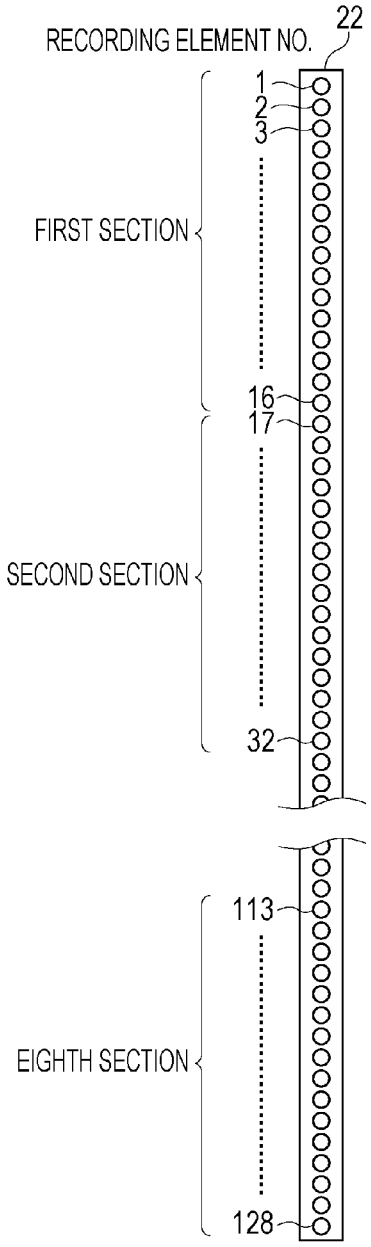
FIGS. 7A through 7C are diagrams for describing a common dime-division driving method.
Figure 7B:
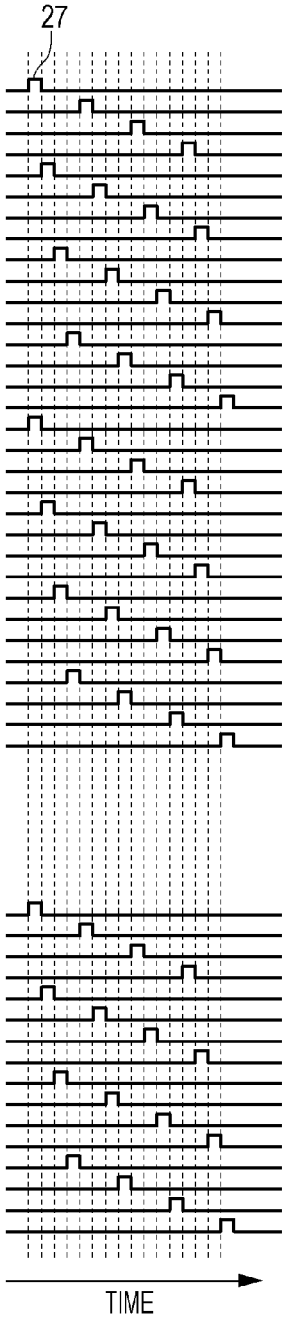
Figure 7C:
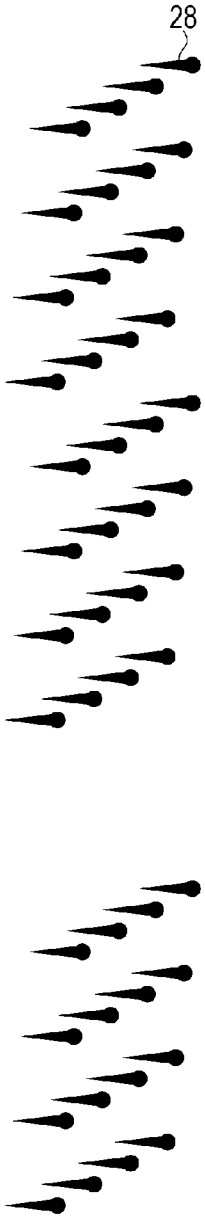

FIGS. 7A through 7C are diagrams for describing time-division driving according to the present embodiment. FIG. 7A is a diagram illustrating 128 recording elements making up a single recording element row 22, FIG. 7B is a diagram illustrating drive signals applied to the recording elements, and FIG. 7C is a diagram schematically illustrating actual ink droplets being discharged. Note that in the following description, the recording element farthest downstream in the Y direction of the 128 recording elements will be numbered recording element No. 1, with the numbers increasing toward the upstream in the Y direction in the manner of recording elements No. 2, No. 3, and so on, through No. 126, No. 127, and recording element No. 128 is the recording element farthest upstream in the Y direction, as illustrated in FIG. 7A.

In the present embodiment, the 128 recording elements are classified into eight sections from a first section through eighth section, each section being made up of 16 consecutive recording elements in the Y direction. Recording elements positioned at the same relative position in each of the eight sections form a driving block, and thus the 128 recording elements are divided into a total of 16 driving blocks, from driving block No. 1 through driving block No. 16.

In detail, the recording element farthest downstream in the Y direction of each of the eight selections from the first section through the eighth section are taken as recording elements belonging to driving block No. 1. As for a specific example, recording element No. 1, recording element No. 17, and so on through recording element No. 113, are recording elements belonging to driving block No. 1. In other words, recording elements satisfying recording element No. (16×a+1), where "a" is an integer of 0 through 7, are recording elements belonging to driving block No. 1.

Also, the recording element second farthest downstream in the Y direction of each of the eight selections from the first section through the eighth section are taken as recording elements belonging to driving block No. 2. That is to say, recording element No. 2, recording element No. 18, and so on through recording element No. 114, are recording elements belonging to driving block No. 2. In other words, recording elements satisfying recording element No. (16×a+2), where "a" is an integer of 0 through 7, are recording elements belonging to driving block No. 2. This holds for the other driving blocks No. 3 through No. 16. Specifically, recording elements satisfying recording element No. (16×a+b), where "a" is an integer of 0 through 7, are recording elements belonging to driving block No. b.

Driving of the recording elements is controlled in time-division driving according to the present embodiment so that the recording elements belonging to different driving blocks are sequentially driven at different timings from each other, following a preset driving order. The driving order settings are stored in the ROM 302 within the recording apparatus 1000 in the present embodiment, and are transmitted to the recording head 7 via the drive circuit 307. Block enable signals are transmitted to the recording head 7 at predetermined intervals, and the driving signals according to the AND of the block enable signals and recording data are applied to the recording elements. FIG. 7B illustrates recording elements belonging to the driving blocks being driven by driving signals 27 applied in the driving order of driving block Nos. 1, 5, 9, 13, 2, 6, 10, 14, 3, 7, 11, 15, 4, 8, 12, 16. As a result, ink droplets 28 are discharged as illustrated in FIG. 7C.

Multi-Pass Recording Method

Figure 8:
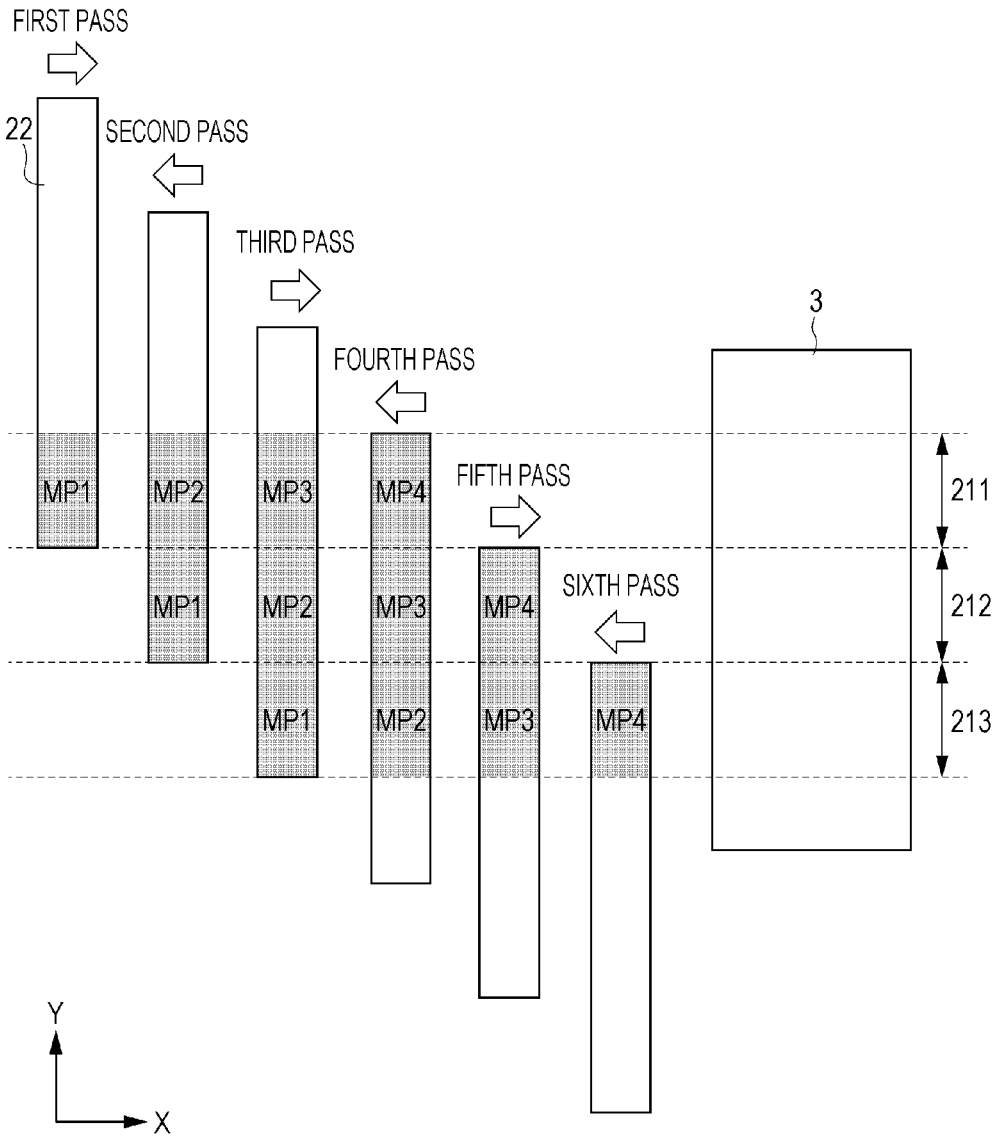
FIG. 8 is a diagram for describing a multi-pass recording method according to an embodiment.

Recording is performed in the present embodiment using multi-pass recording, where a unit region on a recording medium is recorded by multiple scans. FIG. 8 is a diagram for describing a general multi-pass recording method, illustrating an example where a unit region is recorded by four scans. The multi-pass recording method according to the present embodiment involves alternating scans from the upstream side in the X direction to the downstream side (hereinafter, also referred to as scanning in the "forward" direction) and scans from the downstream side in the X direction to the upstream side (hereinafter, also referred to as scanning in the "backward" direction).

The recording elements provided in recording element row 22 are divided into first, second, third, and fourth recording element groups in the Y direction. The first recording element group is made up of recording elements No. 97 through 128, the second recording element group is made up of recording elements No. 65 through 96, the third recording element group is made up of recording elements No. 33 through 64, and the fourth recording element group is made up of recording elements No. 1 through 32. The length of each of the first through fourth recording element groups in the Y direction is L/4, where the Y-directional length of the recording element row 22 is L.

In the first recording scan (first pass), ink is discharged from the first recording element group to a unit region 211 on the recording medium 3. This first pass is made from the upstream side toward the downstream side in the X direction.

Next, the recording medium 3 is conveyed relative to the recording head 7, from the upstream side toward the downstream side in the Y direction, by a distance L/4. Although a case is illustrated here where the recording head 7 has been conveyed over the recording medium 3 from the downstream side toward the upstream side in the Y direction for the same of brevity, the relative positional relationship as to the recording head 7 is the same as the recording medium 3 having been conveyed in downstream in the Y direction.

Thereafter, the second recording scan is performed. In the second recording scan (second pass), ink is discharged from the second recording element group to the unit region 211, and from the first recording element group to a unit region 212, on the recording medium 3. This second pass is made from the downstream side toward the upstream side in the X direction.

The reciprocal scanning of the recording head 7 and the relative conveyance of the recording medium 3 are alternately performed thereafter. As a result, after the fourth recording scan (fourth pass) has been performed, ink has been discharged onto the unit region 211 of the recording medium 3 once from each of the first through fourth recording element groups. Although a case of performing recording by four scans has been described here, recording can be performed in the same way by a different number of scans.

1-bit recording data to use in each scan is generated from the image data in the above-described multi-pass recording method according to the present embodiment, using image data having n (n≥2) bits of information, a mask pattern having m (m≥2) bits of information, and a decoding table stipulating discharging or non-discharging of ink in accordance with a combination of values indicated by multiple bits of information in each of the image data and mask pattern. A case will be described below where both the image data and mask pattern are made up of 2-bit information.

FIGS. 9A through 9E are diagrams illustrating the process of generating recording data using image data and mask patterns, each having multiple bits of information. FIG. 10 is a diagram illustrating a decoding table used to generate recording data such as illustrated in FIGS. 9A through 9E.

FIG. 9A is a diagram schematically illustrating 16 pixels 700 through 715 in a certain unit region. Although a unit region made up of pixel regions equivalent to 16 pixels is used for description here, for sake of brevity, the unit region according to the present embodiment has a size corresponding to 32 recording elements, as described with reference to FIG. 8, so the unit region in the present embodiment actually is made up of pixel regions equivalent to 32 pixels in the Y direction.

FIG. 9B is a diagram illustrating an example of image data corresponding to the unit region. In a case where the 2-bit information making up image data corresponding to a certain pixel is "00", i.e., the pixel value is "0", the number of times of ink discharge to that pixel is zero in the present embodiment. In a case where the 2-bit information making up image data corresponding to a certain pixel is "01", i.e., the pixel value is "1", the number of times of ink discharge to that pixel is once. Further, in a case where the 2-bit information making up image data corresponding to a certain pixel is "10", i.e., the pixel value is "2", the number of times of ink discharge to that pixel is twice. Accordingly, the pixel value for pixel 703, for example, in the image data in FIG. 9B is "0", so the number of times that ink is discharged to the pixel region corresponding to pixel 703 is zero. Also, the pixel value for pixel 700 for example is "2", so the number of times that ink is discharged to the pixel region corresponding to pixel 700 is twice.

FIGS. 9C1 through 9C4 are diagrams illustrating mask patterns to be applied to the image data illustrated in FIG. 9B, corresponding to the first through fourth scans, respectively. That is to say, the mask pattern MP1 corresponding to the first scan illustrated in FIG. 9C1 is applied to the image data illustrated in FIG. 9B, thereby generating recording data used in the first scan. In the same way, the mask patterns MP2, MP3, and MP4, corresponding to the second, third and fourth scan illustrated in FIGS. 9C2 through 9C4, are applied to the image data illustrated in FIG. 9B, thereby generating recording data used in the second, third and fourth scan.

Each of the pixels in the mask patterns illustrated in FIGS. 9C1 through 9C4 have 2-bit information set to one of "00", "01", and "10". In a case where the 2-bit information is "10", the value that the information indicates (hereinafter also referred to as "code value") is "2". In a case where the 2-bit information is "01", the value that the information indicates (code value) is "1". In a case where the 2-bit information is "00", the value that the information indicates (code value) is "0".

It can be seen by referencing the decoding table in FIG. 10 that in a case where the code value is "0", no ink is discharged, regardless of whether the pixel value corresponding to that pixel is "0", "1", or "2". That is to say, the code value "0" in the mask pattern corresponds to not permitting ink discharge at all (the number of ink discharge permitted is zero). In the following description, a pixel in a mask pattern to which the code value "0" has been allocated is also referred to as a "recording non-permitted pixel".

On the other hand, it can be seen by referencing the decoding table in FIG. 10 that in a case where the code value is "2", no ink is discharged if the pixel value of the corresponding pixel is "0" or "1", but ink is discharged if "2". That is to say, the code value of "2" corresponds to permitting discharge of ink once (the number of ink discharge permitted is once) as to three pixel values.

Further, in a case where the code value is "1", no ink is discharged if the pixel value of the corresponding pixel is "0", but ink is discharged if "1" or "2". That is to say, the code value of "1" corresponds to permitting discharge of ink twice (the number of ink discharge permitted is twice) as to three pixel values ("0", "1", and "2"). That is to say, the code value "1" is a code value that sets the largest number of times permitted, out of the number of times permitted that is reproduced by the 2-but information making up the mask pattern according to the present embodiment. In the following description, a pixel in a mask pattern to which a code value "1" or "2" has been allocated is also referred to as a "recording permitted pixel".

Now, a mask pattern having m-bit information that is used in the present embodiment is set based on the following Condition 1 and Condition 2.

Condition 1

Now, two of the four pixels at the same position in each of the four mask patterns illustrated in FIGS. 9C1 through 9C4 are allocated one code value each of "1" and "2" (recording permitted pixels), and the remaining two pixels (i.e., 4−2=2) are allocated the code value "0" (recording non-permitted pixel). For example, the pixel 700 is allocated the code value of "2" in the mask pattern illustrated in FIG. 9C1, and allocated "1" in the mask pattern illustrated in FIG. 9C2. The code value "0" is the allocated in the mask patterns in FIGS. 9C3 and 9C4. The pixel 700 thus is a recording permitted pixel in the mask patterns illustrated in FIGS. 9C1 and 9C2, and is a recording non-permitted pixel in the mask patterns illustrated in FIGS. 9C3 and 9C4.

Also, the pixel 701 is allocated the code value of "2" in the mask pattern illustrated in FIG. 9C4, and allocated "1" in the mask pattern illustrated in FIG. 9C1. The code value "0" is the allocated in the mask patterns in FIGS. 9C2 and 9C3. The pixel 701 thus is a recording permitted pixel in the mask patterns illustrated in FIGS. 9C1 and 9C4, and is a recording non-permitted pixel in the mask patterns illustrated in FIGS. 9C2 and 9C3. According to this configuration, recording data can be generated to discharge ink at a pixel region corresponding to certain pixel, regardless of whether the pixel value of that pixel is "0", "1", or "2", for a number of times of discharge corresponding to that pixel value.

Condition 2

The mask patterns illustrated in FIGS. 9C1 through 9C4 are each arranged so that the number of recording permitted pixels corresponding to the code value "1" is about the same number in each. More specifically, the code value "1" is allocated to the four pixels 701, 706, 711, and 712 in the mask pattern illustrated in FIG. 9C1. The code value "1" is allocated to the four pixels 700, 705, 710, and 715 in the mask pattern illustrated in FIG. 9C2. Further, the code value "1" is allocated to the four pixels 703, 704, 709, and 714 in the mask pattern illustrated in FIG. 9C3. Moreover, the code value "1" is allocated to the four pixels 702, 707, 708, and 713 in the mask pattern illustrated in FIG. 9C4. In other words, there are four recording permitted pixels corresponding to the code value "01" in the four mask patterns illustrated in FIGS. 9C1 through 9C4. In the same way, the mask patterns illustrated in FIGS. 9C1 through 9C4 are each arranged so that the number of recording permitted pixels corresponding to the code value "2" is the same number in each.

Although the same number of recording permitted pixels corresponding to each of the code values "1" and "2" are arranged in the mask patterns in the above description, in practice a number that is about the same will suffice. Accordingly, when generating recording data by distributing the image data over four scans using the mask patterns illustrated in FIGS. 9C1 through 9C4, the recording ratio can be made to be about the same for the four scans.

FIGS. 9D1 through 9D4 are diagrams illustrating recording data generated by applying the mask patterns illustrated in each of FIGS. 9C1 through 9C4 to the image data illustrated in FIG. 9B. For example, looking at the pixel 700 in the recording data corresponding to the first scan illustrated in FIG. 9D1, the pixel value of the image data is "2" and the code value of the mask pattern is "2", so discharge ("1") is set for the pixel 700 in accordance with the decoding table in FIG. 10. For the pixel 701, the pixel value of the image data is "1" and the code value of the mask pattern is "1", so discharge ("1") is set. For the pixel 704, the pixel value of the image data is "2" and the code value of the mask pattern is "0", so non-discharge ("0") is set.

Ink is discharged in the first through fourth scans following the recording data illustrated in FIGS. 9D1 through 9D4, that has been generated in this way. For example, ink is discharged to the pixel regions on the recording medium corresponding to pixels 700, 701, and 712 in the first scan, which can be seen from the recording data illustrated in FIG. 9D1.

FIG. 9E is a diagram showing the logical sum of recording data illustrated in each of FIGS. 9D1 through 9D4. By discharging ink according to the recording data illustrated in FIGS. 9D1 through 9D4, the pixel regions corresponding to the pixels receive discharge of ink as many times as shown in FIG. 9E.

For example, discharging of ink is set for the pixel 700 in recording data corresponding to the first and second scans illustrated in FIGS. 9D1 and 9D2. Accordingly, ink is discharged twice to the pixel region corresponding to the pixel 700, as illustrated in FIG. 9E. Also, discharging of ink is set for the pixel 701 in recording data corresponding to the first scan illustrated in FIG. 9D1. Accordingly, ink is discharged once to the pixel region corresponding to the pixel 701, as illustrated in FIG. 9E.

Comparing the recording data illustrated in FIG. 9E with the image data illustrated in FIG. 9B reveals that the recording data has been generated so that ink is discharged to each pixel in accordance with the number of times of discharge corresponding to the pixel value of the image data. For example, the pixel value of the image data in FIG. 9B for the pixels 700, 704, 708, and 712 is "2", and the number of times of discharge of ink indicated by the logical sum of the generated recording data also is twice. According to this configuration, 1-bit recording data used for each of multiple scans can be generated based on image data and mask patterns that have multi-bit information.

Discharge Deviation of Ink in Reciprocal Scanning

Next, deviation of ink discharge positions among forward scanning and backward scanning (between reciprocal scans) will be described in detail. The present embodiment suppresses deviation of ink discharge positions between reciprocal scans by the driving order of driving blocks in time-division driving. First, the correlation between the driving order of driving blocks in time-division driving control and ink landing positions in each driving block in the same row extending in the Y direction will be described regarding a certain color, with reference to FIGS. 11A through 11C.

FIG. 11A is a diagram illustrating an example of driving order in time-division driving control. FIG. 11B is a schematic diagram illustrating the way in which dots are formed in a case of driving recording element No. 1 through No. 16 while scanning from the upstream side toward the downstream side in the X direction (forward direction scan) following the driving order shown in FIG. 11A. FIG. 11C is a schematic diagram illustrating the way in which dots are formed in a case of driving recording element No. 1 through No. 16 while scanning from the downstream side toward the upstream side in the X direction (backward direction scan) following the driving order shown in FIG. 11A. Note that the recording element No. is larger in the upstream direction in the Y direction, as illustrated in FIG. 7A, so in the case of both FIGS. 11B and 11C, the dot situated at the position farthest downstream in the Y direction is a dot formed by the recording element No. 1, the farther upstream from that position the dots are, the larger the recording element No. of the recording element forming that dot, and the dot situated at the end position farthest upstream in the Y direction is a dot formed by the recording element No. 16.

An example will be described here where time-division driving is performed in the driving order of driving block No. 1, driving block No. 2, driving block No. 3, driving block No. 4, driving block No. 5, driving block No. 6, driving block No. 7, driving block No. 8, driving block No. 9, driving block No. 10, driving block No. 11, driving block No. 12, driving block No. 13, driving block No. 14, driving block No. 15, and driving block No. 16, as illustrated in FIG. 11A. When scanning in the forward direction, ink droplets discharged by recording elements that are driven earlier are discharged at the upstream side in the X direction. Accordingly, in a case of performing time-division driving of the recording elements No. 1 through No. 16 in the driving order illustrated in FIG. 11A, the dot formed by the recording element No. 1 is situated farthest upstream in the X direction, the larger the recording element No. is the farther the dots are shifted in the downstream side in the X direction, and the dot formed by the recording element No. 16 is situated farthest downstream in the X direction, as illustrated in FIG. 11B.

On the other hand, when scanning in the backward direction, ink droplets discharged by recording elements that are driven earlier are discharged at the downstream side in the X direction. Accordingly, in a case of performing time-division driving of the recording elements No. 1 through No. 16 in the driving order illustrated in FIG. 11A, the dot formed by the recording element No. 1 is situated farthest downstream in the X direction, the larger the recording element No. is the farther the dots are shifted in the upstream side in the X direction, and the dot formed by the recording element No. 16 is situated farthest upstream in the X direction, as illustrated in FIG. 11C. Thus, the earlier in the order of having driven the driving blocks when scanning in the forward direction, the more upstream in the X direction the position of the dots formed will be. On the other hand, the earlier in the order of having driven the driving blocks when scanning in the backward direction, the more downstream in the X direction the position of the dots formed will be.

It can thus be seen that even if the driving order is the same, the ink landing position from the driving blocks under time-division driving will be reversed of the scan direction is differ. Now, it can be understood that if the driving order of driving blocks when scanning in the backward direction and the driving order of driving blocks when scanning in the forward direction are reversed, the landing positions of ink from the driving blocks under time-division driving will be the same in forward direction scanning and backward direction scanning. For example, in the case of time-division driving of the recording element No. 1 through No. 16 in the driving order illustrated in FIG. 11A when scanning in the forward direction, the ink landing positions when scanning in the backward direction can be made to be the same as in the forward direction by performing time-division driving in the driving order of driving block No. 16, driving block No. 15, driving block No. 14, driving block No. 13, driving block No. 12, driving block No. 11, driving block No. 10, driving block No. 9, driving block No. 8, driving block No. 7, driving block No. 6, driving block No. 5, driving block No. 4, driving block No. 3, driving block No. 2, and driving block No. 1.

In light of the above, description will be made regarding ink landing position deviation from each driving block among reciprocal scans for multiple combinations made between recording data and driving order. FIGS. 12A through 12E are diagrams for describing combinations of recording data and driving order. FIGS. 12A1 and 12A2 illustrate an example of recording data corresponding to forward scanning and backward scanning, and FIGS. 12B1 and 12B2 illustrate another example of recording data corresponding to forward scanning and backward scanning. Note that the solid pixels in FIG. 12A1 through 12B2 indicate ink discharge (the recording data is "1"). FIG. 12C illustrates an example of driving order in time-division driving, and FIG. 12D illustrates another example of driving order in time-division driving. FIG. 12E illustrates the contents of the four sets with different recording data and driving order. It can be seen from FIG. 12E that four sets recording data and driving order are set, from a first set through a fourth set.

For the first set, the recording data illustrated in FIGS. 12B1 and 12B2 are used as recording data for forward scanning and backward scanning, respectively, with the driving order for the forward scan being the driving order illustrated in FIG. 12C, and the driving order for the backward scan being the driving order illustrated in FIG. 12D. The recording data illustrated in FIGS. 12B1 and 12B2 is data where pixels set for recording are consecutive in the X direction (dispersion in the X direction of pixels set for recording is low). The driving order for the forward scan (FIG. 12C) and the driving order for the backward scan (FIG. 12D) are opposite from each other as described above, so the ink landing positions from the driving blocks in time-division driving is the same among reciprocal scans.

For the second set, the recording data illustrated in FIGS. 12A1 and 12A2 are used as recording data for forward scanning and backward scanning, respectively, with the driving order for the forward scan being the driving order illustrated in FIG. 12C, and the driving order for the backward scan being the driving order illustrated in FIG. 12D. The recording data illustrated in FIGS. 12A1 and 12A2 is data where pixels set for recording are non-consecutive in the X direction (dispersion in the X direction of pixels set for recording is high). The driving order for the forward scan (FIG. 12C) and the driving order for the backward scan (FIG. 12D) are opposite from each other as described above, so the ink landing positions from the driving blocks in time-division driving is the same among reciprocal scans.

For the third set, the recording data illustrated in FIGS. 12B1 and 12B2 are used as recording data for forward scanning and backward scanning, respectively, with the driving order for the forward scan and backward scan being the driving order illustrated in FIG. 12C. The recording data illustrated in FIGS. 12B1 and 12B2 is data where pixels set for recording are consecutive in the X direction (dispersion in the X direction of pixels set for recording is low). The driving order for the forward scan and the backward scan (FIG. 12C)are the same as described above, so the ink landing positions from the driving blocks in time-division driving are opposite among reciprocal scans.

For the fourth set, the recording data illustrated in FIGS. 12A1 and 12A2 are used as recording data for forward scanning and backward scanning, respectively, with the driving order for the forward scan and backward scan being the driving order illustrated in FIG. 12C. The recording data illustrated in FIGS. 12A1 and 12A2 is data where pixels set for recording are non-consecutive in the X direction (dispersion in the X direction of pixels set for recording is high). The driving order for the forward scan and the backward scan (FIG. 12C)are the same as described above, so the ink landing positions from the driving blocks in time-division driving are opposite among reciprocal scans.

Images recorded in a case where deviation occurs between forward scans and backward scans in the four combinations of recording data and driving order will be described with reference to FIGS. 13A through 16D. FIGS. 13A through 13D illustrate the images recorded in the case of the first set, FIGS. 14A through 14D the second set, FIGS. 15A through 15D the third set, and FIGS. 16A through 16D the fourth set. In each of FIGS. 13A through 16D, the "A"s schematically illustrate images recorded in a case where there is no deviation between the forward scan and the backward scan, the "B"s illustrate images recorded in a case where there is deviation of ½ dot in the X direction between the forward scan and the backward scan, the "C"s illustrate images recorded in a case where there is deviation of 1 dot in the X direction between the forward scan and the backward scan, and the "D"s illustrate images recorded in a case where there is deviation of 2 dots in the X direction between the forward scan and the backward scan. In all of the illustrations, the circles with vertical lines inside represent dots formed in the forward scan, and the circles with horizontal lines inside represent dots formed in the backward scan.

Figure 13A:
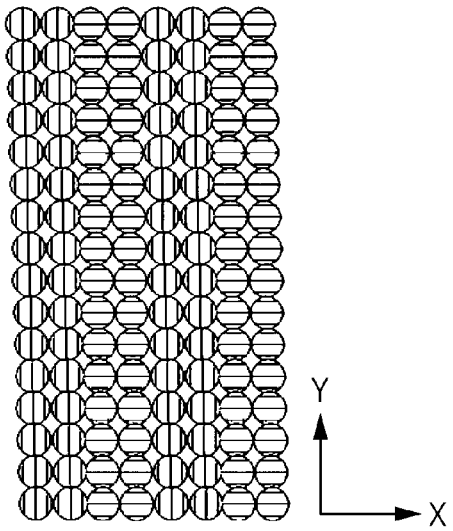
FIGS. 13A through 13D are diagrams for describing the degree of ink discharge position deviation among scans.
Figure 13B:
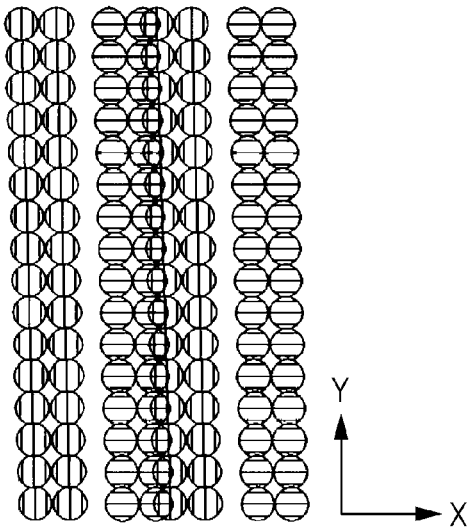
Figure 13C:
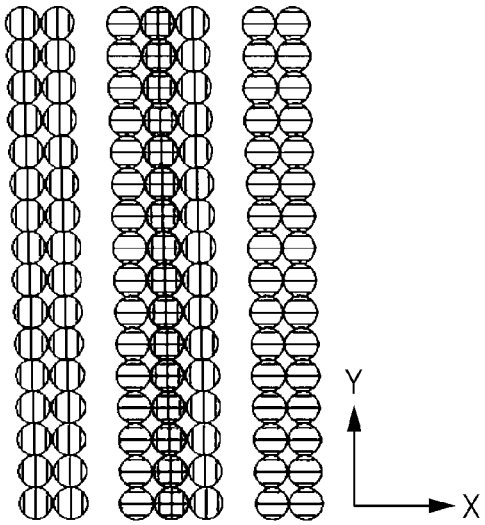
Figure 13D:
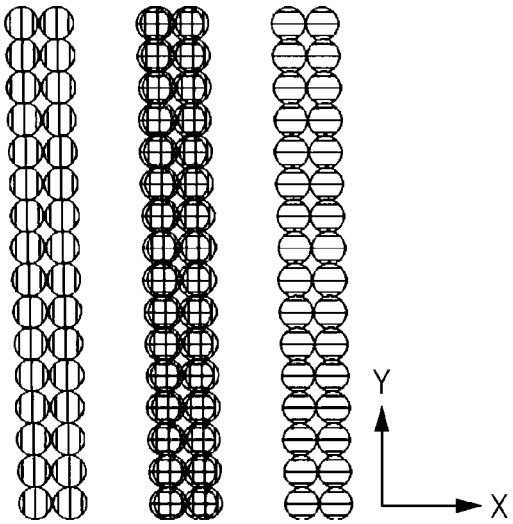

First, the first set will be described. In a case where there is no positional deviation between the forward scan and the backward scan, an ideal image can be recorded with no missing dots or overlapping, as illustrated in FIG. 13A. However, as the deviation in the X direction between reciprocal scans increases, as illustrated in FIGS. 13B, 13C, and 13D, the degree of missing dots and overlapping increases. Particularly, in a case where there is two dots worth of deviation in the X direction between reciprocal scans, deviation of approximately two dots worth occurs straightforward in the image being recorded as illustrated in FIG. 13D, so the image quality of the obtained image is markedly low. Thus, the settings of the first set can obtain preferable images in a case where there is no deviation in the X direction between reciprocal scans, the desired image quality may not be able to be obtained in a case where there is deviation in the X direction between reciprocal scans.

Figure 14A:
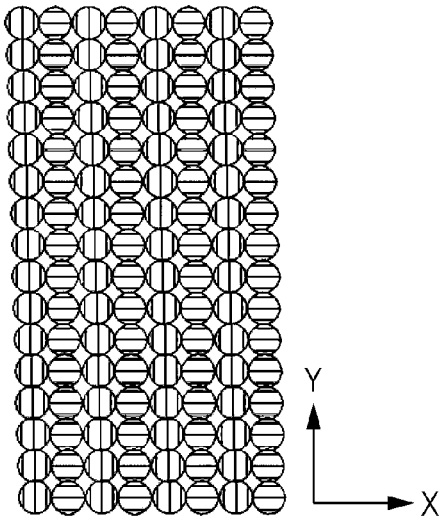
FIGS. 14A through 14D are diagrams for describing the degree of ink discharge position deviation among scans.
Figure 14B:
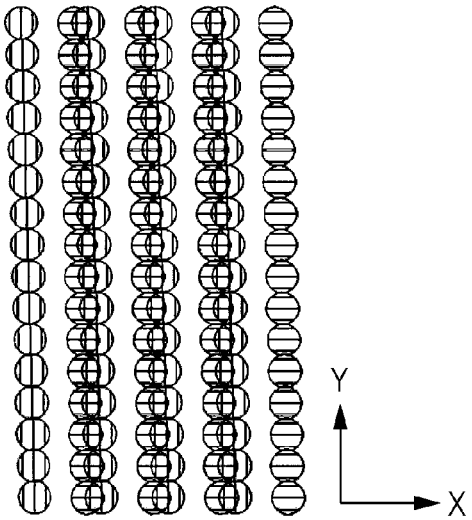
Figure 14C:
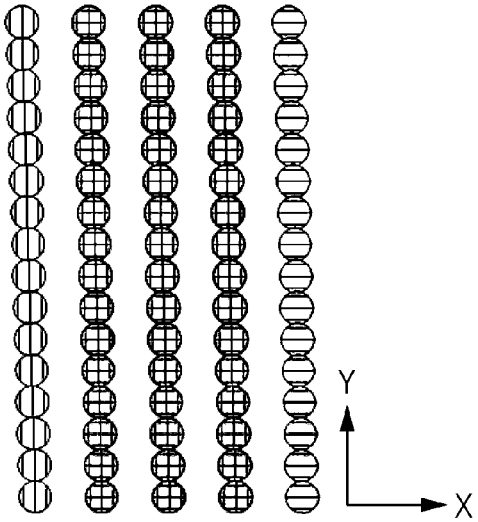
Figure 14D:
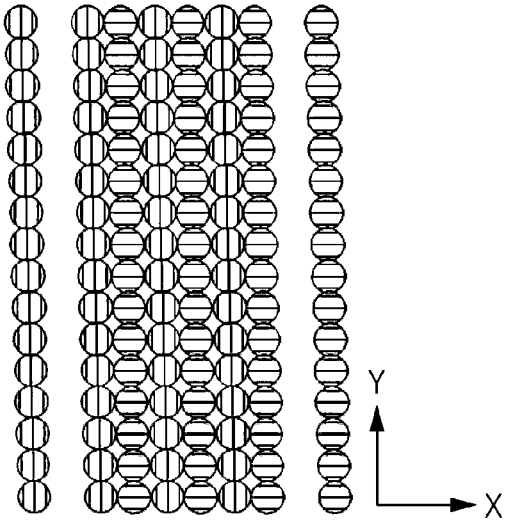

Next, the second set will be described. In a case where there is no positional deviation between the reciprocal scans, an ideal image can be recorded with no missing dots or overlapping, as illustrated in FIG. 14A, in the same way as with the first set in FIG. 13A. Further, in a case where there is large deviation of two dots worth in the X direction between reciprocal scans as illustrated in FIG. 14D, an image with a relatively small degree of missing dots and overlapping can be obtained, unlike the first set in FIG. 13D. This is because the dispersion of recording data in the X direction is high for both the forward scan and backward scan. However, in a case where the deviation in the X direction between reciprocal scans is ½ dot and 1 dot, as illustrated in FIGS. 14B and 14C, images with conspicuous missing dots and overlapping are recorded, in the same way as in FIGS. 13B and 13C. Thus, the settings of the second set can obtain preferable images in a case where there is no deviation in the X direction between reciprocal scans, and further can suppress deterioration in image quality as compared to the settings of the first set in cases where the deviation in the X direction between reciprocal scans is relatively large. However, the settings of the second set cannot suppress deterioration in image quality in cases where the deviation in the X direction between reciprocal scans is relatively small.

Figure 15A:
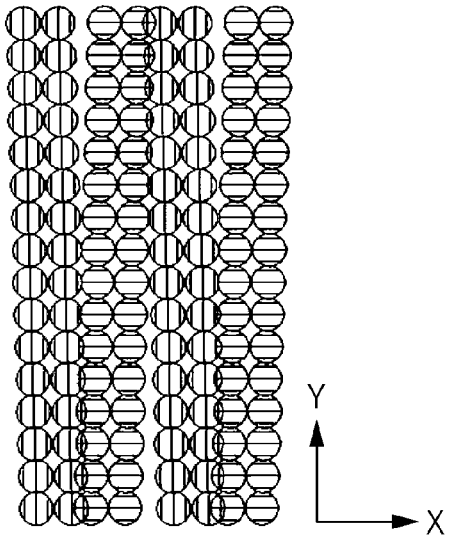
FIGS. 15A through 15D are diagrams for describing the degree of ink discharge position deviation among scans.
Figure 15B:
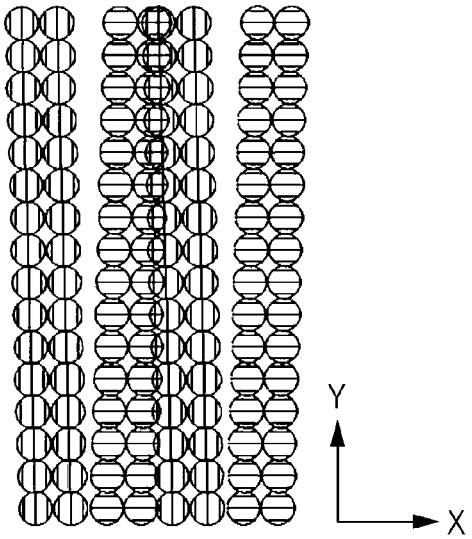
Figure 15C:
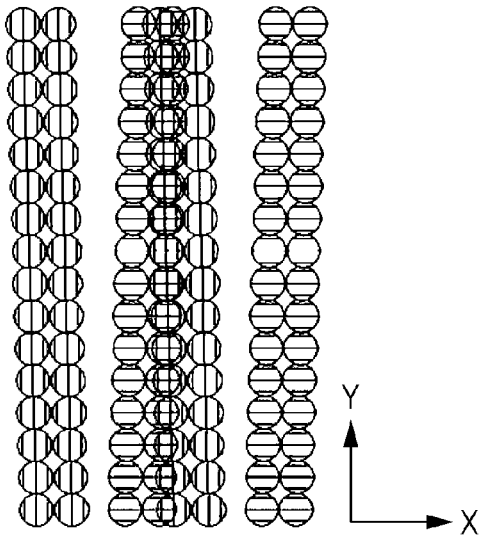
Figure 15D:
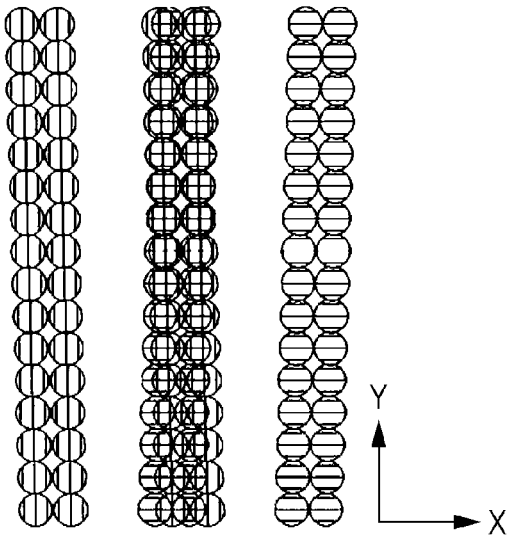

The third set will be described next. In a case where there is no positional deviation between the reciprocal scans, there is slight missing dots and overlapping, as illustrated in FIG. 15A. Also, in a case where the deviation in the X direction between reciprocal scans is relatively large as illustrated in FIG. 15D, images are recorded with a large degree of missing dots and overlapping, in the same way as illustrated in FIG. 13D. On the other hand, in a case where the deviation in the X direction between reciprocal scans is relatively small as illustrated in FIGS. 15B and 15C, images can be recorded where the degree of missing dots and overlapping is somewhat suppressed as compared to the cases in FIGS. 13B, 13C, 14B, and 14C, since the inclinations of dots formed in the forward scan and backward scan differ. That is to say, the settings of the third set enable deterioration of image quality due to deviation in the X direction between reciprocal scans to be suppressed. This is because the ink discharge positions are different between the forward scan and backward scan, so the distances between the dots formed in the forward scan and backward scan differ according to the driving block. Thus, the settings of the third set can suppress deterioration in image quality in cases where the deviation in the X direction is relatively small.

Figure 16A:
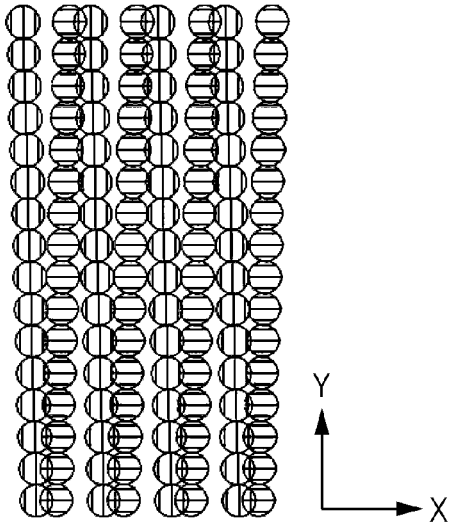
FIGS. 16A through 16D are diagrams for describing the degree of ink discharge position deviation among scans.
Figure 16B:
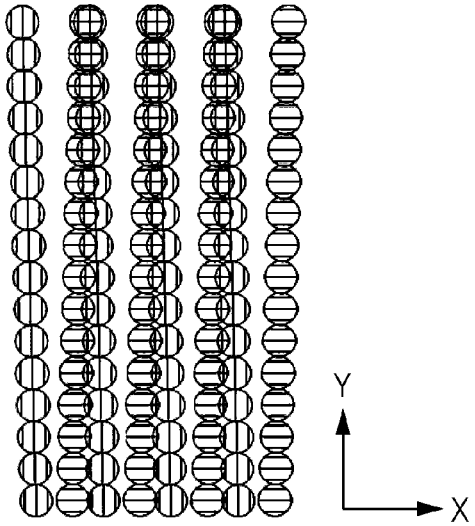
Figure 16C:
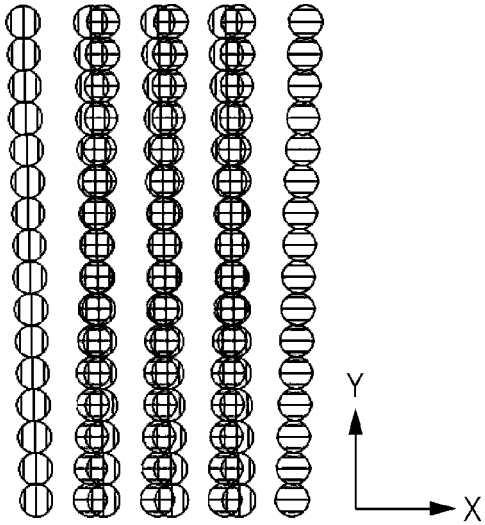
Figure 16D:
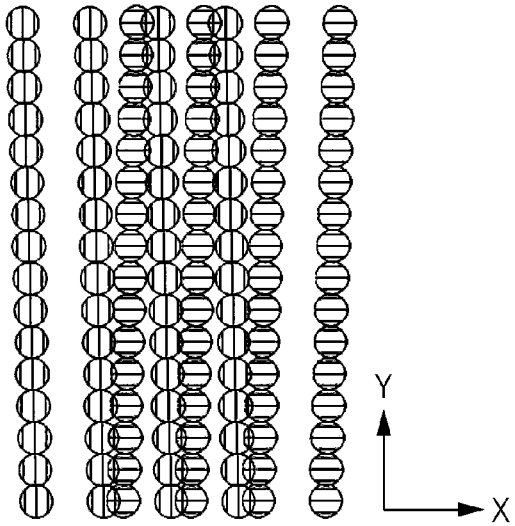

Finally, the fourth set will be described. In a case where there is no positional deviation between the reciprocal scans, there is slight missing dots and overlapping, in the same way as with the third set in FIG. 15A, as illustrated in FIG. 16A. However, in a case where the deviation in the X direction between reciprocal scans is relatively small, in the same way as in the third set, illustrated in FIGS. 16B and 16C, images can be recorded where the degree of missing dots and overlapping is somewhat suppressed, in the same way as in FIGS. 15B and 15C. Further, the settings of the fourth set enable images to be recorded with a small degree of missing dots and overlapping, even in a case where the deviation in the X direction between reciprocal scans is relatively large, as illustrated in FIG. 16D.

It can be thus seen from the images recorded by the settings according to the first, second third, and fourth sets, the settings according to the fourth set is more preferable with regard to suppressing image quality deterioration due to deviation in the X direction between reciprocal scans, with the settings according to the third set being next preferable. Accordingly, time-division driving is performed in the present embodiment so that the dot landing positions from the driving blocks differs between reciprocal scans. Now, the driving order of the driving blocks in scanning in the forward direction and scanning in the backward direction is not opposite to each other in the present embodiment. Thus, the discharge positions of dots recorded in the forward scan and the backward scan can be made to be different, as described with reference to FIGS. 11A through 11C.

Mask Patterns Applied in Present Embodiment

Figure 17A:
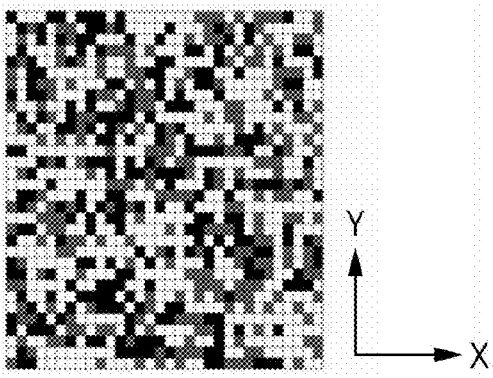
FIGS. 17A through 17F are diagrams illustrating mask patterns applied in an embodiment.
Figure 17B:
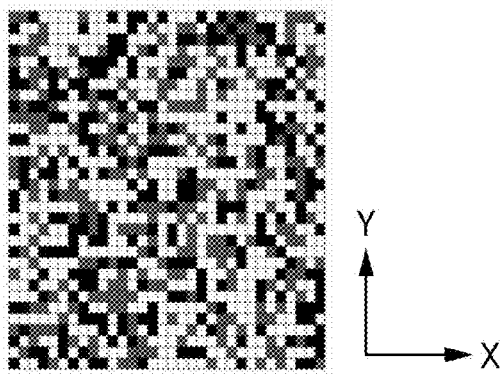
Figure 17C:
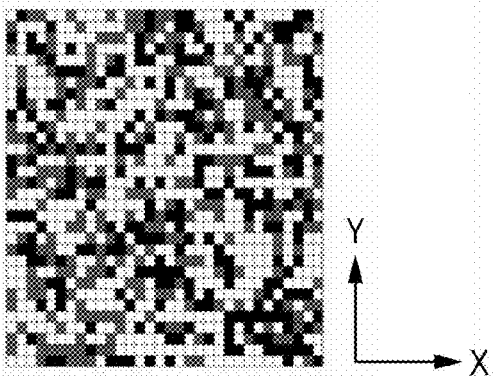
Figure 17D:
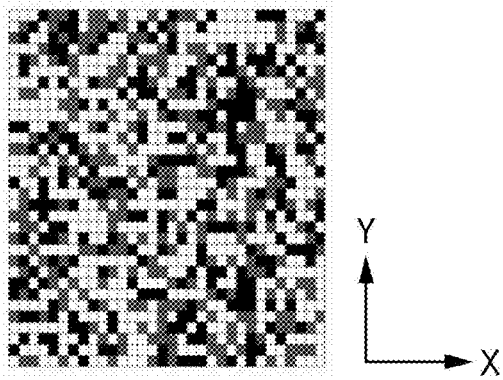
Figure 17E:
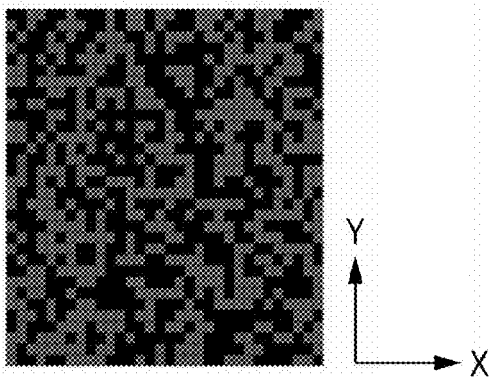
Figure 17F:
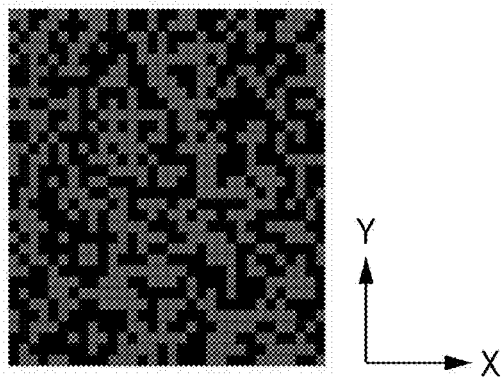

FIGS. 17A through 17F are diagrams illustrating mask patterns used in the present embodiment. Note that FIG. 17A illustrates a mask pattern MP1 corresponding to the first scan, FIG. 17B illustrates a mask pattern MP2 corresponding to the second scan, FIG. 17C illustrates a mask pattern MP3 corresponding to the third scan, and FIG. 17D illustrates a mask pattern MP4 corresponding to the fourth scan. Also, FIG. 17E illustrates a logical sum pattern MP1+MP3 obtained as the logical sum of the number of times of permitted discharge of ink stipulated in the mask pattern MP1 corresponding to the first scan in FIG. 17A and the mask pattern MP3 corresponding to the third scan in FIG. 17C. Further, FIG. 17F illustrates a logical sum pattern MP2+MP4 obtained as the logical sum of the number of times of permitted discharge of ink stipulated in the mask pattern MP2 corresponding to the second scan in FIG. 17B and the mask pattern MP4 corresponding to the fourth scan in FIG. 17D. In FIGS. 17A through 17F, the white pixels indicate pixels to which the code value "0" has been allocated, the gray pixels indicate pixels to which the code value "1" has been allocated, and the black pixels indicate pixels to which the code value "2" has been allocated. It can be seen from these FIGS. 17A through 17F that an arrangement 32 pixels in the X direction and 32 pixels in the Y direction, for a total of 1024 pixels, to which the number of permitted times of ink discharge has been set, is used as a repetitive increment of a mask pattern, and this repetitive increment is repeated in the X direction and the Y direction.

The logical sum of the number of permitted times of ink discharge means the calculated sum of the permitted number of times indicated by the code values of the corresponding multiple mask patterns. For example, the code value is "2" (number of permitted ink discharges is once) for the pixel at the farthest upper left of the mask pattern MP1 illustrated in FIG. 17A, and the code value is "0" (number of permitted ink discharges is zero) for the pixel at the farthest upper left of the mask pattern MP3 illustrated in FIG. 17C, so the code value is "2" (number of permitted ink discharges is once) for the pixel at the farthest upper left of the logical sum mask pattern MP1+MP3 illustrated in FIG. 17E. Also, for example, the code value is "1" (number of permitted ink discharges is twice) for the pixel at the farthest upper left of the mask pattern MP2 illustrated in FIG. 17B, and the code value is "0" (number of permitted ink discharges is zero) for the pixel at the farthest upper left of the mask pattern MP4 illustrated in FIG. 17D, so the code value is "1" (number of permitted ink discharges is twice) for the pixel at the farthest upper left of the logical sum mask pattern MP2+MP4 illustrated in FIG. 17F.

The mask patterns MP1 through MP4 illustrated in FIGS. 17A through 17D are set so as to satisfy the above-described Condition 1 and Condition 2. That is to say, code values are allocated to the pixels such that, of four pixels at the same position in the mask patterns MP1 through MP4 illustrated in FIGS. 17A through 17D, one each of code values "1" and "2" is allocated to two pixels, and code value "0" is allocated to the remaining two (i.e., 4−2=2) pixels (Condition 1). Further, code values are allocated to the pixels such that, among the mask patterns MP1 through MP4 illustrated in FIGS. 17A through 17D, the number of pixels to which the code value "1" has been assigned is about the same, and the number of pixels to which the code value "2" has been assigned is about the same (Condition 2).

In order to suppress ink discharge position deviation between reciprocal scans in the present embodiment, recording data is generated so as to discharge ink in the same pixel regions when scanning in the forward direction (first and third scans) and the backward direction (second and fourth scans) when recording high concentration images. In light of this point, code values are allocated to the pixels in the mask patterns MP1 through MP4 so that, of four pixels at the same position, code value "2" is allocated in mask patterns MP2 and MP4 for pixels in the backward scans corresponding to pixels to which code value "1" is allocated in mask patterns MP1 and MP3, and code value "1" is allocated in mask patterns MP2 and MP4 for pixels in the backward scans corresponding to pixels to which code value "2" is allocated in mask patterns MP1 and MP3. Accordingly, in a case of image data being input for a high-concentration image, such as where the pixel value is "2", recording data can be generated where ink is discharged to one pixel region once each in the forward scan and the backward scan.

The mask patterns MP1 through MP4 illustrated in FIGS. 17A through 17D are set so that pixels where the code value "1" is allocated in the logical sum pattern MP1+MP3 and that pixels where the code value "1" is allocated in the logical sum pattern MP2+MP4 do not occur in an alternating manner in the X direction. More specifically, code values are allocated to the pixels in the mask patterns MP1 through MP4 so that pixels where the code value "1" is allocated in the logical sum pattern MP1+MP3 assume an arrangement having random white noise properties and pixels where the code value "1" is allocated in the logical sum pattern MP2+MP4 assume an arrangement having random white noise properties.

To describe this in detail, the logical sum pattern MP1+MP3 according to the present embodiment has the code value "1" allocated to 513 of the 1024 pixels therein, and of these, 119 pixels to which the code "1" has been assigned are adjacent at both sides in the X direction to a pixel that has been allocated code value "1" in the logical sum pattern MP2+MP4. On the other hand, of the 513 pixels to which the code value "1" has been allocated in the logical sum pattern MP1+MP3, 119 pixels to which the code "1" has been assigned are not adjacent in the X direction to a pixel that has been allocated code value "1" in the logical sum pattern MP2+MP4. That is to say, of the 513 pixels to which the code value "1" has been allocated in the logical sum pattern MP1+MP3, the number of pixels adjacent at both sides in the X direction to a pixel that has been allocated code value "1" in the logical sum pattern MP2+MP4, and the number of pixels not adjacent in the X direction, is the same number.

For example, in the row at the edge portion of the logical sum pattern MP1+MP3 farthest downstream in the Y direction (the top in FIG. 17E), the code value "1" is allocated to the 3rd, 4th, 7th, 11th, 13th, 14th, 16th, 17th, 20th, 21st, 22nd, 24th, 26th, 27th, 28th, and 32nd pixels from the upstream side in the X direction (left side in FIG. 17E). On the other hand, the row at the edge portion of the logical sum pattern MP2+MP4 farthest downstream in the Y direction (the top in FIG. 17F), the code value "1" is allocated to the 1st, 2nd, 5th, 6th, 8th, 9th, 10th, 12th, 15th, 18th, 19th, 23rd, 25th, 29th, 30th, and 31st pixels from the upstream side in the X direction (left side in FIG. 17F).

Now, of the row at the edge portion of the logical sum pattern MP1+MP3 farthest downstream in the Y direction (the top in FIG. 17E), the 7th, 11th, 24th, and 32nd pixels allocated code value "1" from the upstream side in the X direction (left side in FIG. 17E) are adjacent in the X direction at both sides to pixels in the logical sum pattern MP2+MP4 to which the code value "1" has been allocated. That is to say, of the pixels in the row at the edge portion of the logical sum pattern MP1+MP3 farthest downstream in the Y direction (the top in FIG. 17E), the number of pixels adjacent in the X direction at both sides to pixels in the logical sum pattern MP2+MP4 in the row farthest downstream in the Y direction (the top in FIG. 17F) to which the code value "1" has been allocated, is four.

On the other hand, of the row at the edge portion of the logical sum pattern MP1+MP3 farthest downstream in the Y direction (the top in FIG. 17E), the 21st and 27th pixels from the upstream side in the X direction (left side in FIG. 17E) are not adjacent in the X direction to pixels in the logical sum pattern MP2+MP4 to which the code value "1" has been allocated. That is to say, of the pixels in the row at the edge portion of the logical sum pattern MP1+MP3 farthest downstream in the Y direction (the top in FIG. 17E), the number of pixels not adjacent in the X direction to pixels in the logical sum pattern MP2+MP4 in the row farthest downstream in the Y direction (the top in FIG. 17F) to which the code value "1" has been allocated, is two.

Performing the same calculation for each row within the logical sum pattern MP1+MP3 shows that, of the pixels to which the code value "1" has been allocated, the number of pixels adjacent at both sides in the X direction to a pixel in the logical sum pattern MP2+MP4 to which the code value "1" has been allocated is 119, and the number of pixels not adjacent in the X direction also is 119.

In the same way, the logical sum pattern MP2+MP4 according to the present embodiment has the code value "1" allocated to 511 of the 1024 pixels therein, and of these, 120 pixels to which the code "1" has been assigned are adjacent at both sides in the X direction to a pixel that has been allocated code value "1" in the logical sum pattern MP1+MP3. On the other hand, of the 511 pixels to which the code value "1" has been allocated in the logical sum pattern MP2+MP4, 120 pixels to which the code "1" has been assigned are not adjacent in the X direction to a pixel that has been allocated code value "1" in the logical sum pattern MP2+MP4. That is to say, of the pixels to which the code value "1" has been allocated in the logical sum pattern MP2+MP4, the number of pixels adjacent at both sides in the X direction to a pixel that has been allocated code value "1" in the logical sum pattern MP1+MP3, and the number of pixels not adjacent in the X direction, is the same number.

The mask patterns MP1 through MP4 are set based on conditions such as described above. Note that in the present embodiment, the mask patterns MP1 through MP4 illustrated in FIGS. 17A through 17D are used for all of the image data C4 for cyan ink, image data M4 for magenta ink, image data Y4 for yellow ink, image data K4 for black ink, and image data G4 for gray ink. Note however, that the present embodiment is not restricted to this arrangement, and other mask patterns may be applied to each of the image data C4 for cyan ink, image data M4 for magenta ink, image data Y4 for yellow ink, image data K4 for black ink, and image data G4 for gray ink.

Driving Order of Driving Blocks in Present Embodiment

The driving order of the driving blocks in the recording element rows discharging the cyan ink and magenta ink, and the driving order of the driving blocks in the recording element rows discharging the gray ink, are differed from each other in the time-division driving control in the present embodiment. The reason for this will be described later in detail.

FIG. 18A is a diagram illustrating an example of the driving order of driving blocks in recording element rows discharging cyan ink and magenta ink, executed in the present embodiment. FIG. 18B is a schematic diagram illustrating the way in which dots are formed in a case of driving recording element No. 1 through No. 16 while scanning in the forward direction scan following the driving order shown in FIG. 18A. FIG. 18C is a schematic diagram illustrating the way in which dots are formed in a case of driving recording element No. 1 through No. 16 while scanning in the backward direction scan following the driving order shown in FIG. 18A.

An example will be described here where time-division driving is performed for both forward scanning and backward scanning in the driving order of driving block No. 1, driving block No. 9, driving block No. 6, driving block No. 14, driving block No. 3, driving block No. 11, driving block No. 8, driving block No. 16, driving block No. 5, driving block No. 13, driving block No. 2, driving block No. 10, driving block No. 7, driving block No. 15, driving block No. 4, and driving block No. 12, as illustrated in FIG. 18A, for the recording element rows discharging cyan ink and magenta ink.

As described above, time-division driving is performed such that the landing positions of cyan ink and magenta ink from the driving blocks differ between forward scanning and backward scanning. More specifically, the driving order of driving blocks in forward scanning and the driving order of driving blocks in backward scanning are the same order to perform reciprocal scanning in the present embodiment. Note that this is not necessarily restricted to the driving order of driving blocks being the same in reciprocal scanning; it is sufficient for the driving order of driving blocks in the backward scan to be opposite to the driving order of driving blocks in the forward scan in order to differ the discharge position of ink when performing reciprocal scanning such as described above.

In a case of performing time-division driving of the recording elements No. 1 through No. 16 following the driving order illustrated in FIG. 18A, in forward scanning, the dot formed from recording element No. 1 driven the first is situated farthest upstream in the X direction as illustrated in FIG. 18B, the dots formed in the order of recording element Nos. 9, 6, 14, 3, 11, 8, 16, 5, 13, 2, 10, 7, 15, and 4, are situated deviated from the upstream side in the X direction toward the downstream side, and the dot formed by the recording element No. 12 driven last is situated farthest downstream in the X direction.

On the other hand, in the backward scan, the dot formed from recording element No. 1 driven the first is situated farthest downstream in the X direction as illustrated in FIG. 18C, the dots formed in the order of recording element Nos. 9, 6, 14, 3, 11, 8, 16, 5, 13, 2, 10, 7, 15, and 4, are situated deviated from the downstream side in the X direction toward the upstream side, and the dot formed by the recording element No. 12 driven last is situated farthest upstream in the X direction.

Thus, by driving the recording elements belonging to the driving blocks according to the driving order illustrated in FIG. 18A, the landing positions of cyan ink and magenta ink in the same rows extending in the Y direction can be made to differ between reciprocal scans.

FIG. 19A is a diagram illustrating an example of the driving order of driving blocks in recording element rows discharging gray ink, executed in the present embodiment. FIG. 19B is a schematic diagram illustrating the way in which dots are formed in a case of driving recording element No. 1 through No. 16 while scanning in the forward direction scan following the driving order shown in FIG. 19A. FIG. 19C is a schematic diagram illustrating the way in which dots are formed in a case of driving recording element No. 1 through No. 16 while scanning in the backward direction scan following the driving order shown in FIG. 19A.

An example will be described here where time-division driving is performed for both forward scanning and backward scanning in the driving order of driving block No. 5, driving block No. 13, driving block No. 2, driving block No. 10, driving block No. 7, driving block No. 15, driving block No. 4, driving block No. 12, driving block No. 1, driving block No. 9, driving block No. 6, driving block No. 14, driving block No. 3, driving block No. 11, driving block No. 8, and driving block No. 16, as illustrated in FIG. 19A, for the recording element rows discharging gray ink.

In a case of performing time-division driving of the recording elements No. 1 through No. 16 following the driving order illustrated in FIG. 19A, the dot formed from recording element No. 5 driven the first is situated farthest upstream in the X direction as illustrated in FIG. 19B, the dots formed in the order of recording element Nos. 13, 2, 10, 7, 15, 4, 12, 1, 9, 6, 14, 3, 11, and 8, are situated deviated from the upstream side in the X direction toward the downstream side, and the dot formed by the recording element No. 16 driven last is situated farthest downstream in the X direction.

On the other hand, in the backward scan, the dot formed from recording element No. 5 driven the first is situated farthest downstream in the X direction as illustrated in FIG. 19C, the dots formed in the order of recording element Nos. 13, 2, 10, 7, 15, 4, 12, 1, 9, 6, 14, 3, 11, 8, are situated deviated from the downstream side in the X direction toward the upstream side, and the dot formed by the recording element No. 16 driven last is situated farthest upstream in the X direction.

Thus, by driving the recording elements belonging to the driving blocks according to the driving order illustrated in FIG. 19A, the landing positions of gray ink in the same row extending in the Y direction can be made to differ between reciprocal scans.

Now, the driving order of the recording element row discharging gray ink in FIG. 19A is an order that is offset from the driving order of the recording element rows discharging cyan ink and magenta ink in FIG. 18A by eight. More specifically, the driving order of the driving block No. 5, driving block No. 13, driving block No. 2, driving block No. 10, driving block No. 7, driving block No. 15, driving block No. 4, and driving block No. 12, that were the 9th through 16th in driving order in the driving order in FIG. 18A are moved up by eight each in the driving order illustrated in FIG. 19A, as set to the 1st through 8th in driving order. Also, the driving order of the driving block No. 1, driving block No. 9, driving block No. 6, driving block No. 14, driving block No. 3, driving block No. 11, driving block No. 8, and driving block No. 16, that were the 1st through 8th in driving order in the driving order in FIG. 18A are moved down by eight each in the driving order illustrated in FIG. 19A, as set to the 9th through 16th in driving order.

By changing the driving order in the recording element row discharging gray ink and the driving order in the recording element rows discharging cyan ink and magenta ink, the landing positions of gray ink can be deviated from the landing positions of cyan ink and magenta ink, even if the recording data stipulates that the cyan ink and magenta ink are to be applied to the same pixel as the gray ink. This enables graininess, due to the gray ink landing superimposed at the same positions as the cyan ink and magenta ink, to be suppressed.

Figure 20A:
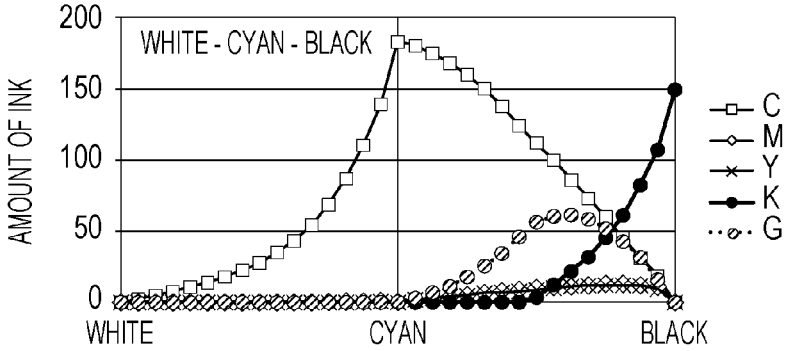
FIGS. 20A through 20D are diagrams illustrating color separation tables according to an embodiment.
Figure 20B:
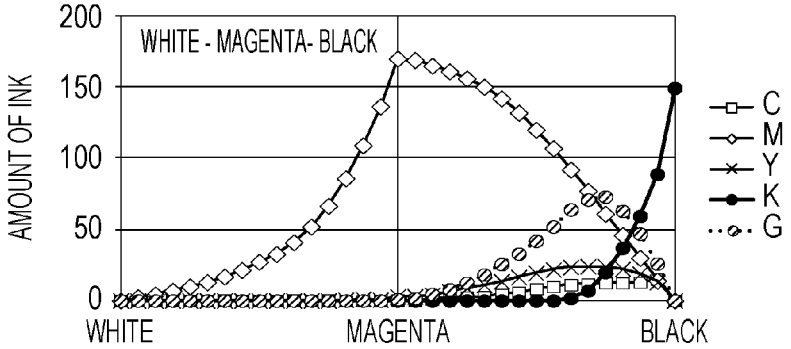
Figure 20C:
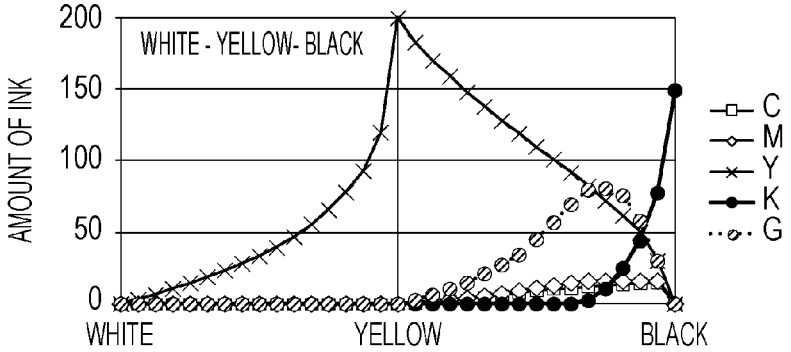
Figure 20D:
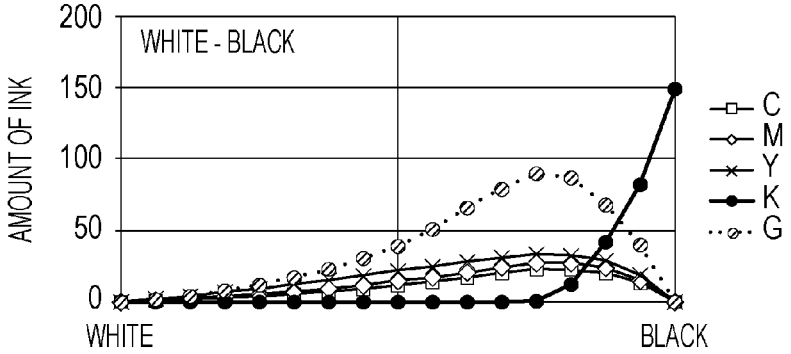

The reason why gray ink has been selected as the ink out of the cyan ink, magenta ink, and gray ink, to have a different driving order from the other color inks, will be described in detail. FIGS. 20A through 20D are diagrams illustrating examples of color separation tables in a system using cyan (C), magenta (M), yellow (Y), black (K), and gray (G) ink. FIG. 20A illustrates the amount of ink of each color used to reproduce each other when passing from white through cyan and to black, showing a so-called cyan line. FIG. 20B illustrates the amount of ink of each color used to reproduce each other when passing from white through magenta and to black, showing a so-called magenta line. FIG. 20C illustrates the amount of ink of each color used to reproduce each other when passing from white through yellow and to black, showing a so-called yellow line. FIG. 20D illustrates the amount of ink of each color used to reproduce each other when passing from white through gray and to black, showing a so-called gray line. Note that in FIGS. 20A through 20D, the horizontal axis corresponds to the colors to be reproduced. The farther to the left on the horizontal axis, the closer to white, and the farther to the right, the closer to black. The vertical axis corresponds to the output signal values (0 through 255) of each ink.

It can be seen from FIGS. 20A through 20D that, the cyan, magenta and yellow inks are used on the respective main color lines, which are the cyan line, magenta line, and yellow line, and also on the gray line, meaning that each of these colors are used on two lines. On the other hand, gray ink is achromatic, and accordingly is broadly used in all lines. That is to say, the probability that gray will be used at the same time as any of cyan, magenta, and yellow ink is high. In other words, the number of colors reproduced using gray ink will be greater than any of the number of colors reproduced using cyan ink, the number of colors reproduced using magenta ink, and the number of colors reproduced using yellow ink.

In light of the above, the gray ink that is most often used along with ink of other colors is set to have a different driving order out of the multiple color inks in the present embodiment, so that the ink landing positions are different from ink of the other colors. This enables efficient covering of the paper over broad color regions, and also aids in improvement of graininess.

Recorded Image According to Present Embodiment

As described above, recording data is generated in the present embodiment using the dot arrangement patterns illustrated in FIGS. 6B through 6E and the mask patterns MP1 through MP4 illustrated in FIGS. 17A through 17D. Further, the recording element rows discharging cyan ink and magenta ink perform time-division driving following the driving order illustrated in FIG. 18A for both forward scanning and backward scanning, while the recording element row discharging gray ink performs time-division driving following the driving order illustrated in FIG. 19A. Accordingly, recording with discharge position deviation among reciprocal scans when recording a high-concentration image can be suppressed even when using multiple color inks.

First, description will be made regarding the positions of dots formed by cyan ink, in a case where gradation data having gradation level of level 4 at all pixels of a pixel group 600 dpi×600 dpi is input as gradation data C3. FIGS. 21A through 21E are diagrams illustrating images formed by cyan ink in a case where gradation data is input where the gradation level is level 4.

In a case where the gradation value for gradation data is level 4 in all pixel groups in the unit region 211 in FIG. 8, image data where the pixel value for all pixels in the 600 dpi×1200 dpi arrangement is "2" will be generated, as can be understood from the dot arrangement pattern illustrated in FIG. 6E. Accordingly, cyan ink is discharged to pixel regions corresponding to pixels allocated code values "1" and "2" in the mask patterns MP1 through MP4 in FIGS. 17A through 17F. That is to say, cyan ink is discharged to pixel region corresponding to the gray pixels and black pixels in FIG. 17A in the first scan, in FIG. 17B in the second scan, in FIG. 17C in the third scan, and in FIG. 17D in the fourth scan.

Of these the first and third scans are forward scans, and the second and fourth scans are backward scans, so the pixels to which cyan ink is discharged in the forward scans are the gray pixels and black pixels in FIG. 17E, and the pixels to which cyan ink is discharged in the backward scans are the gray pixels and black pixels in FIG. 17F. That is to say, cyan ink is discharged to all pixels in the forward scans and the backward scans.

Figure 21A:
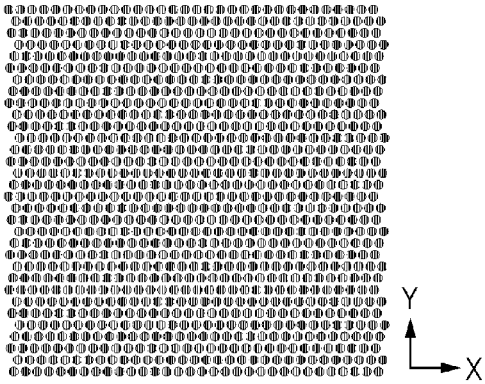
FIGS. 21A through 21E are schematic diagrams illustrating an image recorded by ink of one color in an embodiment.
Figure 21B:
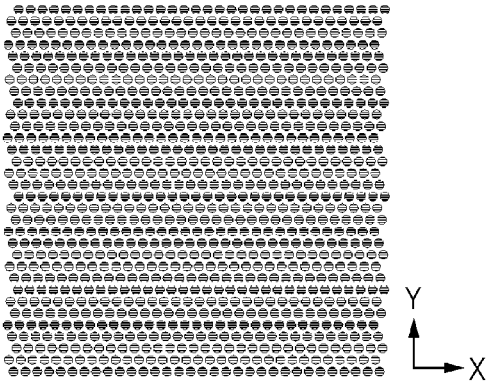
Figure 21C:
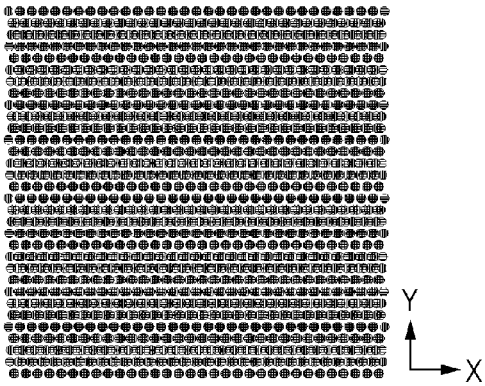
Figure 21D:
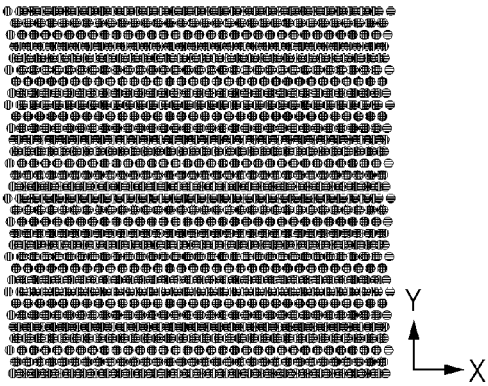

By performing time-division driving in the driving order illustrated in FIG. 18A for both forward scanning and backward scanning, cyan ink will be discharged and dots formed at the positions illustrated in FIG. 21A for the forward scans and in FIG. 21B for the backward scans, if there is no deviation between reciprocal scans. FIG. 21C illustrates a dot arrangement where the dot arrangements in FIGS. 21A and 21B have been overlaid with no positional deviation. FIG. 21D illustrates a case where the dot arrangements have been overlaid with positional deviation of 21.2 μm (equivalent to 1200 dpi) toward the downstream side in the X direction in the backward scan, and FIG. 21E illustrates a case where the dot arrangements have been overlaid with positional deviation of 42.3 μm (equivalent to 600 dpi) toward the downstream side in the X direction in the backward scan.

It can be seen in FIG. 21C that, with regard to the rows extending in the X direction, there are rows where dots from the forward scans and dots from the backward scans are recorded almost completely overlapped, rows partly overlapped, and rows recorded without hardly any overlapping, these various states being intermingled. In FIG. 21D, dots in rows overlapped to begin with newly emerge, while dots in rows that were deviated without overlapping to begin with newly overlap, thereby canceling out variation in concentration. This is also true in FIG. 21E, in that dots in rows overlapped to begin with newly emerge, while dots in rows that were deviated without overlapping to begin with newly overlap, thereby canceling out variation in concentration.

Figure 21E:
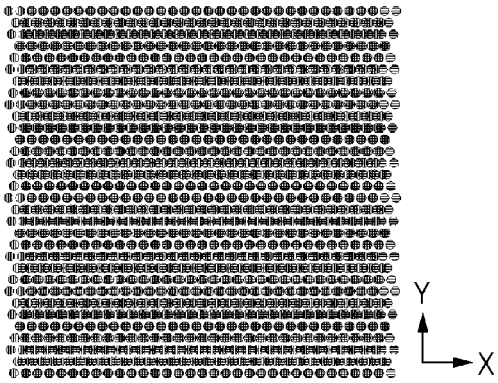

Thus, when viewed as an overall image, there is hardly any variation in concentration occurring in comparison with the case in FIG. 21C where there is no deviation between reciprocal scans, regardless of whether the amount deviation between reciprocal scans is 21.2 μm upstream in the X direction, illustrated in FIG. 21D, or the amount deviation between reciprocal scans is 42.3 μm upstream in the X direction, illustrated in FIG. 21E. Accordingly, it can be seen from FIGS. 21A through 21E that recording can be performed with suppressed discharge position deviation between reciprocal scans when recording images with relatively high concentration where two dots are recorded in one pixel region, according to the mask patterns and driving orders according to the present embodiment.

Figure 22A:
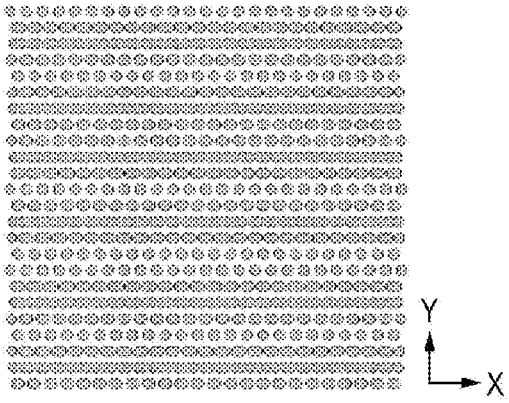
FIGS. 22A through 22D are schematic diagrams illustrating an image recorded by ink of multiple colors in an embodiment.
Figure 22B:
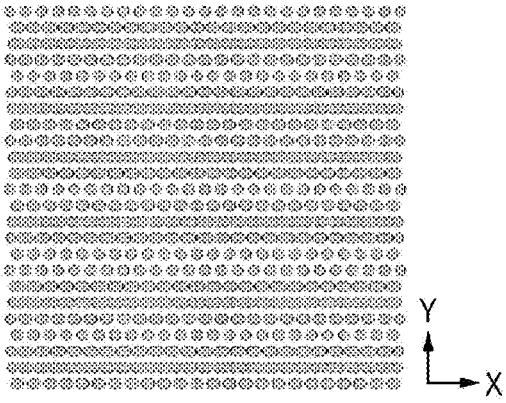
Figure 22C:
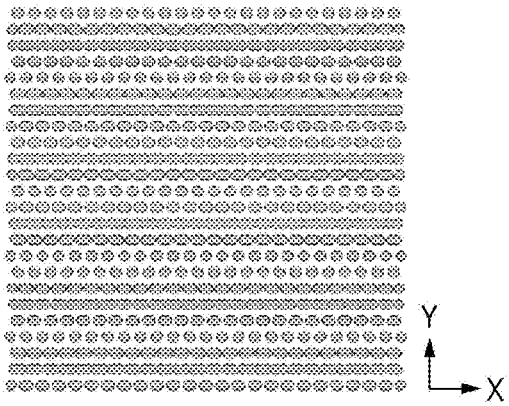
Figure 22D:
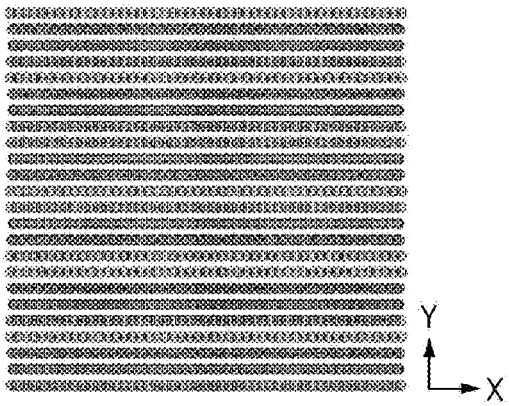

Next, the positions of dots formed in a case of changing the driving order of driving blocks in time-division driving among multiple color inks will be described. FIGS. 22A through 22D are diagrams illustrating dot arrangements formed by generating recording data using the dot arrangement patterns illustrated in FIGS. 6B through 6E and the mask patterns illustrated in FIGS. 17A through 17D, in the driving order illustrated in FIG. 18A for both forward scanning and backward scanning of cyan ink and magenta ink, and the driving order of time-division driving illustrated in FIG. 19A for both forward scanning and backward scanning of gray ink. FIG. 22A illustrates dot arrangements of cyan ink, FIG. 22B illustrates dot arrangements of magenta ink, and FIG. 22C illustrates dot arrangements of gray ink. Further, note that FIG. 22D illustrates the dots of cyan ink, magenta ink, and gray ink, illustrated in FIGS. 22A, 22B, and 22C, having been overlaid.

Note that FIGS. 22A through 22D only illustrate dots formed by S_Ev out of row S_Ev and row S_Od making up the recording element rows for each of the cyan ink, magenta ink, and gray ink, for the sake of simplicity. The circles with the vertical lines inside in FIGS. 22A through 22D represent cyan ink and magenta ink dots, and the circles with horizontal lines inside represent gray ink dots. FIGS. 22A through 22D illustrate dots formed in case where gradation data having gradation level of level 4 is input to all pixels of a 600 dpi×1200 dpi arrangement.

As described above, the same dot arrangement patterns and mask patterns are applied to each of the cyan ink, magenta ink, and gray ink in the present embodiment. Accordingly, the recording data C5 corresponding to the cyan ink, the recording data M5 corresponding to the magenta ink, and the recording data G5 corresponding to the gray ink, are set to discharge ink to the same pixels.

Further, the recording element row for discharging cyan ink and the recording element row for discharging magenta ink both perform time-division driving in the driving order illustrated in FIG. 18A. Accordingly, the arrangement of cyan dots and magenta dots is the same, which can be seen in FIGS. 22A and 22B.

On the other hand, the recording element row for discharging gray ink performs the time-division driving in the driving order illustrated in FIG. 19A, which is different from that of the recording element row for the cyan ink and magenta ink. Accordingly, the arrangement of gray ink dots illustrated in FIG. 22C is different from the arrangement of cyan and magenta ink dots illustrated in FIGS. 22A and 22B.

Accordingly, the dot arrangement where cyan, magenta, and gray have been overlaid can sufficiently cover the surface of the recording medium, which can be seen in FIG. 22D. This is because the dot arrangement of gray ink dots is dense where the dot arrangement of cyan ink and magenta ink dots is sparse, and the dot arrangement of gray ink dots is sparse where the dot arrangement of cyan ink and magenta ink dots is dense. Thus, a situation where the dot arrangements of all inks are superimposed can be avoided, and accordingly graininess can be suppressed.

As described above, discharge position deviation among reciprocal scans of inks of each color can be suitably suppressed by the present embodiment. Further, graininess due to dot arrangements of multiple color inks being superimposed can be suppressed by changing the driving order of gray ink, which is often used at the same time as other colors, from the driving order of inks of other colors.

Comparative Example

Next, a comparative example of the present embodiment will be described in detail. In the comparative example, the dot arrangement patterns illustrated in FIGS. 6B through 6E and the mask patterns illustrated in FIG. 17A through 17D, that were used in the first embodiment, are used to generate recording data. The driving order of the recording element rows discharging the cyan ink and magenta ink is the driving order illustrated in FIG. 18A, the same as in the first embodiment.

Unlike in the first embodiment, the driving order of the recording element row discharging the gray ink is the same as the driving order of the recording element rows discharging the cyan ink and magenta ink. That is to say, the driving order of the recording element row discharging the gray ink also is the driving order illustrated in FIG. 18A.

Figure 23A:
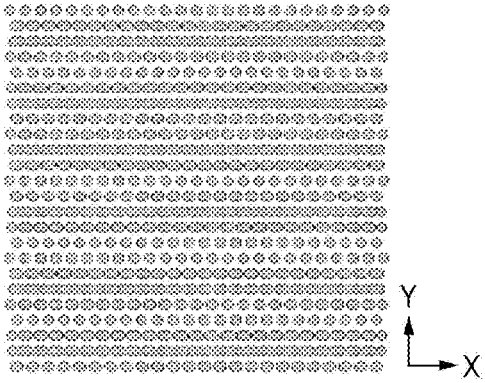
FIGS. 23A through 23D are schematic diagrams illustrating an image recorded by ink of multiple colors in a comparative example.
Figure 23B:
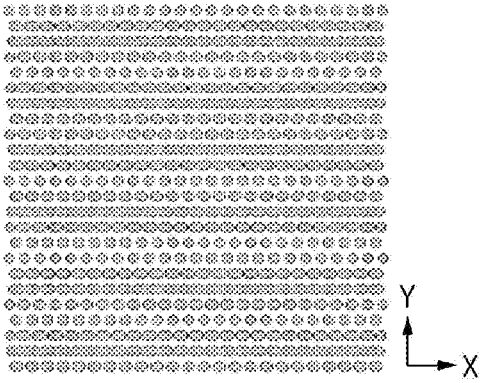
Figure 23C:
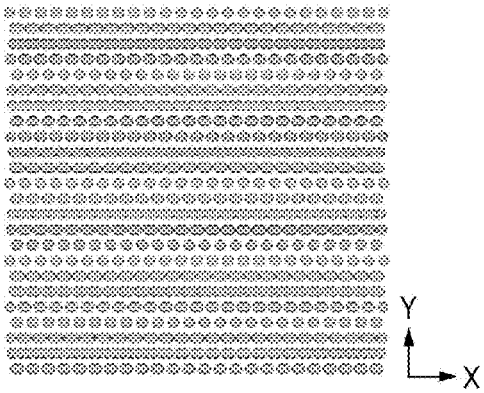
Figure 23D:
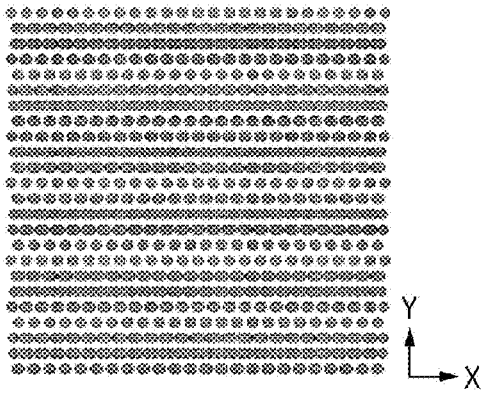

FIGS. 23A through 23D are diagrams illustrating dot arrangements formed by generating recording data using the dot arrangement patterns illustrated in FIGS. 6B through 6E and the mask patterns illustrated in FIGS. 17A through 17D, in the driving order illustrated in FIG. 18A for both forward scanning and backward scanning of each of cyan ink, magenta ink, and gray ink. FIG. 23A illustrates dot arrangements of cyan ink, FIG. 23B illustrates dot arrangements of magenta ink, and FIG. 23C illustrates dot arrangements of gray ink. Further, note that FIG. 23D illustrates the dots of cyan ink, magenta ink, and gray ink, illustrated in FIGS. 23A, 23B, and 23C, having been overlaid.

Note that FIGS. 23A through 23D only illustrate dots formed by S_Ev out of row S_Ev and row S_Od making up the recording element rows for each of the cyan ink, magenta ink, and gray ink, for the sake of simplicity, in the same way as in FIGS. 22A through 22D. The circles with the vertical lines inside in FIGS. 23A through 23D represent cyan ink and magenta ink dots, and the circles with horizontal lines inside represent gray ink dots. FIGS. 23A through 23D illustrate dots formed in case where gradation data having gradation level of level 4 is input to all pixels of a 600 dpi×1200 dpi arrangement.

As described above, the same dot arrangement patterns and mask patterns are applied to each of the cyan ink, magenta ink, and gray ink in the comparative example. Accordingly, the recording data C5 corresponding to the cyan ink, the recording data M5 corresponding to the magenta ink, and the recording data G5 corresponding to the gray ink, are set to discharge ink to the same pixels.

Further, the recording element row for discharging cyan ink and the recording element row for discharging magenta ink both perform time-division driving in the driving order illustrated in FIG. 18A. Accordingly, the arrangement of cyan dots and magenta dots is the same, which can be seen in FIGS. 23A and 23B. Now, the dot arrangement patterns, mask patterns, and driving order in time-division driving control are all the same as in the first embodiment, so the dot arrangements shown in FIGS. 23A and 23B are the same as the dot arrangements shown in FIGS. 22A and 22B.

Unlike the first embodiment, the recording element row for discharging gray ink performs the time-division driving in the driving order illustrated in FIG. 18A. Accordingly, the arrangement of gray ink dots illustrated in FIG. 23C is no different from the arrangement of cyan and magenta ink dots illustrated in FIGS. 23A and 23B.

Accordingly, when the cyan, magenta, and gray are overlaid, the arrangements of all of the dots are superimposed on each other, as illustrated in FIG. 23D. As a result, the comparative example cannot sufficiently cover the surface of the recording medium with dots. Consequently, images with conspicuous graininess may be recorded. Comparing the dot arrangement of multiple colors of ink recorded by the first embodiment illustrated in FIG. 22D with the dot arrangement of multiple colors of ink recorded by the comparative example in FIG. 23D clearly shows that graininess can be suppressed by applying the first embodiment.

Modification of First Embodiment

Although description has been made in the first embodiment regarding an arrangement where the recording element row discharging cyan ink performs time-division driving according to the same driving order illustrated in FIG. 18A for both forward scanning and backward scanning, but other arrangements may be made as well. It is sufficient for the driving order of one recording element row in the first embodiment to be such that the driving order of driving blocks in the backward scan to be the opposite order from the driving order of the driving blocks in the forward scan when scanning reciprocally.

The driving order in the first embodiment preferably is such that the driving order of driving blocks in the backward scan is the opposite order from an offset order of the driving order of the driving blocks in the forward scan when scanning reciprocally. This point will be described below in detail. In a case where the scanning order for forward scanning is the order illustrated in FIG. 24A, and the scanning order for backward scanning is the order illustrated in FIG. 24B, the driving order in FIG. 24B is the opposite order from an offset order of the driving order in FIG. 24A.

The driving order illustrated in FIG. 24A is the driving order of driving block No. 1, driving block No. 2, driving block No. 3, driving block No. 4, driving block No. 5, driving block No. 6, driving block No. 7, driving block No. 8, driving block No. 9, driving block No. 10, driving block No. 11, driving block No. 12, driving block No. 13, driving block No. 14, driving block No. 15, and driving block No. 16.

An example of an offset order of the driving order illustrated in FIG. 24A is the driving order of driving block No. 2, driving block No. 3, driving block No. 4, driving block No. 5, driving block No. 6, driving block No. 7, driving block No. 8, driving block No. 9, driving block No. 10, driving block No. 11, driving block No. 12, driving block No. 13, driving block No. 14, driving block No. 15, driving block No. 16, and driving block No. 1. In this order, the driving block No. 2 through driving block No. 16 have been shifted up one each, and the driving block No. 1 brought to the last. In other words, this order is an order where the driving order in FIG. 24A has been offset forward by one.

Another example of an offset order of the driving order illustrated in FIG. 24A is the driving order of driving block No. 3, driving block No. 4, driving block No. 5, driving block No. 6, driving block No. 7, driving block No. 8, driving block No. 9, driving block No. 10, driving block No. 11, driving block No. 12, driving block No. 13, driving block No. 14, driving block No. 15, driving block No. 16, driving block No. 1, and driving block No. 2. In this order, the driving block No. 3 through driving block No. 16 have been shifted up two each, and the driving block No. 1 and driving block No. 2 have been brought to the last. In other words, this order is an order where the driving order in FIG. 24A has been offset forward by two.

Along the same line of thought, the driving order of driving block No. 9, driving block No. 10, driving block No. 11, driving block No. 12, driving block No. 13, driving block No. 14, driving block No. 15, driving block No. 16, driving block No. 1, driving block No. 2, driving block No. 3, driving block No. 4, driving block No. 5, driving block No. 6, driving block No. 7, and driving block No. 8, also is an offset order of the driving order illustrated in FIG. 24A, offset by eight. Note that the driving order illustrated in FIG. 24B is the opposite order of this order. Thus, it can be seen that the driving order illustrated in FIG. 24B is the opposite order of an offset order of the driving order illustrated in FIG. 24A.

FIG. 24C is a schematic diagram illustrating the way in which dots are formed in a case of driving recording element No. 1 through No. 16 while scanning in the forward direction following the driving order shown in FIG. 24A. FIG. 24D is a schematic diagram illustrating the way in which dots are formed in a case of driving recording element No. 1 through No. 16 while scanning in the backward direction following the driving order shown in FIG. 24B. In such an arrangement where the driving order for backward scanning is the opposite order of an offset order of the driving order for forward scanning, the ink landing positions from the driving blocks differ in the forward scan and backward scan, but are discharged in a parallel positional relationship.

Figure 25A:
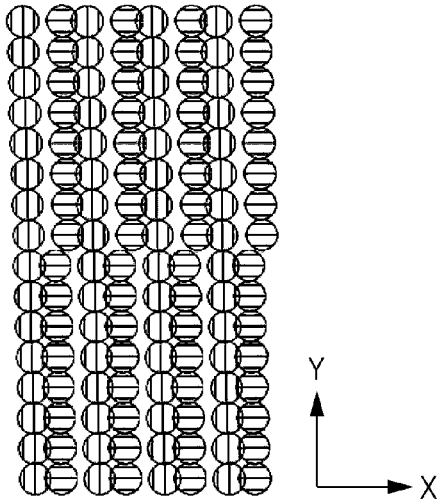
FIGS. 25A through 25D are diagrams for describing the degree of ink discharge position deviation among scans.
Figure 25B:
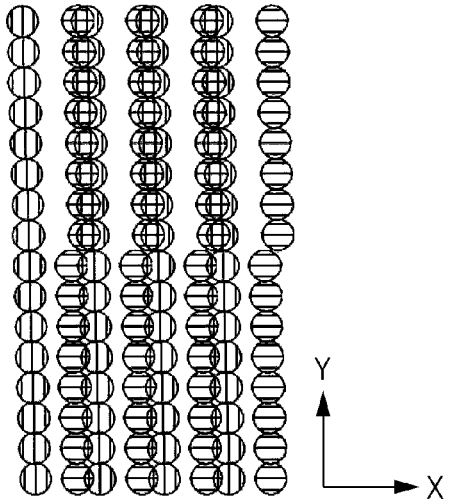
Figure 25C:
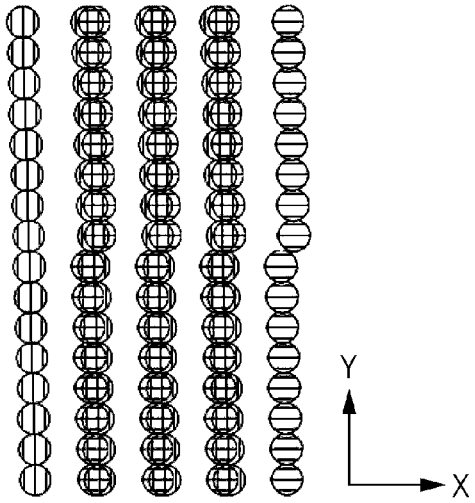
Figure 25D:
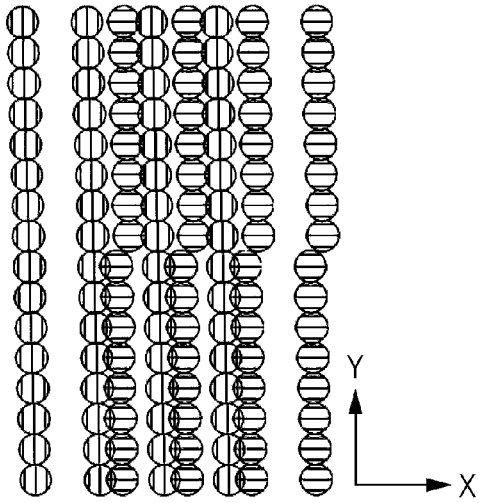

FIGS. 25A through 25D are diagrams schematically illustrating images formed when recording using the recording data illustrated in FIGS. 12A1 and 12A2 for recording data in both forward scanning and backward scanning, at the driving order illustrated in FIG. 24A for forward scanning and the driving order illustrated in FIG. 24B for backward scanning. FIG. 25A schematically illustrate an image recorded in a case where there is no deviation between the forward scan and the backward scan, FIG. 25B illustrates an image recorded in a case where there is deviation of ½ dot in the X direction between the forward scan and the backward scan, FIG. 25C illustrates an image recorded in a case where there is deviation of 1 dot in the X direction between the forward scan and the backward scan, and FIG. 25D illustrates an image recorded in a case where there is deviation of 2 dots in the X direction between the forward scan and the backward scan. In all of the illustrations, the circles with vertical lines inside represent dots formed in the forward scan, and the circles with horizontal lines inside represent dots formed in the backward scan.

Comparing FIGS. 25A through 25D with FIGS. 14A through 14D and FIGS. 16A through 16D, the images in FIGS. 25A through 25D have been improved over the images in FIGS. 14A through 14D in that the overlapping and missing dots are not as conspicuous, although the improvement is not as marked as in FIGS. 16A through 16D. As described above, FIGS. 14A through 14D are images where the driving order of the backward scan is the opposite order to the driving order in the forward scan, while FIGS. 16A through 16D are images where the driving order of the backward scan is the same order as the driving order of the forward scan. Accordingly, discharge position deviation between reciprocal scans can be suppressed more in a case where the driving order of the backward scan is the opposite order as to the driving order of the forward scan when the order is offset, as compared to a case where the driving order of the backward scan is the same order as the driving order of the forward scan. On the other hand, it can be seen from FIGS. 16A through 16D that a case where the driving order of the backward scan is the same order as the driving order of the forward scan is more preferable.

In light of the above points, the driving order at the time of backward scanning needs to be different from the opposite order to the driving order at the time of forward scanning in the present embodiment, at each of the recording element rows. In doing so, the driving order at the time of backward scanning preferably is different from the opposite order to an offset order of the driving order at the time of forward scanning. More preferably, the order is the same as the driving order at the time of forward scanning.

Although an arrangement has been described in the first embodiment where the driving order of the recording element row discharging the gray ink is offset from the driving order of the recording element rows discharging the cyan ink and magenta ink by eight, but other arrangements may be made. Specifically, it is sufficient for the driving order of the recording element row discharging the gray ink in the first embodiment to be different from the driving order of the recording element rows discharging the cyan ink and magenta ink.

FIG. 26A is a diagram illustrating another example of the driving order of recording element row discharging gray ink, that is executable in the first embodiment. FIG. 26B is a schematic diagram illustrating the way in which dots are formed in a case of driving recording element No. 1 through No. 16 while scanning in the forward direction scan following the driving order shown in FIG. 26A. FIG. 26C is a schematic diagram illustrating the way in which dots are formed in a case of driving recording element No. 1 through No. 16 while scanning in the backward direction scan following the driving order shown in FIG. 26A.

An example will be described here where time-division driving is performed in the driving order of driving block No. 9, driving block No. 4, driving block No. 15, driving block No. 10, driving block No. 5, driving block No. 16, driving block No. 11, driving block No. 6, driving block No. 1, driving block No. 12, driving block No. 7, driving block No. 2, driving block No. 13, driving block No. 8, driving block No. 3, and driving block No. 14, as illustrated in FIG. 26A, for the recording element rows discharging gray ink. Comparing FIG. 18A and FIG. 26A shows that the driving order illustrated in FIG. 26A is not an order where the driving order illustrated in FIG. 18A has been offset, but rather is an order with no correlation in particular.

In a case of performing time-division driving of the recording elements No. 1 through No. 16 following the driving order illustrated in FIG. 26A, the dot formed from recording element No. 9 driven the first is situated farthest upstream in the X direction as illustrated in FIG. 26B, the dots formed in the order of recording element Nos. 4, 15, 10, 5, 16, 11, 6, 1, 12, 7, 2, 13, 8, and 3, are situated deviated from the upstream side in the X direction toward the downstream side, and the dot formed by the recording element No. 14 driven last is situated farthest downstream in the X direction.

On the other hand, in the backward direction scan, the dot formed from recording element No. 9 driven the first is situated farthest downstream in the X direction as illustrated in FIG. 26C, the dots formed in the order of recording element Nos. 4, 15, 10, 5, 16, 11, 6, 1, 12, 7, 2, 13, 8, and 3, are situated deviated from the downstream side in the X direction toward the upstream side, and the dot formed by the recording element No. 14 driven last is situated farthest upstream in the X direction.

Figure 27A:
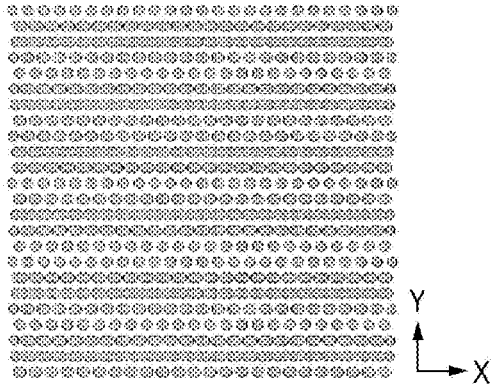
FIGS. 27A through 27D are schematic diagrams illustrating an image recorded by ink of multiple colors in an embodiment.
Figure 27B:
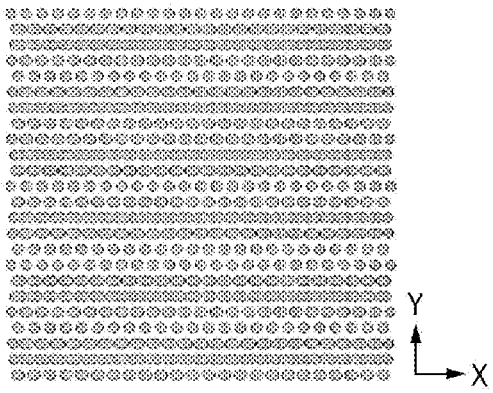
Figure 27C:
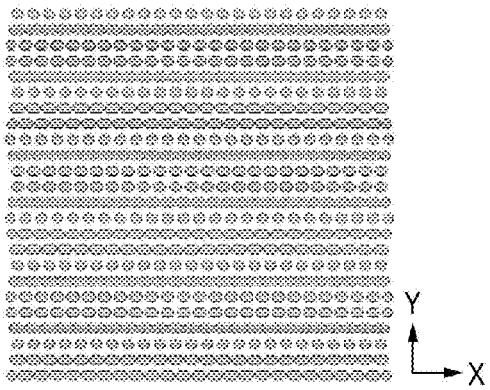
Figure 27D:
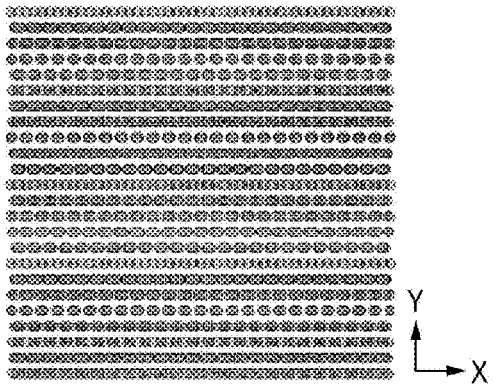

FIGS. 27A through 27D are diagrams illustrating dot arrangements formed by generating recording data by time-division driving using the dot arrangement patterns illustrated in FIGS. 6B through 6E and the mask patterns illustrated in FIGS. 17A through 17D, in the driving order illustrated in FIG. 18A for both forward scanning and backward scanning of each of cyan ink and magenta ink, and in the driving order illustrated in FIG. 26A for both forward scanning and backward scanning of gray ink. FIG. 27A illustrates dot arrangements of cyan ink, FIG. 27B illustrates dot arrangements of magenta ink, and FIG. 27C illustrates dot arrangements of gray ink. Further, FIG. 27D illustrates the dots of cyan ink, magenta ink, and gray ink, illustrated in FIGS. 27A, 27B, and 27C, having been overlaid. Other points are the same as in FIGS. 22A through 22D.

As described above, time-division driving is performed with the driving order of the recording element row discharging gray ink having no correlation with the driving order of recording element rows discharging cyan ink and magenta ink. In this case as well, it can be seen by comparing FIG. 27D and FIG. 23D that a wider area on the surface of the recording media can be covered by dot arrangements when overlaying inks of multiple color, as compared with a case of the driving order of gray ink being the same driving order as cyan ink and magenta ink. Accordingly, graininess can be suppressed.

Thus, the driving order of gray ink to suppress graininess when using ink of multiple colors is not restricted to an order where the driving order of cyan ink and magenta ink has been offset, and the order may be an order with no correlation in particular, or the like. That is to say, it is sufficient as long as the driving order of the gray ink is different from the driving order of the cyan ink and magenta ink.

Note however, that it is particularly preferable to have an offset of the driving order of gray ink as to the driving order of cyan ink and magenta ink so as to satisfy K, where K is a natural number satisfying $N/2-1 \leq K \leq N/2+1$, and N represents the number of driving blocks in time-division driving control. The reason for this will be described later in detail.

Figure 28:
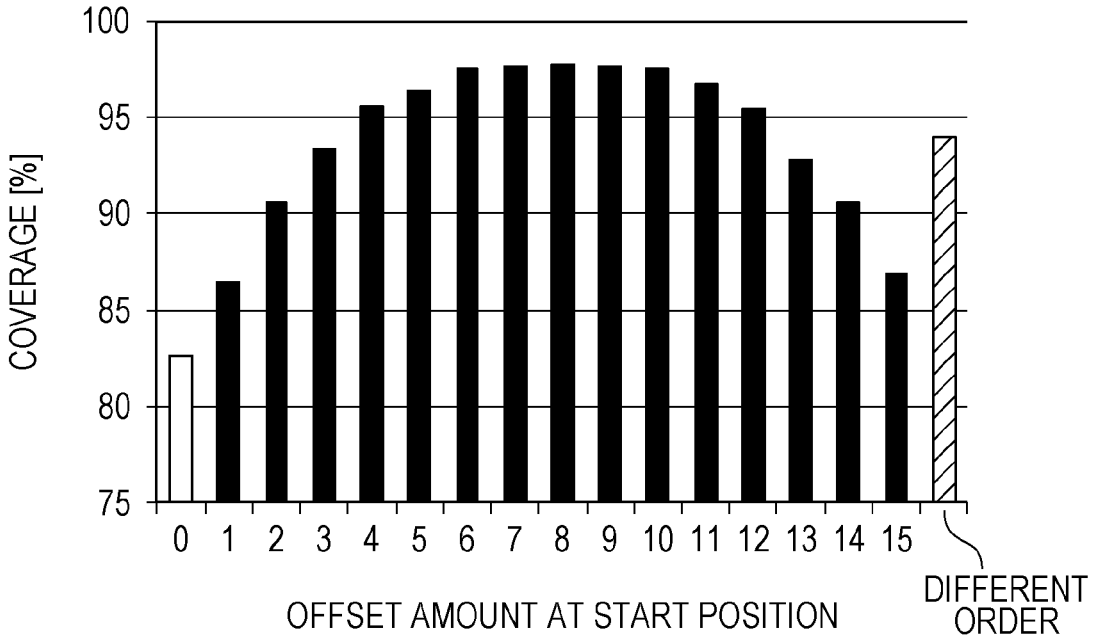
FIG. 28 is a diagram illustrating correlation between offset of driving order and dot coverage.

FIG. 28 is a diagram illustrating the percentage of dots covering the surface of the recording medium (coverage) when performing time-division driving control in a case where the driving order of the cyan ink and magenta ink is the order illustrated in FIG. 18A and the driving order of the gray ink is an order offset forward by different numbers. The coverage of dots when performing time-division driving control using the order illustrated in FIG. 26A for the driving order of the gray ink is denoted by the phrase "different order" in FIG. 28. Also note that FIG. 28 shows the coverage in a case of applying two each of cyan ink, magenta ink, and gray ink, to all pixels.

It can be seen from FIG. 28 that the coverage is higher for cases where the driving order of gray ink is offset as to the driving order of cyan ink and magenta ink, or an order with no particular correlation, as compared to a case where the order is the same (i.e., offset of zero). The coverage is particularly high in cases where the offset amount is 7, 8, or 9.

Now, the number of driving blocks in the first embodiment is 16 (N=16), so N/2−1 is 7, and N/2+1 is 9. That is to say, in the first embodiment, the above K is one of 7, 8, and 9. The reason thereof is thought to be that shifting the driving order of gray ink from the driving order of cyan ink and magenta ink by around 8, which is approximately half of the number of time-division driving divisions, enables the dots of gray ink and the dots of cyan ink and magenta ink formed from all of the driving blocks to be suitably separated.

AS described above, there is a need for the driving order of the gray ink to be a different order from the driving order of the cyan ink and magenta ink in the first embodiment, and preferably is an order offset by K defined in the above inequality expression.

Second Embodiment

In the first embodiment, the mask patterns MP1 through MP4 have been described as being set so that pixels where the code value "1" is allocated in the logical sum pattern MP1+MP3 for forward scanning and that pixels where the code value "1" is allocated in the logical sum pattern MP2+MP4 for backward scanning, as mask patterns, have random white noise properties. Accordingly, the mask patterns MP1 through MP4 used in the first embodiment as described above were set so that of the pixels allocated the code value "1" in the logical sum pattern MP2+MP4, the number of pixels adjacent at both sides in the X direction to a pixel that has been allocated code value "1" in the logical sum pattern MP1+MP3, and the number of pixels not adjacent in the X direction to a pixel that has been allocated code value "1" in the logical sum pattern MP1+MP3, are the same. In the same way, of the pixels allocated the code value "1" in the logical sum pattern MP1+MP3, the number of pixels adjacent at both sides in the X direction to a pixel that has been allocated code value "1" in the logical sum pattern MP2+MP4, and the number of pixels not adjacent in the X direction to a pixel that has been allocated code value "1" in the logical sum pattern MP2+MP4, were also the same.

Conversely, in the present embodiment, mask patterns are used where code values have been set for each pixel, so that of the pixels to which a code value "1" has been allocated in a backward scan logical sum pattern, the number of pixels adjacent at both sides in the X direction to a pixel that has been allocated code value "1" in a forward scan logical sum pattern is larger than the number of pixels not adjacent in the X direction to a pixel that has been allocated code value "1" in the forward scan logical sum pattern. In the same way, in the present embodiment, mask patterns are used where code values have been set for each pixel, so that of the pixels to which a code value "1" has been allocated in a forward scan logical sum pattern, the number of pixels adjacent at both sides in the X direction to a pixel that has been allocated code value "1" in a backward scan logical sum pattern is larger than the number of pixels not adjacent in the X direction to a pixel that has been allocated code value "1" in the backward scan logical sum pattern. Note that portions which are the same as in the above-described first embodiment will be omitted from description.

Deterioration in image quality due to deviation in the X direction between reciprocal scans was suppressed in the first embodiment by driving order in the backward scan being a different order from the opposite order to the driving order of the forward scan, as described with reference to FIGS. 12A1 through 16D. However, it can be seen by comparing FIGS. 15A through 15D with FIGS. 16A through 16D that, when recording a relatively low-concentration image such as an image where one dot each is formed at each pixel, the degree of deterioration in image quality due to deviation in the X direction between reciprocal scans also differs depending on the recording data, not just the driving order.

In a case of generating recording data so that the dots recorded in the forward scan and the dots recorded in the backward scan do not alternate in the X direction, as illustrated in FIGS. 15A through 15D, deterioration in image quality can be suitably suppressed in a case where the amount of deviation in the X direction between reciprocal scans is small. However, it can be seen from FIG. 15D that in a case where the amount of deviation in the X direction between reciprocal scans is large, missing and overlapping dots may be marked even if the driving orders are not opposite to each other. Conversely, generating recording data so that the dots recorded in the forward scan and the dots recorded in the backward scan alternate in the X direction can reduce missing and overlapping dots even in a case where deviation in the X direction between reciprocal scans is large, as illustrated in FIG. 16D.

In light of the above points, recording data is generated in the present embodiment so that the dots recorded in the forward scan and the dots recorded in the backward scan alternate when recording low-concentration images, to suppress deterioration in image quality due to deviation in the X direction between reciprocal scans when recording low-concentration images. With regard to low-concentration image data, such as image data where the pixel value is "1", for example, dots are formed only at pixels in the mask pattern where the code value "1" is set, as illustrated in the decoding table in FIG. 10. The reason is that code value "1" is the code value out of the code values "0", "1", and "2" that permits the greatest number of times of ink discharge. Accordingly, in order to alternately generate dots recorded in each of the forward scan and the backward scan when recording low-concentration images, a mask pattern can be used to alternately generate pixels in the X direction where the code value "1" has been set in a logical sum pattern for forward scanning and a logical sum pattern for backward scanning.

Figure 29A:
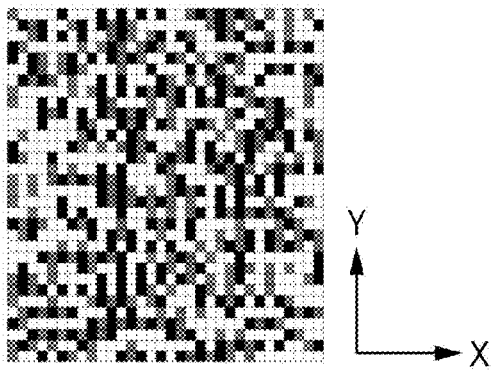
FIGS. 29A through 29F are diagrams illustrating mask patterns applied in an embodiment.
Figure 29B:
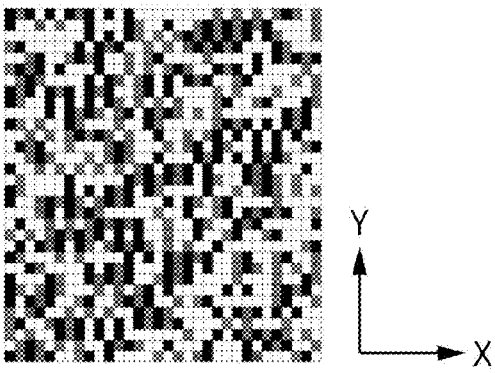
Figure 29C:
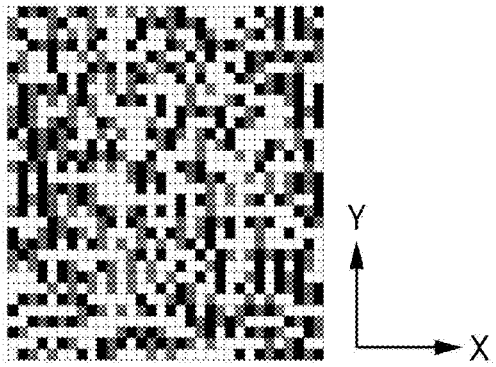
Figure 29D:
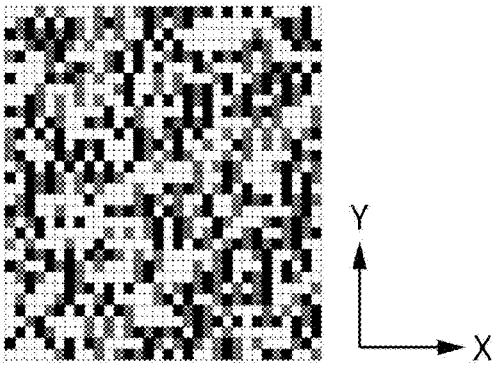
Figure 29E:
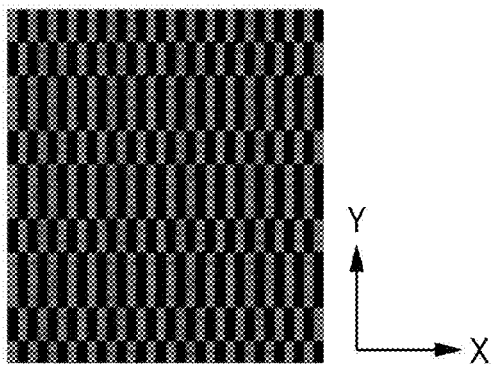
Figure 29F:
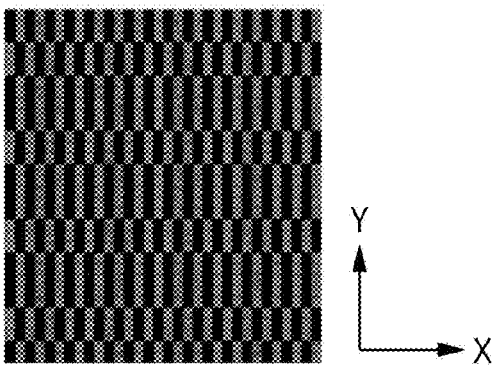

FIGS. 29A through 29F illustrate mask patterns used in the present embodiment. Note that FIG. 29A illustrates a mask pattern MP1' corresponding to the first scan, FIG. 29B illustrates a mask pattern MP2' corresponding to the second scan, FIG. 29C illustrates a mask pattern MP3' corresponding to the third scan, and FIG. 29D illustrates a mask pattern MP4' corresponding to the fourth scan. FIG. 29E illustrates a logical sum pattern MP1'+MP3' obtained as the logical sum of the number of times permitted for ink discharge set in the mask pattern MP1' corresponding to the first scan in FIG. 29A and the mask pattern MP3' corresponding to the third scan in FIG. 29C. Further, FIG. 29F illustrates a logical sum pattern MP2'+MP4' obtained as the logical sum of the number of times permitted for ink discharge set in the mask pattern MP2' corresponding to the second scan in FIG. 29B and the mask pattern MP4' corresponding to the fourth scan in FIG. 29D. In FIGS. 29A through 29F, the white pixels indicate pixels to which the code value "0" has been allocated, the gray pixels indicate pixels to which the code value "1" has been allocated, and the black pixels indicate pixels to which the code value "2" has been allocated.

The mask patterns MP1' through MP4' illustrated in FIGS. 29A through 29D differ from the mask patterns MP1 through MP4 illustrated in FIGS. 17A through 17D in that pixels allocated code value "1" in the logical sum pattern MP1'+MP3' illustrated in FIG. 29E and pixels allocated code value "1" in the logical sum pattern MP2'+MP4' illustrated in FIG. 29F are set to be generated alternately in the X direction. Other than the above-described setting conditions, the mask patterns MP1' through MP4' illustrated in FIGS. 29A through 29D are the same as the mask patterns MP1 through MP4 illustrated in FIGS. 17A through 17D.

To describe the above settings in detail, the logical sum pattern MP1'+MP3' according to the present embodiment illustrated in FIG. 29E has the code value "1" allocated to 512 of the 1024 pixels therein, and all of these, i.e., 512 pixels to which the code "1" has been assigned are adjacent at both sides in the X direction to a pixel that has been allocated code value "1" in the logical sum pattern MP2'+MP4' illustrated in FIG. 29F. On the other hand, of the 512 pixels to which the code value "1" has been allocated in the logical sum pattern MP1+MP3 in FIG. 29E, there are no pixels to which the code "1" has been assigned that are adjacent in the X direction to a pixel that has been allocated code value "1" in the logical sum pattern MP2+MP4 illustrated in FIG. 29F.

For example, in the row at the edge portion of the logical sum pattern MP1'+MP3' illustrated in FIG. 29E farthest downstream in the Y direction (the top in FIG. 29E), the code value "1" is allocated to the 1st, 3rd, 5th, 7th, 9th, 11th, 13th, 15th, 17th, 19th, 21st, 23rd, 25th, 27th, 29th, and 31st pixels from the upstream side in the X direction (left side in FIG. 29E). On the other hand, in the row at the edge portion of the logical sum pattern MP2'+MP4' in FIG. 29F farthest downstream in the Y direction (the top in FIG. 29F), the code value "1" is allocated to the 2nd, 4th, 6th, 8th, 10th, 12th, 14th, 16th, 18th, 20th, 22nd, 24th, 26th, 28th, 30th, and 32nd pixels from the upstream side in the X direction (left side in FIG. 29F).

Now, of the row at the edge portion of the logical sum pattern MP1'+MP3' illustrated in FIG. 29E, farthest downstream in the Y direction (the top in FIG. 29E), the 3rd pixel from the upstream side in the X direction (left side in FIG. 29E) is assigned code value "1", and code value "1" has been allocated in the logical sum pattern MP2'+MP4' illustrated in FIG. 29F to the 2nd and 4th pixels from the upstream side in the X direction (left side in FIG. 29F) adjacent thereto. That is to say, of the row at the edge portion of the logical sum pattern MP1'+MP3' illustrated in FIG. 29E, farthest downstream in the Y direction (the top in FIG. 29E), the 3rd pixel from the upstream side in the X direction (left side in FIG. 29E) is allocated code value "1", and also the pixels adjacent at both sides in the X direction in the logical sum pattern MP2'+MP4' illustrated in FIG. 29F are allocated code value "1".

Here, a pixel at the edge portion upstream in the X direction (left side in the FIGS. 29A through 29F) and a pixel at the edge portion downstream in the X direction (right side in FIGS. 29A through 29F) that are in the same row, are considered to be adjacent. The reason for this is that the mask patterns MP1' through MP4' illustrated in FIGS. 29A through 29D indicate units of repetition of the mask pattern, and these mask patterns actually are used in repetition sequentially in the X direction. Accordingly, when actually applying to image data, situated to the right side of a region within binary data equivalent to the pixel at the edge portion downstream in the X direction (right side in FIGS. 29A through 29F) of a certain mask pattern is binary data equivalent to the pixel at the edge portion upstream in the X direction (left side in FIGS. 29A through 29F) of the next mask pattern.

Thus, regarding a pixel allocated code value "1" that is the 1st pixel upstream in the X direction (left side in FIG. 29E) in a row at the edge downstream in the Y direction (top in FIG. 29E) within the logical sum pattern MP1'+MP3' illustrated in FIG. 29E for example, code value "1" is allocated to the 32nd and 2nd pixels adjacent at both sides in the X direction, upstream in the X direction (left side in FIG. 29F) in a row at the edge downstream in the Y direction (top in FIG. 29F) within the logical sum pattern MP2'+MP4' illustrated in FIG. 29F.

Also, the logical sum pattern MP2'+MP4' according to the present embodiment illustrated in FIG. 29F has the code value "1" allocated to 512 of the 1024 pixels therein, and all of these, i.e., 512 pixels to which the code "1" has been assigned are adjacent at both sides in the X direction to a pixel that has been allocated code value "1" in the logical sum pattern MP1'+MP3' illustrated in FIG. 29E. On the other hand, of the 512 pixels to which the code value "1" has been allocated in the logical sum pattern MP2'+MP4' illustrated in FIG. 29F, there are no pixels to which the code "1" has been assigned that are adjacent in the X direction to a pixel that has been allocated code value "1" in the logical sum pattern MP1'+MP3' illustrated in FIG. 29E.

Figure 30A:
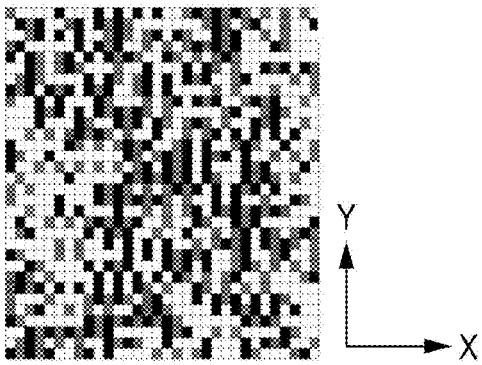
FIGS. 30A through 30F are diagrams illustrating mask patterns applied in an embodiment.
Figure 30B:
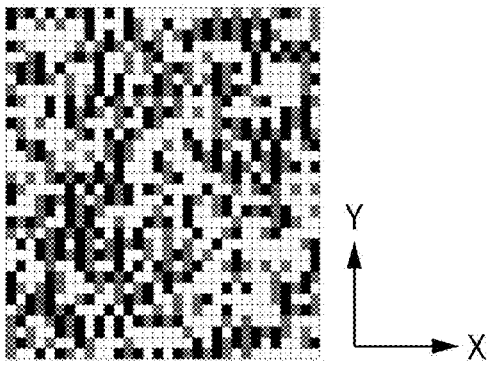
Figure 30C:
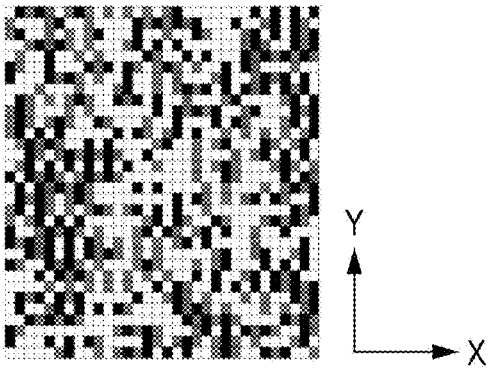
Figure 30D:
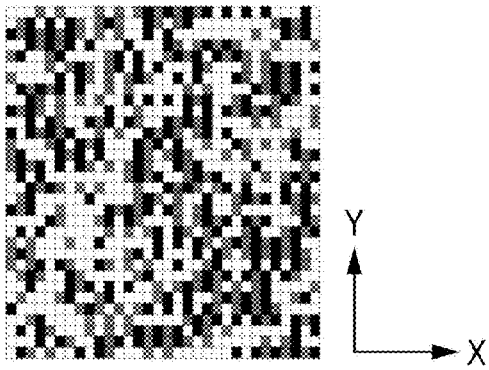
Figure 30E:
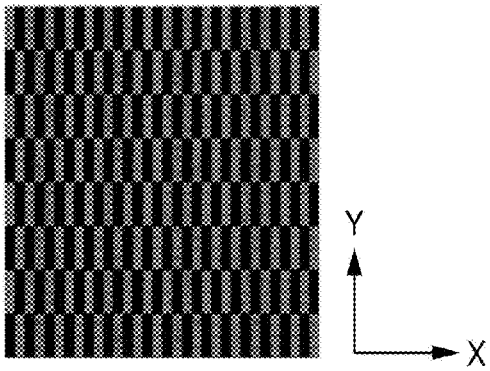
Figure 30F:
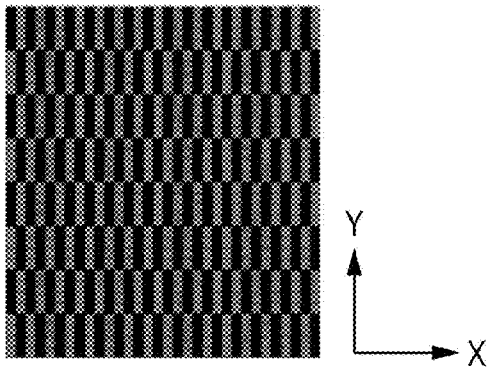

FIGS. 30A through 30F are diagrams illustrating other mask patterns that can be applied in the present embodiment. Note that FIG. 30A illustrates a mask pattern MP1" corresponding to the first scan, FIG. 30B illustrates a mask pattern MP2" corresponding to the second scan, FIG. 30C illustrates a mask pattern MP3" corresponding to the third scan, and FIG. 30D illustrates a mask pattern MP4" corresponding to the fourth scan. Also, FIG. 30E illustrates a logical sum mask pattern MP1"+MP3" obtained as the logical sum of the number of times of permitted discharge of ink stipulated in the mask pattern MP1" corresponding to the first scan in FIG. 30A and the mask pattern MP3" corresponding to the third scan in FIG. 30C. Further, FIG. 30F illustrates a logical sum pattern MP2"+MP4" obtained as the logical sum of the number of times of permitted discharge of ink stipulated in the mask pattern MP2" corresponding to the second scan in FIG. 30B and the mask pattern MP4" corresponding to the fourth scan in FIG. 30D.

Regarding the mask patterns MP1" through MP4" illustrated in FIGS. 30A through 30D, pixels allocated code value "1" in the logical sum pattern MP1"+MP3" illustrated in FIG. 30E and pixels allocated code value "1" in the logical sum pattern MP2"+MP4" illustrated in FIG. 30F are set to alternate in the X direction, in the same way as in the mask patterns MP1' through MP4' illustrated in FIGS. 29A through 29D. In the present embodiment, recording data is generated using mask patterns such as illustrated in FIGS. 29A through 29D and FIGS. 30A through 30D, i.e., logical sum patterns, where pixels allocated code value "1" alternate in the X direction.

Recorded Image According to Present Embodiment

Recording data is generated in the present embodiment using the dot arrangement patterns illustrated in FIGS. 6B through 6E and the mask patterns illustrated in FIGS. 29A through 29D and FIGS. 30A through 30D, so that code values of "1" alternate in the logical sum patterns in the X direction. Further, the recording element rows discharging cyan ink and magenta ink perform time-division driving following the driving order illustrated in FIG. 18A for both forward scanning and backward scanning, while the recording element row discharging gray ink performs time-division driving following the driving order illustrated in FIG. 19A. Accordingly, recording with discharge position deviation among reciprocal scans when recording a high-concentration image can be suppressed even when using multiple color inks. Further, discharge position deviation between reciprocal scans can be suppressed when recording low-concentration images according to the present embodiment.

First, description will be made regarding the positions of dots formed by cyan ink, in a case where gradation data having gradation level of level 2 at all pixels of a pixel group 600 dpi×600 dpi is input as gradation data C3. A case of using the mask patterns MP1' through MP 4 illustrated in FIGS. 29A through 29D will be described. FIGS. 31A through 31E are diagrams illustrating images formed by cyan ink in a case where gradation data is input where the gradation level is level 2.

In a case where the gradation value for gradation data is level 4 in all pixel groups in the unit region 211 in FIG. 8, image data is generated where the pixel value for all pixels in the 600 dpi×1200 dpi arrangement "1", as can be understood from the dot arrangement pattern illustrated in FIG. 6C. Accordingly, cyan ink is discharged to pixel regions corresponding to pixels allocated code values "1" in the mask patterns MP1' through MP4' in FIGS. 29A through 29F, as shown in the decoding table in FIG. 10. That is to say, cyan ink is discharged to pixel region corresponding to the gray pixels in FIG. 29A in the first scan, in FIG. 29B in the second scan, in FIG. 29C in the third scan, and in FIG. 29D in the fourth scan.

Of these the first and third scans are forward scans, and the second and fourth scans are backward scans, so the pixels to which cyan ink is discharged in the forward scans are the gray pixels in FIG. 29E, and the pixels to which cyan ink is discharged in the backward scans are the gray pixels in FIG. 29F.

Figure 31A:
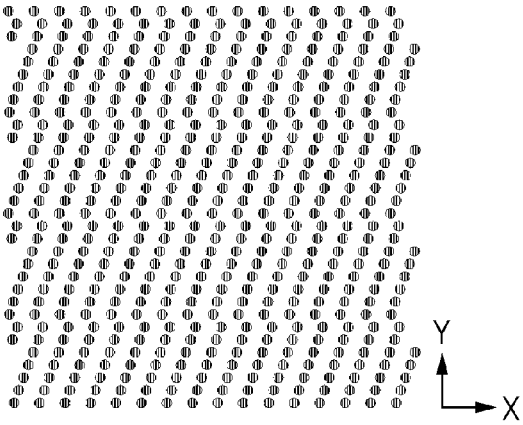
FIGS. 31A through 31E are schematic diagrams illustrating an image recorded by ink of one color in an embodiment.
Figure 31B:
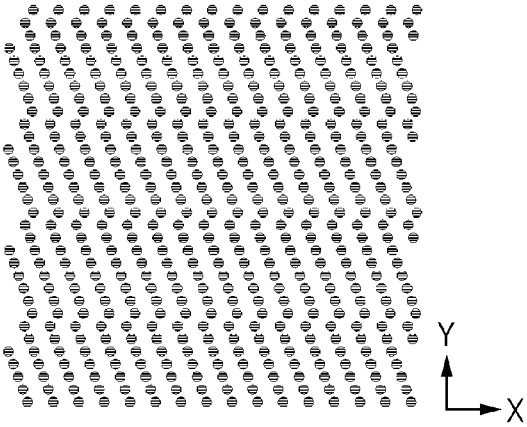
Figure 31C:
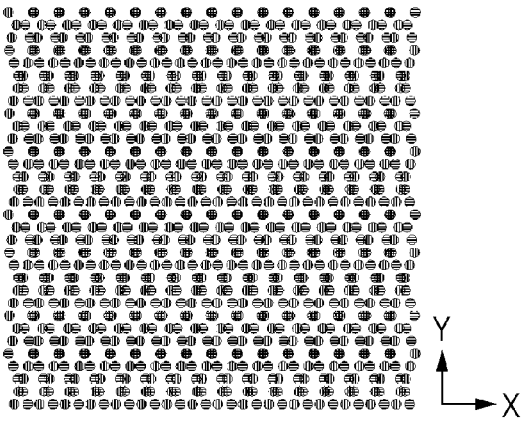
Figure 31D:
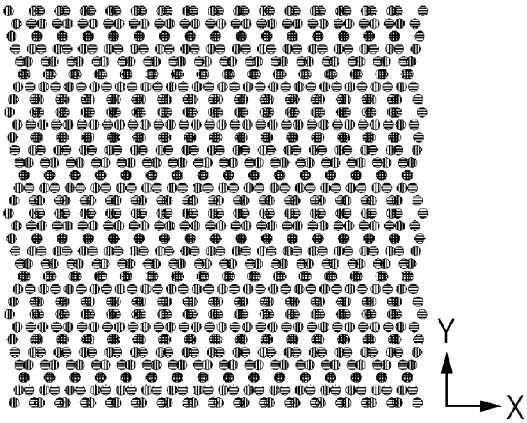

By performing time-division driving in the driving order illustrated in FIG. 18A for both forward scanning and backward scanning, cyan ink will be discharged and dots formed at the positions illustrated in FIG. 31A for the forward scans and in FIG. 31B for the backward scans, if there is no deviation between reciprocal scans. FIG. 31C illustrates a dot arrangement where the dot arrangements in FIGS. 31A and 31B have been overlaid with no positional deviation. FIG. 31D illustrates a case where the dot arrangements have been overlaid with positional deviation of 21.2 μm (equivalent to 1200 dpi) toward the downstream side in the X direction in the backward scan, and FIG. 31E illustrates a case where the dot arrangements have been overlaid with positional deviation of 42.3 μm (equivalent to 600 dpi) toward the downstream side in the X direction in the backward scan.

It can be seen in FIG. 31C that, with regard to the rows extending in the X direction, there are rows where dots from the forward scans and dots from the backward scans are recorded almost completely overlapped, rows partly overlapped, and rows recorded without hardly any overlapping, these various states being intermingled. In FIG. 31D, dots in rows overlapped to begin with newly emerge, while dots in rows that were deviated without overlapping to begin with newly overlap, thereby canceling out variation in concentration. This is also true in FIG. 31E, in that dots in rows overlapped to begin with newly emerge, while dots in rows that were deviated without overlapping to begin with newly overlap, thereby canceling out variation in concentration.

Figure 31E:
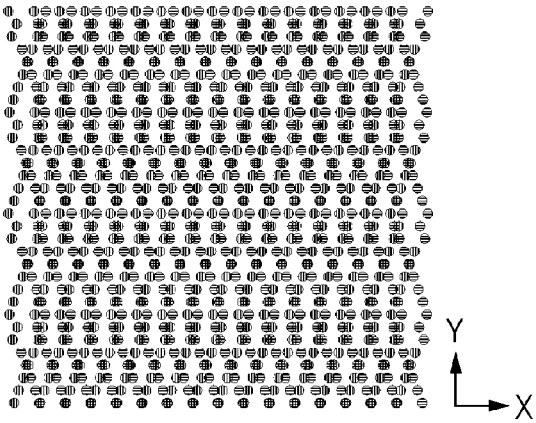

Thus, when viewed as an overall image, there is hardly any variation in concentration occurring in comparison with the case in FIG. 31C where there is no deviation between reciprocal scans, regardless of whether the amount deviation between reciprocal scans is 21.2 μm upstream in the X direction, illustrated in FIG. 31D, or the amount deviation between reciprocal scans is 42.3 μm upstream in the X direction, illustrated in FIG. 31E. Accordingly, it can be seen from FIGS. 31A through 31E that recording can be performed with suppressed discharge position deviation between reciprocal scans when recording images with relatively low concentration where one dot is recorded in one pixel region, according to the mask patterns and driving orders according to the present embodiment.

As a comparison, description will be made regarding the positions of dots formed by cyan ink, in a case where gradation data having gradation level of level 2 at all pixels of a pixel group 600 dpi×600 dpi is input as gradation data C3, using the mask patterns illustrated in FIGS. 17A through 17D used in the first embodiment. FIGS. 32A through 32E are diagrams illustrating images formed by cyan ink in a case where gradation data is input where the gradation level is level 2, using the mask patterns MP1 through MP4 illustrated in FIGS. 17A through 17D.

In a case where the gradation value for gradation data is level 2 in all pixel groups in the unit region 211 in FIG. 8, image data is generated where the pixel value for all pixels in the 600 dpi×1200 dpi arrangement "1", as can be understood from the dot arrangement pattern illustrated in FIG. 6C. Accordingly, cyan ink is discharged to pixel regions corresponding to pixels allocated code values "1" in the mask patterns MP1 through MP4 in FIGS. 17A through 17F, as shown in the decoding table in FIG. 10. That is to say, cyan ink is discharged to pixel region corresponding to the gray pixels in FIG. 17A in the first scan, in FIG. 17B in the second scan, in FIG. 17C in the third scan, and in FIG. 17D in the fourth scan.

Of these the first and third scans are forward scans, and the second and fourth scans are backward scans, so the pixels to which cyan ink is discharged in the forward scans are the gray pixels in FIG. 17E, and the pixels to which cyan ink is discharged in the backward scans are the gray pixels in FIG. 17F.

Figure 32A:
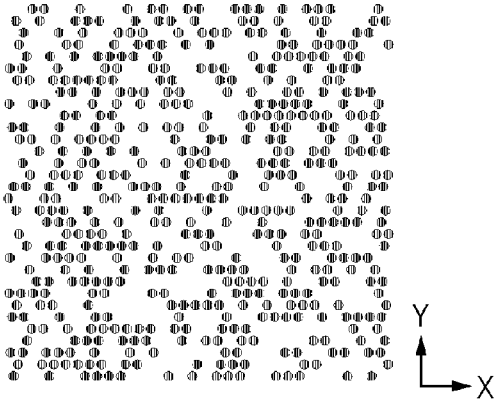
FIGS. 32A through 32E are schematic diagrams illustrating an image recorded by ink of one color in a comparative example.
Figure 32B:
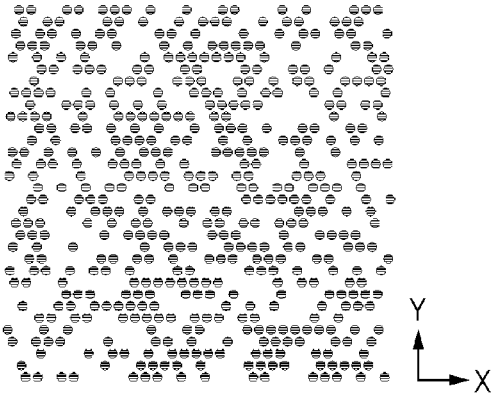
Figure 32C:
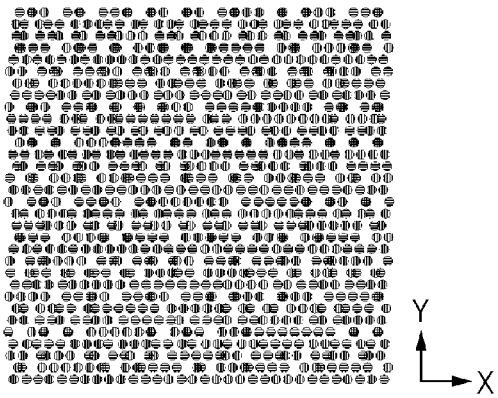
Figure 32D:
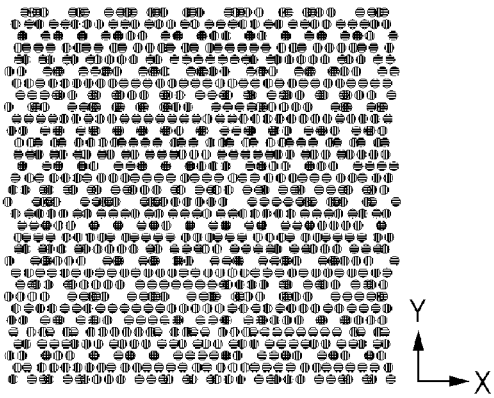
Figure 32E:
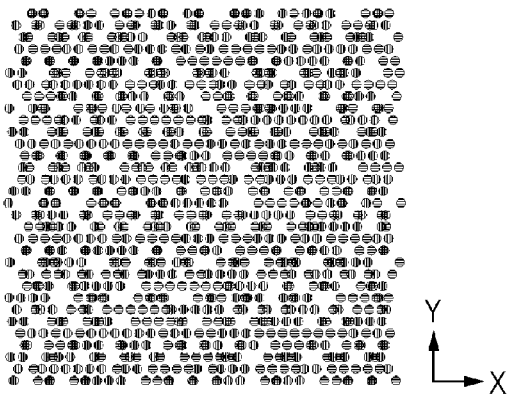

By performing time-division driving in the driving order illustrated in FIG. 18A for both forward scanning and backward scanning, cyan ink will be discharged and dots formed at the positions illustrated in FIG. 32A for the forward scans and in FIG. 32B for the backward scans, if there is no deviation between reciprocal scans. FIG. 32C illustrates a dot arrangement where the dot arrangements in FIGS. 32A and 32B have been overlaid with no positional deviation. FIG. 32D illustrates a case where the dot arrangements have been overlaid with positional deviation of 21.2 μm (equivalent to 1200 dpi) toward the downstream side in the X direction in the backward scan, and FIG. 32E illustrates a case where the dot arrangements have been overlaid with positional deviation of 42.3 μm (equivalent to 600 dpi) toward the downstream side in the X direction in the backward scan.

It can be seen in FIG. 32C that, in comparison with the comparative example, there are rows where dots from the forward scans and dots from the backward scans are recorded almost completely overlapped, rows partly overlapped, and rows recorded without hardly any overlapping, these various states being intermingled. Accordingly, in a case where the deviation between reciprocal scans is relatively small, as illustrated in FIG. 32D the overlapping and missing of dots is somewhat more than the case illustrated in FIG. 32C, but images with little difference can be recorded. However, in a case where the deviation between reciprocal scans becomes relatively large, overlapping and missing dots become pronounced as illustrated in FIG. 32E, and deterioration in image quality is visually recognizable. The dispersion in the X direction of pixels set for recording is low, so deterioration in image quality cannot be suppressed in a case where deviation between reciprocal scans is large. Accordingly, confirmation by experimentation can be made that the second embodiment can suppress discharge position deviation of a single color ink between reciprocal scans when recording a low-concentration image, as compared with the first embodiment.

Next, the positions of dots formed in a case where the driving order of driving blocks is changed in time-division driving among multiple colors will be described. Description will be made here regarding a case of using the mask patterns MP1" through MP4" illustrated in FIGS. 30A through 30D.

Figure 33A:
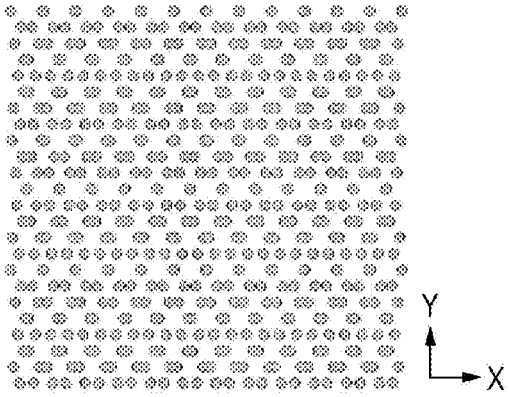
FIGS. 33A through 33D are schematic diagrams illustrating an image recorded by ink of multiple colors in an embodiment.
Figure 33B:
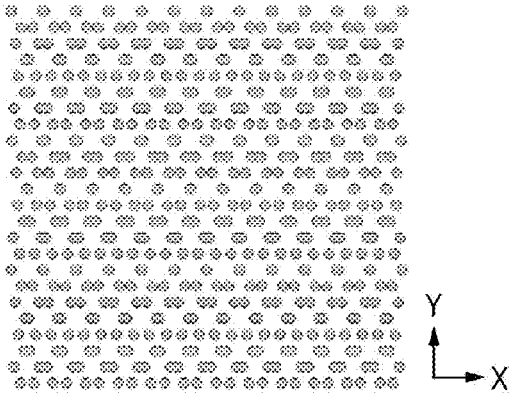
Figure 33C:
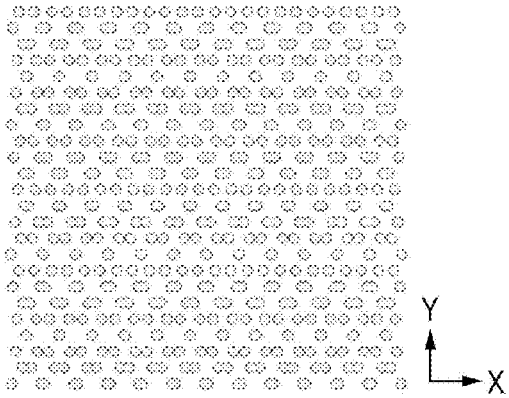
Figure 33D:
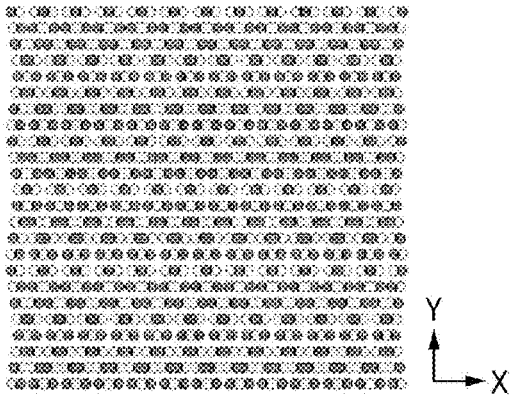

FIGS. 33A through 33D are diagrams illustrating dot arrangements formed by generating recording data using the dot arrangement patterns illustrated in FIGS. 6B through 6E and the mask patterns illustrated in FIGS. 30A through 30D, in the driving order illustrated in FIG. 18A for both forward scanning and backward scanning of each of cyan ink and magenta ink, and in the driving order illustrated in FIG. 19A for both forward scanning and backward scanning of gray ink. FIG. 33A illustrates dot arrangements of cyan ink, FIG. 33B illustrates dot arrangements of magenta ink, and FIG. 33C illustrates dot arrangements of gray ink. Further, FIG. 33D illustrates the dots of cyan ink, magenta ink, and gray ink, illustrated in FIGS. 33A, 33B, and 33C, having been overlaid.

Note that FIGS. 33A through 33D only illustrate dots formed by S_Ev out of row S_Ev and row S_Od making up the recording element rows for each of the cyan ink, magenta ink, and gray ink, for the sake of simplicity. The circles with the vertical lines inside in FIGS. 33A through 33D represent cyan ink and magenta ink dots, and the circles with horizontal lines inside represent gray ink dots. FIGS. 33A through 33D illustrate dots formed in case where gradation data having gradation level of level 2 is input to all pixels of a 600 dpi×1200 dpi arrangement.

As described above, the same dot arrangement patterns and mask patterns are applied to each of the cyan ink, magenta ink, and gray ink in the present embodiment. Accordingly, the recording data C5 corresponding to the cyan ink, the recording data M5 corresponding to the magenta ink, and the recording data G5 corresponding to the gray ink, are set to discharge ink to the same pixels.

Further, the recording element row for discharging cyan ink and the recording element row for discharging magenta ink both perform time-division driving in the driving order illustrated in FIG. 18A. Accordingly, the arrangement of cyan dots and magenta dots is the same, which can be seen in FIGS. 33A and 33B.

On the other hand, the recording element row for discharging gray ink performs the time-division driving in the driving order illustrated in FIG. 19A, which is different from that of the recording element row for the cyan ink and magenta ink. Accordingly, the arrangement of gray ink dots illustrated in FIG. 33C is different from the arrangement of cyan and magenta ink dots illustrated in FIGS. 33A and 33B.

Accordingly, the dot arrangement where cyan, magenta, and gray have been overlaid can sufficiently cover the surface of the recording medium, which can be seen in FIG. 33D. This is because the dot arrangement of gray ink dots is dense where the dot arrangement of cyan ink and magenta ink dots is sparse, and the dot arrangement of gray ink dots is sparse where the dot arrangement of cyan ink and magenta ink dots is dense. Thus, a situation where the dot arrangements of all inks are superimposed can be avoided, and accordingly graininess can be suppressed.

As described above, graininess due to dot arrangements of multiple color inks being superimposed can be suppressed by changing the driving order of gray ink, which is often used at the same time as other colors, from the driving order of inks of other colors.

As a comparison, the position of dots formed using the mask patterns illustrated in FIG. 30A through 30D, and all of cyan ink, magenta ink, and gray ink are subjected to time-division driving with the driving order illustrated in FIG. 18A for both forward scanning and backward scanning, will be described.

Figure 34A:
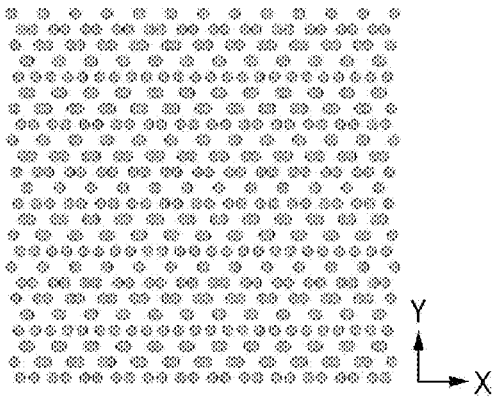
FIGS. 34A through 34D are schematic diagrams illustrating an image recorded by ink of multiple colors in a comparative example.
Figure 34B:
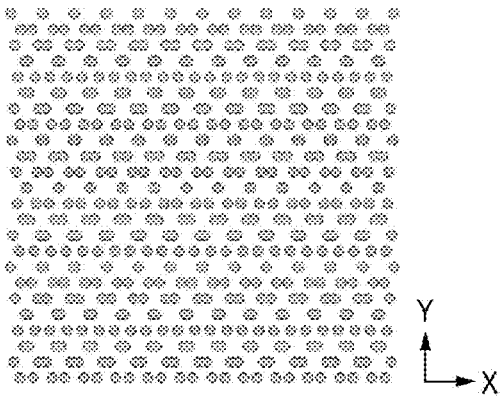
Figure 34C:
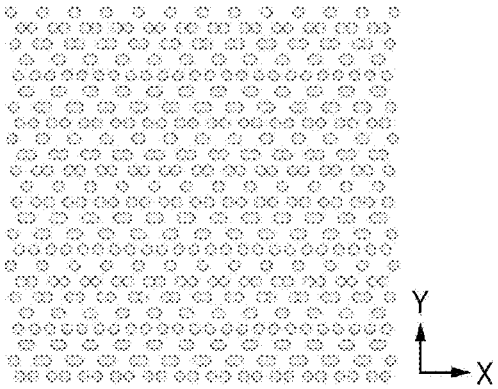
Figure 34D:
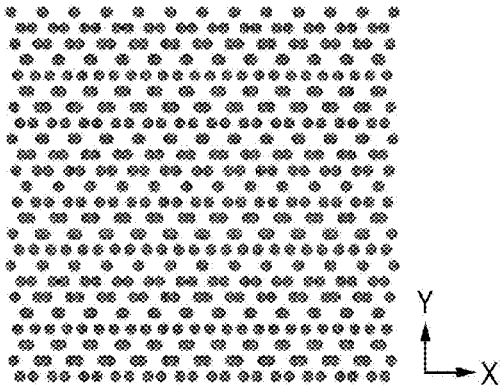

FIGS. 34A through 34D are diagrams illustrating dot arrangements formed by generating recording data using the dot arrangement patterns illustrated in FIGS. 6B through 6E and the mask patterns illustrated in FIGS. 30A through 30D, in the driving order illustrated in FIG. 18A for both forward scanning and backward scanning of each of cyan ink, magenta ink, and gray ink. FIG. 34A illustrates dot arrangements of cyan ink, FIG. 34B illustrates dot arrangements of magenta ink, and FIG. 34C illustrates dot arrangements of gray ink. Further, note that FIG. 34D illustrates the dots of cyan ink, magenta ink, and gray ink, illustrated in FIGS. 34A, 34B, and 34C, having been overlaid.

Note that FIGS. 34A through 34D only illustrate dots formed by S_Ev out of row S_Ev and row S_Od making up the recording element rows for each of the cyan ink, magenta ink, and gray ink, for the sake of simplicity, in the same way as in FIGS. 33A through 33D. The circles with the vertical lines inside in FIGS. 34A through 34D represent cyan ink and magenta ink dots, and the circles with horizontal lines inside represent gray ink dots. FIGS. 34A through 34D illustrate dots formed in case where gradation data having gradation level of level 2 is input to all pixels of a 600 dpi×1200 dpi arrangement.

As described above, the same dot arrangement patterns and mask patterns are applied to each of the cyan ink, magenta ink, and gray ink in the comparative example. Accordingly, the recording data C5 corresponding to the cyan ink, the recording data M5 corresponding to the magenta ink, and the recording data G5 corresponding to the gray ink, are set to discharge ink to the same pixels.

Further, the recording element row for discharging cyan ink and the recording element row for discharging magenta ink both perform time-division driving in the driving order illustrated in FIG. 18A. Accordingly, the arrangement of cyan dots and magenta dots is the same, which can be seen in FIGS. 34A and 34B. The dot arrangement patterns are the same as in FIGS. 33A and 33B.

Also, the recording element row for discharging gray ink performs the time-division driving in the driving order illustrated in FIG. 18A. Accordingly, the arrangement of gray ink dots illustrated in FIG. 34C is no different from the arrangement of cyan and magenta ink dots illustrated in FIGS. 34A and 34B.

Accordingly, when the cyan, magenta, and gray are overlaid, the arrangements of all of the dots are superimposed on each other, as illustrated in FIG. 34D. As a result, the surface of the recording medium cannot sufficiently be covered with dots, as can be seen in comparison with FIG. 33D. Consequently, images with conspicuous graininess may be recorded. Comparing the dot arrangement of multiple colors of ink recorded by the second embodiment illustrated in FIG. 33D with the dot arrangement of multiple colors of ink recorded by the comparative example in FIG. 34D clearly shows that graininess can be suppressed by applying the second embodiment.

As described above, discharge position deviation between reciprocal scans can be suppressed according to the present embodiment not only when recording images in high concentration, but also when recording images in low concentration. Further, gray ink that is often used along with ink of other colors is set to have a different driving order as to inks of other colors, so graininess due to superimposing dot positions among inks of multiple colors can be suppressed.

Although description has been made in the present embodiment regarding a mask pattern where, of pixels to which code value "1" has been allocated in one logical sum pattern, all pixels are adjacent on both sides in the X direction to pixels allocated code value "1" in the other logical sum pattern, other arrangements may be made. In order to obtain the advantages of the present embodiment, it is sufficient that, of the pixels allocated code value "1" in one logical sum pattern, the number of pixels adjacent on both sides in the X direction to a pixel allocated code value "1" in the other logical sum pattern is greater than the number of pixels to which no pixel allocated code value "1" in the other logical sum pattern is adjacent in the X direction.

Third Embodiment

An arrangement has been described in the first and second embodiments where the driving order of the recording element row that discharges gray ink is different from the driving order of the recording element rows that discharge cyan ink and magenta ink. A third embodiment will be described where the driving order differs from that in the first and second embodiments. Description of portions that are the same in the first and second embodiments will be omitted.

Figure 35A:
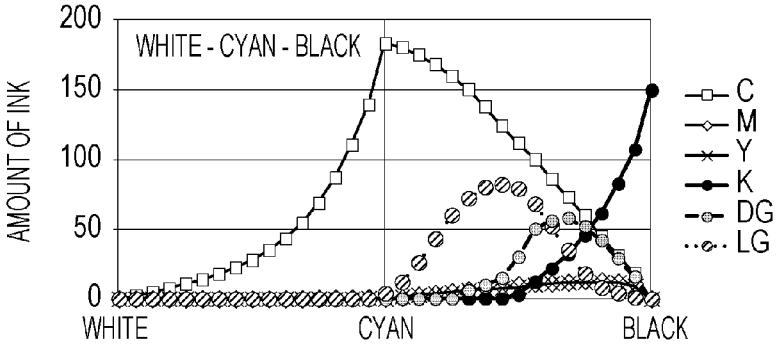
FIGS. 35A through 35D are diagrams illustrating color separation tables according to an embodiment.
Figure 35B:
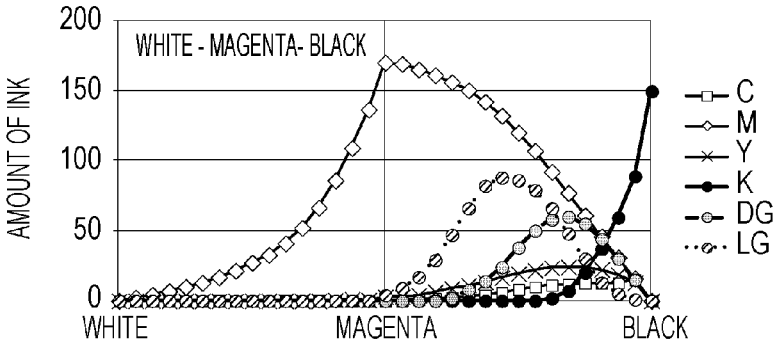
Figure 35C:
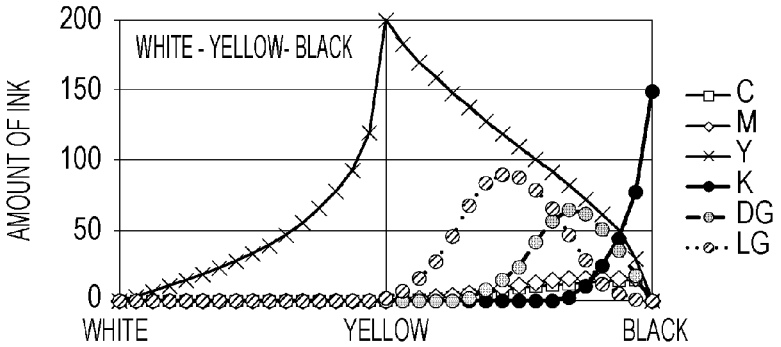
Figure 35D:
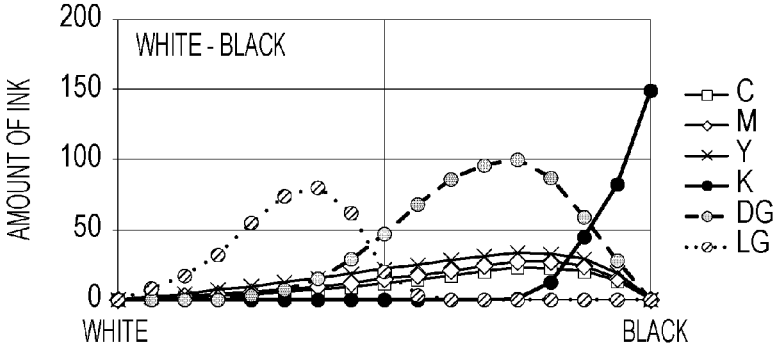

The present embodiment uses six inks, which are cyan (C), magenta (M), yellow (Y), black (K), dark gray (DG), and light gray (LG). FIGS. 35A through 35D are diagrams illustrating examples of color separation tables in a system using the six inks of cyan (C), magenta (M), yellow (Y), black (K), dark gray (DG), and light gray (LG) ink. FIG. 35A is a color separation table illustrating a cyan line of white-cyan-black, FIG. 35B illustrates a magenta line of white-magenta-black, FIG. 35C illustrates a yellow line of white-yellow-black, and FIG. 35D illustrates a white-black gray line.

It can be seen from FIGS. 35A through 35D that, the cyan, magenta and yellow inks are used on the respective main color axes and the gray lines, while dark gray and light gray is achromatic, and accordingly is broadly used in all axes. That is to say, the probability that dark gray and light gray will be used at the same time as any of cyan, magenta, and yellow ink is high. Accordingly, these grays are set to have a different block driving order, so that the dot arrangements are different from ink of the other colors. This enables efficient covering of the paper over broad color regions, and also aids in improvement of graininess.

The way in which the dark gray and light gray are used has the same tendency in each of the lines in FIGS. 35A through 35D. That is to say, first the light gray is gradually increased to lower lightness, following which the light gray is reduced as dark gray is introduced, following which dark gray is gradually increased to further lower lightness. Thus, there is always a color region where dark gray and light gray are used at the same time, so changing the block driving order of these two and offsetting the dot arrangement enables the face of the sheet to be covered more efficiently.

In light of the above points, the driving order of driving blocks is made to differ in the present embodiment regarding the three sets of recording element rows, which are the recording element rows discharging cyan ink and magenta ink, the recording element row discharging light gray ink, and the recording element row discharging dark gray ink. Specifically, the recording element rows discharging cyan ink and magenta ink perform time-division driving in the driving order illustrated in FIG. 18A described in the first embodiment, for both forward scanning and backward scanning. The recording element row discharging light gray ink performs time-division driving in the driving order illustrated in FIG. 19A described in the first embodiment, for both forward scanning and backward scanning.

On the other hand, FIG. 36A is a diagram illustrating an example of the driving order of driving blocks in recording element row discharging dark gray ink, executed in the present embodiment. FIG. 36B is a schematic diagram illustrating the way in which dots are formed in a case of driving recording element No. 1 through No. 16 while scanning in the forward direction scan following the driving order shown in FIG. 36A. FIG. 36C is a schematic diagram illustrating the way in which dots are formed in a case of driving recording element No. 1 through No. 16 while scanning in the backward direction scan following the driving order shown in FIG. 36A.

Now, the driving order of discharging dark gray ink illustrated in FIG. 36A is an order where the driving order has been offset forwards by four as compared to the driving order at the recording element row of the recording element rows discharging cyan ink and magenta ink illustrated in FIG. 18A. Similarly, the driving order at the recording element row of discharging dark gray ink illustrated in FIG. 36A is an order where the driving order has been offset backwards by four as compared to the driving order of the recording element row discharging light gray ink illustrated in FIG. 19A.

Thus, differentiating these three, i.e., the driving order of the recording element row discharging dark gray ink, the driving order of the recording element row discharging light gray ink, and the driving order of the recording element rows discharging cyan ink and magenta ink, enables the landing positions of dark gray ink, the landing positions of light gray ink, and the landing positions of cyan ink and magenta ink, to be offset, even if the recording data is set for these inks to be applied to the same pixels. Accordingly, graininess can be suppressed.

Fourth Embodiment

A fourth embodiment will be described where the driving order differs from that in the first through third embodiments. Description of portions that are the same in the first through third embodiments will be omitted. The present embodiment uses six inks, which are cyan (C), magenta (M), yellow (Y), black (K), light cyan (LC), and light magenta (LM). Light cyan ink is an ink that has approximately the same hue as cyan ink, but has a lower concentration than cyan ink. Light magenta ink is an ink that has approximately the same hue as magenta ink, but has a lower concentration than magenta ink.

Figure 37A:
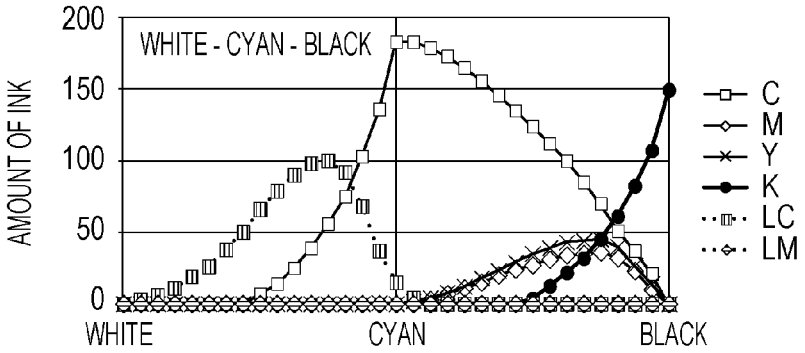
FIGS. 37A through 37D are diagrams illustrating color separation tables according to an embodiment.
Figure 37B:
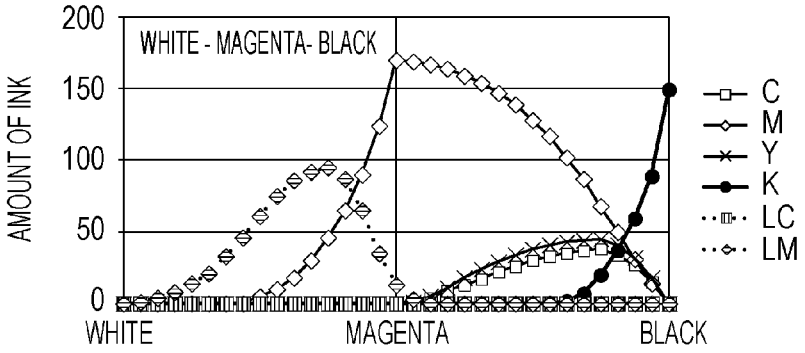
Figure 37C:
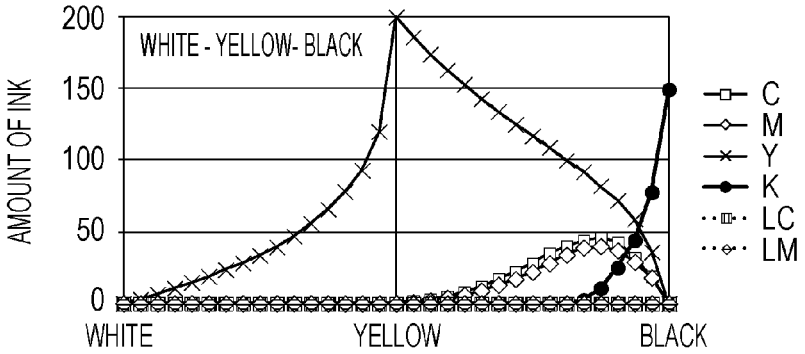
Figure 37D:
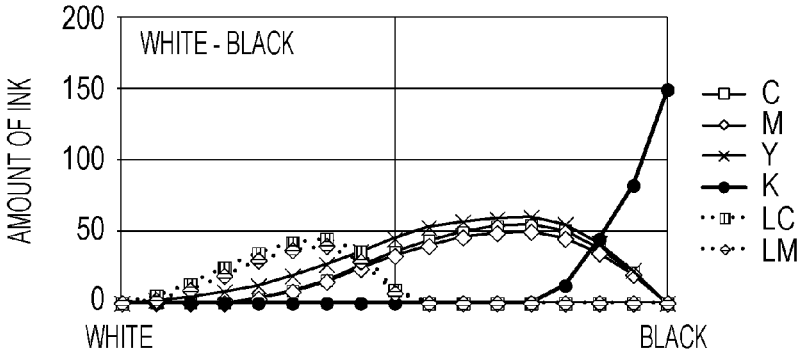

FIGS. 37A through 37D are diagrams illustrating examples of color separation tables in a system using the six inks of cyan (C), magenta (M), yellow (Y), black (K), light cyan (LC), and light magenta (LM) ink. FIG. 37A is a color separation table illustrating a cyan line of white-cyan-black, FIG. 37B illustrates a magenta line of white-magenta-black, FIG. 37C illustrates a yellow line of white-yellow-black, and FIG. 37D illustrates a white-black gray line.

The way in which the cyan and light cyan, and magenta and light magenta, are used, is the same way as with the dark gray and light gray described in the third embodiment, as illustrated in FIGS. 37A 37B, and 37D. That is to say, first the light ink (LC or LM) is gradually increased to lower lightness, following which the light ink is reduced as dark ink (C or M) is introduced, following which dark ink is gradually increased to further lower lightness. Thus, there is always a color region where dark ink (C or M) and light ink (LC or LM) are used at the same time.

In light of the above points, the driving order of driving blocks is made to differ in the present embodiment regarding the two sets of recording element rows, which are the recording element rows discharging cyan ink and magenta ink, and the recording element rows discharging light cyan ink and light magenta ink. Specifically, the recording element rows discharging cyan ink and magenta ink perform time-division driving in the driving order illustrated in FIG. 18A described in the first embodiment, for both forward scanning and backward scanning. The recording element rows discharging light cyan ink and light magenta ink perform time-division driving in the driving order illustrated in FIG. 19A described in the first embodiment, for both forward scanning and backward scanning.

Thus, differentiating these two, i.e., the driving order of the recording element rows discharging cyan ink and magenta ink, the driving order of the recording element rows discharging light cyan ink and light magenta ink, enables the landing positions of cyan ink and magenta ink, and the landing positions of light cyan ink and light magenta ink, to be offset, even if the recording data is set for these inks to be applied to the same pixels. Accordingly, graininess can be suppressed.

Fifth Embodiment

A fifth embodiment will be described where the driving order of ink differs from that in the first through fourth embodiments. Description of portions that are the same in the first through fourth embodiments will be omitted. The present embodiment uses five inks, which are cyan (C), magenta (M), yellow (Y), black (K), and light blue (LB). Light blue ink is an ink that has approximately the same hue as blue, which is a color reproducible by adding equal amounts of cyan ink and magenta ink, but has a lower concentration than blue.

Figure 38A:
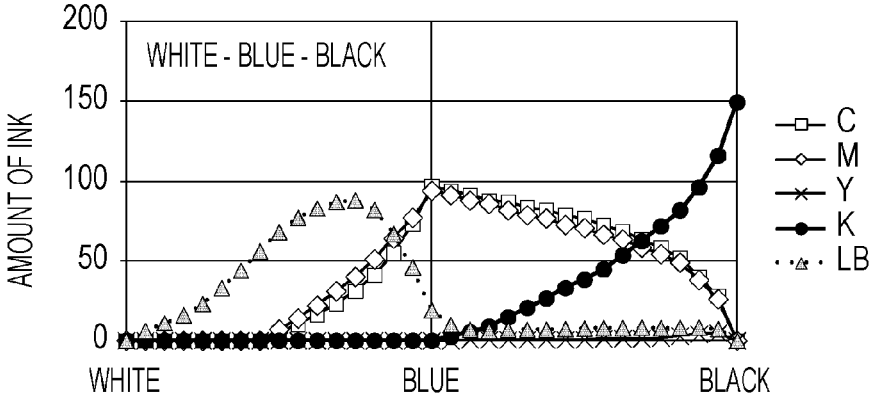
FIGS. 38A and 38B are diagrams illustrating color separation tables according to an embodiment.
Figure 38B:
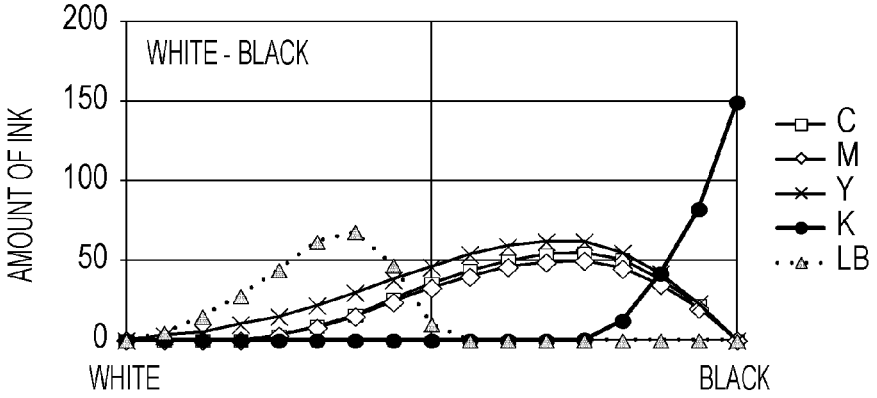

FIGS. 38A and 38B are diagrams illustrating examples of color separation tables in a system using the five inks of cyan (C), magenta (M), yellow (Y), black (K), and light blue (LB) ink. FIG. 38A is a color separation table illustrating a blue line of white-blue-black, and FIG. 38B illustrates a white-black gray line.

The way in which the cyan, magenta, and light blue, are used, is the same way as with the dark gray and light gray described in the third embodiment, as illustrated in FIGS. 38A and 38B. That is to say, first the light blue (LB) is gradually increased to lower lightness, following which the light blue (LB) is reduced as dark ink (C and M) are introduced, following which dark ink is gradually increased to further lower lightness.

In light of the above points, the driving order of driving blocks is made to differ in the present embodiment regarding the two sets of recording element rows, which are the recording element rows discharging cyan ink and magenta ink, and the recording element row discharging light blue ink. Specifically, the recording element rows discharging cyan ink and magenta ink perform time-division driving in the driving order illustrated in FIG. 18A described in the first embodiment, for both forward scanning and backward scanning. The recording element row discharging light blue ink performs time-division driving in the driving order illustrated in FIG. 19A described in the first embodiment, for both forward scanning and backward scanning.

Thus, differentiating these two, i.e., the driving order of the recording element rows discharging cyan ink and magenta ink, and the driving order of the recording element row discharging light blue ink, enables the landing positions of cyan ink and magenta ink, and the landing positions of light blue ink, to be offset, even if the recording data is set for these inks to be applied to the same pixels. Accordingly, graininess can be suppressed.

Arrangements have been described in the above embodiments where discharge deviation is suppressed between forward scans and backward scans in a case where forward scanning and backward scanning is performed as to a unit region. Accordingly, description has been made that the driving order at the time of backward scanning needs to be the opposite order to the driving order at the time of forward scanning, that the driving order at the time of backward scanning preferably is different from the opposite order to an offset order of the driving order at the time of forward scanning, and the order is more preferably the same as the driving order at the time of forward scanning.

However, the present invention is not restricted to the above-described arrangements, and in a case where recording is performed multiple times by scanning in one way as to a unit region, the present invention can be used to suppress discharge position deviation between a first type of scan and a second type of scan. For example, in a case where, out of multiple scans, a first type of scan is a scan of a first half and a second type of scan is a scan of a second half, discharge position deviation between the scan of the first half and the scan of the second half can be suppressed. In this case, the driving order of the second type of scan needs to be the opposite order to the driving order of the first type of scan, the driving preferably is the opposite order to an offset order of the driving order of the first type of scan, and the driving order is more preferably the opposite order as the driving order of the first type of scan.

The reason is that, as described with reference to FIGS. 11A through 11C and other drawings, when performing reciprocal scanning using the same driving order, the ink landing positions from the driving blocks under time-division driving control are positions inverted from each other, and when performing one-way scanning with the same driving order, the ink landing positions from the driving blocks under time-division driving control are the same positions. It can thus be understood that the ink landing positions from the driving blocks when time-division driving is performed with the driving order of the second type of scan being opposite to the driving order of the first type of scan in a case of one-way scanning for example, and the ink landing positions from the driving blocks when time-division driving is performed with the same order for the driving order of the forward scan and the driving order of the backward scan in reciprocal scanning, are the same.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

Although arrangements have been described above in the embodiments regarding differentiating the driving order of recording element rows discharging inks of different colors from each other, other arrangements may be made as well. For example, the driving order of recording element rows discharging ink of different dot sizes may be differentiated from each other. Accordingly, the ink landing positions can be offset between large dot sizes and small dot sizes. Also, the driving order of row S_Ev and row S_Od may be differentiated from each other. Accordingly, the ink landing positions can be offset between row S_Ev and row S_Od. Thus, the present invention is not restricted to application among recording element rows discharging ink of different colors, and can be applied among recording element rows discharging ink of different dot sizes, or among recording element rows disposed offset in the Y direction.

Although arrangements have been described above in the embodiments regarding applying the same mask pattern to image data corresponding to inks of different colors, other arrangements may be made. That is to say, different mask patterns may be applied to image data corresponding to inks of different colors. In this case, the advantages of the embodiments can be obtained if the mask patterns applied to inks of each color satisfy the conditions described in the embodiments.

Although description has been made in the embodiments regarding an arrangement where the driving order of gray ink is made to differ from the driving order of cyan ink and magenta ink, an arrangement where the driving order of light cyan ink and light magenta ink is made to differ from the driving order of cyan ink and magenta ink, and an arrangement where the driving order of light blue ink is made to differ from the driving order of cyan ink and magenta ink, other arrangements may be made. Advantages of the present invention can be obtained by an arrangement where the driving order of one color ink is different from the driving order of another color ink.

Although arrangements have been described above in the embodiments regarding using multi-value mask patterns configured using multiple bit information indicating the number of times ink discharge is permitted to each pixel, the present invention may be carried out by other arrangements instead. For example, a binary mask pattern configured using 1-bit information indicating permission/non-permission of ink discharge as to each pixel may be used.

Although description has been made in the embodiments regarding an arrangement where two passes each are performed of a forward scan and a backward scan as to a unit region, and to an arrangement where two passes each are performed for one of a forward scan and a backward scan as to a unit region and one pass for the other, other arrangements may be made. That is, the present invention can be applied as long as K ($K \geq 1$) forward scans and L ($L \geq 1$) backward scans are performed as to a unit region. In this case, K mask patterns for forward scanning and L mask patterns for backward scanning may be used.

Although description has been made in the embodiments regarding an arrangement where recording is performed while conveying a recording medium between multiple scans as to a unit region, the present invention may be carried out by other arrangements as well. That is to say, an arrangement may be made where multiple scans are performed for recording on a unit region without performing conveyance of the recording medium.

The present invention is not restricted to a thermal-jet ink jet recording apparatus. The present invention can be effectively applied to various recording apparatuses, such as a piezoelectric ink jet recording apparatus that discharges ink using piezoelectric elements, for example.

Although a recording method using a recording apparatus has been described in the embodiments, an arrangement may be made where an image processing apparatus, image processing method, and program, to generate data for performing the recording method described in the embodiments, are provided separately from the recording apparatus. It is needless to say that the present invention is widely applicable to an arrangement provided to part of a recording apparatus.

Also, the term "recording medium" is not restricted to paper used in general recording apparatuses, and broadly includes any material capable of accepting ink, including cloth, plastic film, metal plates, glass, ceramics, wood, leather, and so forth.

Further, the term "ink" refers to a liquid that, by being applied onto a recording medium, is used to form images designs, patterns, or the like, or to process the recording medium, or for processing of ink (e.g., solidification or insolubilization of coloring material in the ink applied to the recording medium.

According to the recording apparatus, recording method, and program according to the present invention, recording can be performed with ink discharge position deviation suppressed among two types of scans without image defects, even in a case of discharging ink of multiple types, such as ink of multiple types of color or multiple dot sizes.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-157606, filed Aug. 7, 2015, Japanese Patent Application No. 2015-178700, filed Sep. 10, 2015, and Japanese Patent Application No. 2015-178701, filed Sep. 10, 2015, which are hereby incorporated by reference herein in their entirety.

What is claimed is:

1. A recording apparatus comprising:

a recording head including recording element rows corresponding to ink of a plurality of types which are different from each other, a plurality of recording elements configured to generate energy to discharge ink of a same type being arrayed in a predetermined direction in each of the recording element rows;

a scanning unit configured to execute (i) a first scan of the recording head over a unit region on a recording medium, a predetermined number of times in a first direction following an intersecting direction intersecting the predetermined direction, and (ii) a second scan of the recording head over the unit region, the predetermined number of times in a second direction opposite to the first direction;

an obtaining unit configured to obtain first image data determining the number of times of discharge of ink to each of a plurality of pixel regions within the unit region for each pixel;

a generating unit configured to generate a plurality of sets of recording data determining discharge or non-discharge of the ink to each of the plurality of pixel regions in each of the predetermined number of first and second scans for each pixel, based on the image data and mask patterns corresponding to the first and second scans, each of the mask patterns determining the number of times permitted for discharge of ink to each of the plurality of pixel regions for each pixel;

a driving unit configured to, (i) drive a plurality of first recording elements such that the first recording elements belonging to different first driving blocks are driven at different timings from each other, the plurality of first recording elements corresponding to the unit region in the predetermined number of times of the first scan of the plurality of recording elements, and the first driving blocks being obtained by the plurality of first recording elements being divided, and (ii) drive a plurality of second recording elements such that the second recording elements belonging to different second driving blocks are driven at different timings from each other, the plurality of second recording elements corresponding to the unit region in the predetermined number of times of the second scan of the plurality of recording elements, and the second driving blocks being obtained by the plurality of second recording elements being divided; and a control unit configured to, in each of the predetermined number of times of the first and second scans by the scanning unit, discharge ink to the unit region by driving the plurality of recording elements with the driving unit, based on the plurality of sets of recording data generated by the generating unit, wherein (i) driving orders of the first driving blocks are different from each other as between the ink of different types, (ii) the driving orders of the second driving blocks are different from each other as between the ink of different types, and (iii) the driving order of the second driving blocks is different from an opposite order of the driving order of the first driving blocks with regard to ink of a same type, and wherein with regard to each pixel, the number of times permitted for discharge of ink indicated by a first logical sum pattern and the number of times permitted for discharge of ink indicated by a second logical sum pattern are larger than zero and are different from each other, (i) the first logical sum pattern being obtained by the logical sum of the number of times permitted for discharge of ink to each of the pixels in the mask patterns corresponding to the predetermined number of times of the first scan and ink of a same type, and (ii) the second logical sum pattern being obtained by the logical sum of the number of times permitted for discharge of ink to each of the pixels in the mask patterns corresponding to the predetermined number of times of the second scan and ink of a same type.

2. The recording apparatus according to claim 1, wherein the driving order of the second driving blocks is different from an opposite order of the driving order of the first driving blocks that has been offset with regard to ink of the same type.

3. The recording apparatus according to claim 2, wherein the driving order of the second driving blocks is the same as the driving order of the first driving blocks with regard to ink of the same type.

4. The recording apparatus according to claim 1, wherein the ink of the plurality of types are different in color.

5. The recording apparatus according to claim 4, wherein the ink of the plurality of types includes at least ink of a first color, ink of a second color which is different from the first color, and ink of a third color which is different form the first and second colors, and wherein (i) the driving order of the first driving blocks corresponding to the first color is the same order as the driving order of the first driving blocks corresponding to the third color, and (ii) the driving order of the first driving blocks corresponding to the first color is different from the driving order of the first driving blocks corresponding to the second color.

6. The recording apparatus according to claim 5, wherein the first color and the third color each are one of cyan, magenta, and yellow, and the second color is gray.

7. The recording apparatus according to claim 5, wherein the first color and the third color each are one of cyan, magenta, and yellow, and the second color is one of light cyan and light magenta.

8. The recording apparatus according to claim 5, wherein the first color and the third color each are one of cyan, magenta, and yellow, and the second color is light blue.

9. The recording apparatus according to claim 1, wherein the ink of the plurality of types is different in size of a dot.

10. The recording apparatus according to claim 1, the number of first pixels where second pixels are adjacent at both sides in the intersecting direction is larger than the number of first pixels where the second pixels are not adjacent at both sides in the intersecting direction, (i) the first pixel being a pixel where the number of times permitted for discharge of ink indicated by a first logical sum pattern is the largest number of times permitted for discharge of ink that can be indicated by the first logical sum pattern, and (ii)

the second pixel being a pixel where the number of times permitted for discharge of ink indicated by a second logical sum pattern is the largest number of times permitted for discharge of ink that can be indicated by the second logical sum pattern.

11. The recording apparatus according to claim 1, further comprising:

a conveying unit configured to convey the recording medium in the predetermined direction between consecutive scans of the predetermined number of times of the first and second scans by the scanning unit.

12. The recording apparatus according to claim 1, wherein the scanning unit alternately performs the first scan and the second scan as to the unit region.

13. A recording apparatus comprising:

a recording head including recording element rows corresponding to ink of a plurality of types which are different from each other, a plurality of recording elements configured to generate energy to discharge ink of a same type being arrayed in a predetermined direction in each of the recording element rows;

a scanning unit configured to execute (i) a first scan of the recording head over a unit region on a recording medium, a predetermined number of times in a first direction following an intersecting direction intersecting the predetermined direction, and (ii) a second scan of the recording head over the unit region, the predetermined number of times in the first direction;

an obtaining unit configured to obtain first image data determining the number of times of discharge of ink to each of a plurality of pixel regions within the unit region for each pixel, a generating unit configured to generate a plurality of sets of recording data determining discharge or non-discharge of the ink to each of the plurality of pixel regions in each of the predetermined number of the first and second scans for each pixel, based on the image data and mask patterns corresponding to the first and second scans, each of the mask patterns determining the number of times permitted for discharge of ink to each of the plurality of pixel regions for each pixel;

a driving unit configured to, (i) drive a plurality of first recording elements such that the first recording elements belonging to different first driving blocks are driven at different timing from each other, the a plurality of first recording elements corresponding to the unit region in the predetermined number of times of the first scan of the plurality of recording elements, and the first driving blocks being obtained by the plurality of first recording elements being divided, and (ii) drive a plurality of second recording elements such that the second recording elements belonging to different second driving blocks are driven at different timing from each other, the plurality of second recording elements corresponding to the unit region in the predetermined number of times of the second scan of the plurality of recording elements, and the second driving blocks being obtained by the plurality of second recording elements being divided; and a control unit configured to, in each of the predetermined number of times of the first and second scans by the scanning unit, discharge ink to the unit region by driving the plurality of recording elements with the driving unit, based on the plurality of sets of recording data generated by the generating unit, wherein (i) the driving orders of the first driving blocks are different from each other as between the ink of different types, (ii) the driving orders of the second driving blocks are different from each other as between the ink of different types, and (iii) the driving order of the second driving blocks is different from the driving order of the first driving blocks with regard to ink of a same type, and wherein with regard to each pixel, the number of times permitted for discharge of ink indicated by a first logical sum pattern and the number of times permitted for discharge of ink indicated by a second logical sum pattern are larger than zero and are different from each other, (i) the first logical sum pattern being obtained by the logical sum of the number of times permitted for discharge of ink to each of the pixel in the mask patterns corresponding to the predetermined number of times of the first scan and ink of a same type, and (ii) the second logical sum pattern being obtained by the logical sum of the number of times permitted for discharge of ink to each of the pixel in the mask patterns corresponding to the predetermined number of times of the second scan and ink of a same type.

14. The recording apparatus according to claim 13, wherein the driving order of the second driving blocks is different from the driving order of the first driving blocks that has been offset with regard to ink of the same type.

15. The recording apparatus according to claim 14, wherein the driving order of the second driving blocks is an opposite order from the driving order of the first driving blocks with regard to ink of the same type.

* * * * *